US007565093B2

(12) United States Patent
Okabe et al.

(10) Patent No.: US 7,565,093 B2
(45) Date of Patent: Jul. 21, 2009

(54) IMAGE-FORMING DEVICE HAVING CARTRIDGE-ACCOMMODATING SECTION

(75) Inventors: Yasushi Okabe, Nagoya (JP); Naoya Kamimura, Nagoya (JP); Shinji Kimura, Kani (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 189 days.

(21) Appl. No.: 11/252,740

(22) Filed: Oct. 19, 2005

(65) Prior Publication Data

US 2006/0083545 A1 Apr. 20, 2006

(30) Foreign Application Priority Data

Oct. 19, 2004 (JP) ..... 2004-304693

(51) Int. Cl.
*G03G 15/00* (2006.01)

(52) U.S. Cl. ..... 399/111

(58) Field of Classification Search ..... 399/111, 399/107, 113, 110

See application file for complete search history.

(56) References Cited

U.S. PATENT DOCUMENTS

| | | | |
|---|---|---|---|
| 5,398,098 | A | 3/1995 | Fukunaga et al. |
| 5,508,785 | A | 4/1996 | Takahashi et al. |
| 5,663,787 | A | 9/1997 | Haneda et al. |
| 5,752,133 | A | 5/1998 | Nagase et al. |
| 6,041,203 | A | 3/2000 | Suzuki et al. |
| 6,330,410 | B1 | 12/2001 | Okabe et al. |
| 6,411,789 | B1 | 6/2002 | Okabe et al. |
| 6,546,217 | B2 | 4/2003 | Okabe et al. |
| 6,674,982 | B2 | 1/2004 | Saitoh et al. |
| 6,690,903 | B2 | 2/2004 | Okabe et al. |
| 6,873,810 | B2 | 3/2005 | Okabe et al. |

(Continued)

FOREIGN PATENT DOCUMENTS

CN 2924592 Y 7/2007

(Continued)

OTHER PUBLICATIONS

European Search report for Application No. 05022725, dated Jul. 5, 2006.

(Continued)

*Primary Examiner*—Quana M Grainger
(74) *Attorney, Agent, or Firm*—Banner & Witcoff, Ltd

(57) ABSTRACT

A first cartridge and a second cartridge are detachably mounted in a housing of the image-forming device. The first cartridge is formed thicker than the second cartridge in a thickness direction orthogonal to a mounting direction of the first and second cartridges. The housing has a cartridge-accommodating section that accommodates the first and second cartridges. The cartridge-accommodating section includes first and second accommodating sections that are disposed continuously along the mounting direction and that are partly displaced with respect to each other in the thickness direction. The second accommodating section is disposed upstream of the first accommodating section with respect to the mounting direction and is formed thicker than the first cartridge and thinner than both the first and second cartridges together when the first and second cartridges are accommodated in the cartridge-accommodating section. The first accommodating section is formed thicker than the first and second cartridges together when the first and second cartridges are accommodated in the cartridge-accommodating section.

31 Claims, 29 Drawing Sheets

U.S. PATENT DOCUMENTS

| | | | | |
|---|---|---|---|---|
| 2002/0172527 | A1* | 11/2002 | Nishiwaki et al. | 399/107 |
| 2003/0161656 | A1 | 8/2003 | Miura et al. | |
| 2004/0096239 | A1 | 5/2004 | Hosokawa et al. | |
| 2005/0002686 | A1 | 1/2005 | Saitoh et al. | |
| 2005/0135837 | A1 | 6/2005 | Okabe et al. | |
| 2006/0083545 | A1 | 4/2006 | Okabe et al. | |

FOREIGN PATENT DOCUMENTS

| | | | |
|---|---|---|---|
| JP | 6222628 | | 8/1994 |
| JP | 8171324 | | 7/1996 |
| JP | 9080854 | | 3/1997 |
| JP | 9081014 | | 3/1997 |
| JP | 9325622 | | 12/1997 |
| JP | 2000267371 | | 9/2000 |
| JP | 2001022149 | | 1/2001 |
| JP | 2002099193 | | 4/2002 |
| JP | 2003287992 | | 10/2003 |
| JP | 2004109455 | | 4/2004 |
| JP | 2004170727 | | 6/2004 |
| JP | 2004212657 | | 7/2004 |
| JP | 2004-240198 | A | 8/2004 |

OTHER PUBLICATIONS

Japanese Office Action in Application No. 2005101141281 with mailing date of Dec. 21, 2007 and English translation thereof.
Corresponding English Language Abstract for CN2924592Y.
Office Action dated Jul. 31, 2008 in corresponding Japanese Application No. 2004-304693 (partial English translation only).

* cited by examiner 12
101
31
41
57
10
33
34
105
115
44
140
56
103
14
16
17
35
141
15
60
102
43
51
13
19

IMAGE-FORMING DEVICE HAVING CARTRIDGE-ACCOMMODATING SECTION

BACKGROUND OF THE INVENTION

1. Field of the Invention

The present invention relates to an image-forming device such as a laser printer, and a photosensitive cartridge, developer cartridge, and process cartridge detachably mounted in the image-forming device.

2. Description of Related Art

In recent years, electrophotographic image-forming devices well known in the art have been equipped with separate cartridges for accommodating the developer and photosensitive member, respectively, so that the cartridges can be replaced individually based on their own life span.

One example of this type of image-forming device disclosed in U.S. Pat. No. 6,330,410 B1 includes a photosensitive cartridge accommodating a photosensitive drum, and a developer cartridge accommodating a developing roller, wherein the photosensitive cartridge and developer cartridge can be mounted in or removed from a main casing of the image-forming device as an integrated unit. In another image-forming device disclosed in U.S. Patent Application Publication No. 2003/0161656 A1, the photosensitive cartridge and developer cartridge can be mounted in or removed from the main casing along independent paths.

However, both of these image-forming devices simply provide additional space in the main casing for the mounting path of the photosensitive cartridge and the mounting path of the developer cartridge. Accordingly, these image-forming devices impose limitations on how compact the device can be made.

SUMMARY OF THE INVENTION

In view of the foregoing, it is an object of the present invention to provide a compact image-forming device having detachably mounted first and second cartridges with a reduced space required for the mounting paths of these cartridges.

It is another object of the present invention to provide a photosensitive cartridge, developer cartridge, and process cartridge capable of being detachably mounted in the image-forming device.

In order to attain the above and other objects, the present invention provides an image-forming device, including: a housing; and a first cartridge and a second cartridge that are detachably mounted in the housing and that have a process member used in an image-forming process. The first cartridge is formed thicker than the second cartridge in a thickness direction orthogonal to a mounting direction of the first and second cartridges. The housing has a cartridge-accommodating section that accommodates the first and second cartridges therein. The cartridge-accommodating section includes first and second accommodating sections that are disposed continuously along the mounting direction of the first and second cartridges and that are partly displaced with respect to each other in the thickness direction. The second accommodating section is disposed upstream of the first accommodating section with respect to the mounting direction of the first and second cartridges and is formed thicker than the first cartridge in the thickness direction and thinner than both the first and second cartridges together when the first and second cartridges are accommodated in the cartridge-accommodating section. The first accommodating section is formed thicker than the first and second cartridges together in the thickness direction when the first and second cartridges are accommodated in the cartridge-accommodating section.

According to another aspect, the present invention provides an image-forming device, including: a housing; and first and second cartridges that are detachably mounted in the housing and that have a process member used in an image-forming process. The housing has a cartridge-accommodating section that accommodates therein the first and second cartridges. The cartridge-accommodating section includes first and second accommodating sections that are disposed continuously along a mounting direction of the first and second cartridges and that are partly displaced with respect to each other in a thickness direction orthogonal to the mounting direction of the first and second cartridges. The first accommodating section is disposed downstream of the second accommodating section with respect to the mounting direction of the first and second cartridges and is formed wider than the second accommodating section in the thickness direction orthogonal to the mounting direction of the first and second cartridges. The first accommodating section has an expanded region, by which the first accommodating section is wider than the second accommodating section. The first cartridge has a protruding part that is disposed in the expanded region when the first cartridge is mounted in the first accommodating section. The cartridge-accommodating section has a shape that restricts movement of the first cartridge in the mounting direction when the protruding part is positioned in the expanded region, but that allows movement of the first cartridge in the mounting direction when the protruding part is moved from the expanded region in the thickness direction by a distance equivalent to the thickness of the second cartridge.

According to another aspect, the present invention provides an image-forming device, including: a housing; and first and second cartridges that are detachably mounted in the housing and that are provided with a process member used in an image-forming process. The housing includes: a first accommodating section; a second accommodating section; and a distended part. The first accommodating section defines a first accommodating region in which the first cartridge is accommodated. The second accommodating section is disposed upstream of the first accommodating section with respect to a mounting direction of mounting the first cartridge. The second accommodating section defines a second accommodating region that allows passage of the first cartridge when the first cartridge is mounted in or removed from the first accommodating section and that accommodates the second cartridge therein. The distended part distends toward the second accommodating region to restrict passage of the first cartridge in the second accommodating section when the second cartridge accompanies the first cartridge and to allow passage of the first cartridge through the second accommodating region of the second accommodating section when the second cartridge fails to accompany the first cartridge.

According to another aspect, the present invention provides a photosensitive cartridge that can be detachably mounted in a cartridge-accommodating section defined in an image-forming device. The photosensitive cartridge includes: a first casing; and a photosensitive member and a charger disposed in the first casing. The first casing integrally includes: a main body that accommodates therein the charger and the photosensitive member; and an extended part disposed upstream of the main body in a mounting direction for mounting the photosensitive cartridge.

According to another aspect, the present invention provides a process cartridge, including: a photosensitive cartridge that can be detachably mounted in a cartridge-accommodating section defined in an image-forming device; and a developer cartridge that can be detachably mounted in the cartridge-accommodating section defined in the image-forming device. The photosensitive cartridge includes: a first casing; and a photosensitive member and a charger disposed in the first casing. The first casing integrally includes: a main body that accommodates therein the charger and the photosensitive member; and an extended part disposed upstream of the main body in a mounting direction for mounting the photosensitive cartridge. The developer cartridge includes: a second casing; and a developing roller disposed in the second casing with its portion exposed therefrom.

According to another aspect, the present invention provides a developer cartridge that can be detachably mounted in a cartridge-accommodating section defined by a wall included in an image-forming device. The developer cartridge includes: a casing; a developing roller; a pressing part; and a sliding part. The developing roller is disposed in the casing with a portion exposed therefrom. The pressing part is disposed on the casing, facing the peripheral surface of the developing roller exposed from the casing along the length of the developing roller, and contacts the peripheral surface of the developing roller with pressure to prevent leakage of developer. The sliding part protrudes further downstream than the pressing part in a mounting direction for mounting the developer cartridge in a cartridge-accommodating section defined by a wall included in an image-forming device. The sliding part protrudes nearer to the wall than the pressing part. The sliding part contacts the wall when mounting the developer cartridge and functions to slide along the wall.

According to another aspect, the present invention provides a process cartridge, including: a developer cartridge that can be detachably mounted in a cartridge-accommodating section defined by a wall included in an image-forming device; and a photosensitive cartridge that can be detachably mounted in the cartridge-accommodating section. The developer cartridge includes: a second casing; a developing roller disposed in the second casing with a portion exposed therefrom; a pressing part disposed on the second casing, facing the peripheral surface of the developing roller exposed from the second casing along the length of the developing roller, and contacting the peripheral surface of the developing roller with pressure to prevent leakage of developer; and a sliding part protruding further downstream than the pressing part in a mounting direction for mounting the developer cartridge in the cartridge-accommodating section, the sliding part protruding nearer to the wall than the pressing part, the sliding part contacting the wall when mounting the developer cartridge and functioning to slide along the wall. The photosensitive cartridge includes a first casing and a photosensitive member and a charger disposed in the first casing.

BRIEF DESCRIPTION OF THE DRAWINGS

The above and other objects, features and advantages of the invention will become more apparent from reading the following description of the preferred embodiment taken in connection with the accompanying drawings in which:

FIGS. 22 and 23 are a series of side views showing the process of engaging a pressing cam with a drum shaft when mounting the drum cartridge in the process accommodating section (the engagement operation being associated with the mounting and removal of the drum cartridge), wherein FIG. 22 shows the pressing cam prior to engagement and FIG. 23 shows the pressing cam after engagement is complete;

FIG. 32(*b*) a side view showing the structure of the cam driving path;

DETAILED DESCRIPTION OF THE PREFERRED EMBODIMENT

Figure 1:
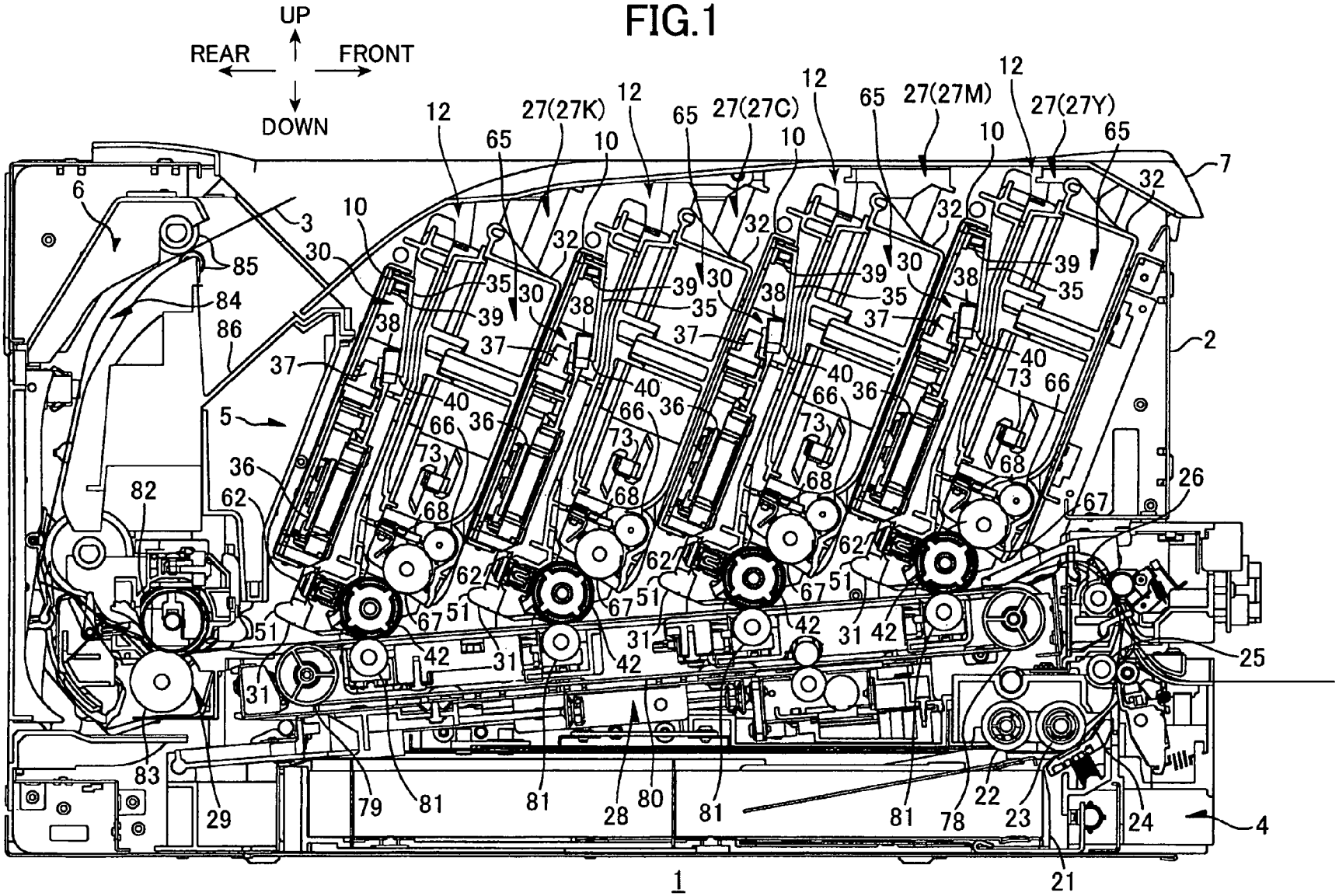
FIG. 1 is a side cross-sectional view showing a color laser printer according to a preferred embodiment of the present invention.

An image-forming device according to a preferred embodiment of the present invention will be described while referring to the accompanying drawings wherein like parts and components are designated by the same reference numerals to avoid duplicating description.

FIG. 1 is a side cross-sectional view showing a color laser printer, serving as a preferred embodiment of the image-forming device according to the present invention.

A color laser printer 1 shown in FIG. 1 is a transverse tandem type color laser printer having a plurality of process sections 27 that are horizontally juxtaposed. The color laser printer 1 includes a main casing 2 and, within the main casing 2, a feeder unit 4 for feeding a paper 3, an image-forming unit 5 for forming images on the paper 3 supplied from the feeder unit 4, and a discharge unit 6 for discharging the paper 3 from the color laser printer 1 after an image has been formed on the paper 3.

The main casing 2 is shaped substantially like an open-topped rectangular box when viewed from the side. A top cover 7 is provided on the top side of the main casing 2. The top cover 7 is rotatably supported by hinges (not shown) disposed on the rear side of the main casing 2 (hereinafter, the left side in FIG. 1 will be referred to as the rear side, while the right side in FIG. 1 will be referred to as the front side) and is capable of opening and closing on the main casing 2.

Figure 14:
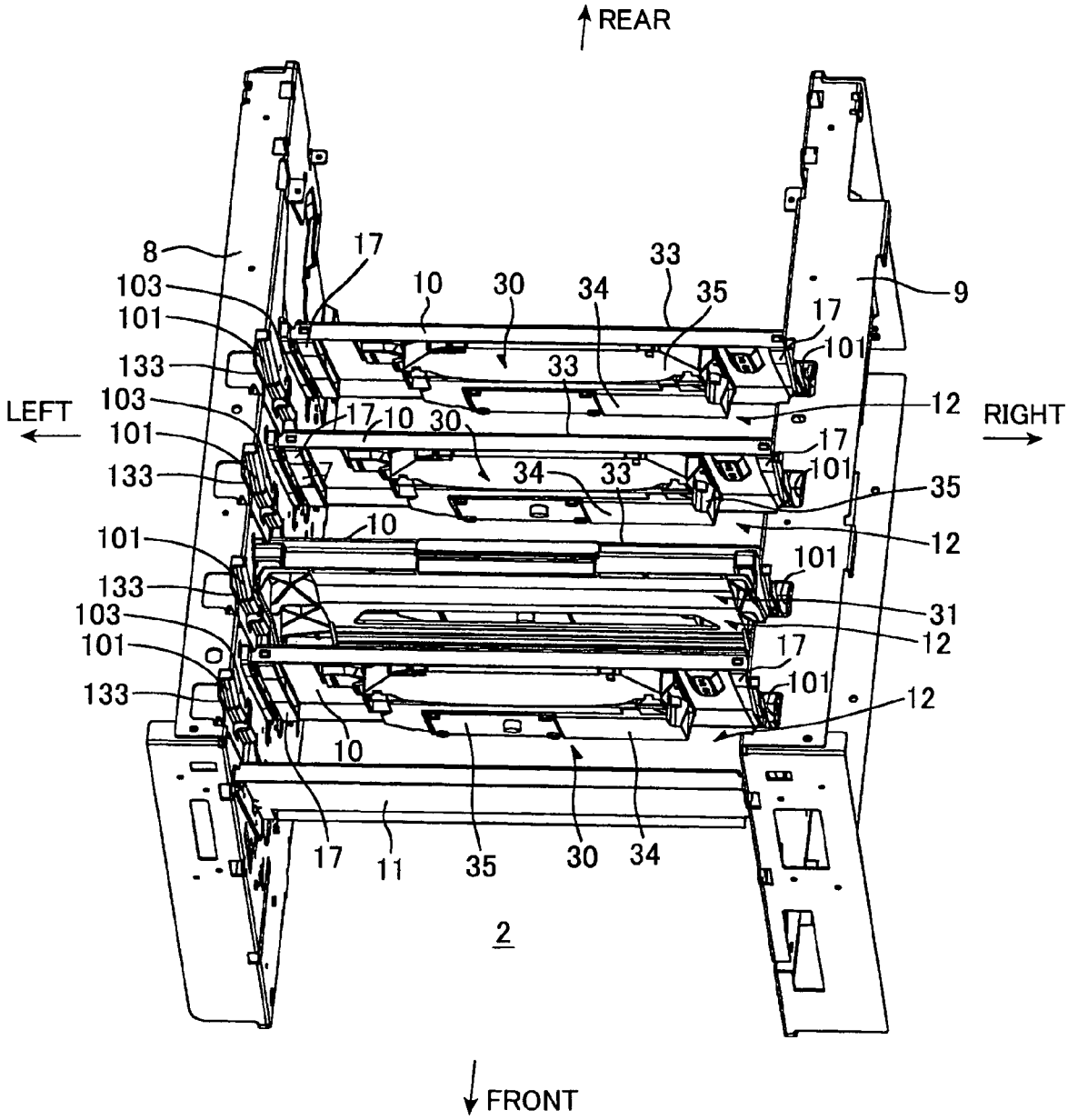
FIG. 14 is a perspective view from above the front side of a main casing in the color laser printer.

As shown in FIG. 14, the main casing 2 includes a left side plate 8 and a right side plate 9 that face each other in a widthwise direction orthogonal to the front-to-rear direction and to the vertical direction and that are separated by a prescribed gap; and four partitioning plates 10 and a front plate 11 that span between the left side plate 8 and right side plate 9. The partitioning plates 10 are disposed in the main casing 2 at prescribed intervals in the front-to-rear direction, and the front plate 11 is disposed further forward of the partitioning plates 10 so as to partition the space between the left side plate 8 and right side plate 9 in the front-to-rear direction into a space for each of the process sections 27 (FIG. 1) described later. Each partition plate 10 has a rear surface 33 on its rear side.

The partitioning plates 10 and the front plate 11 are each slanted with respect to the front-to-rear direction, which is identical to the direction in which the paper 3 is conveyed through the color laser printer 1 while being formed with images, and the vertical direction, with the top end farther forward than the bottom end. As shown in FIG. 1, the partitioning plates 10 and front plates 11 are arranged so that a vertical gap is formed between the top ends of the plates 10, 11 and the top cover 7 and another vertical gap is formed between the bottom ends of the plates 10, 11 and a transfer section 28 described later.

Figure 15:
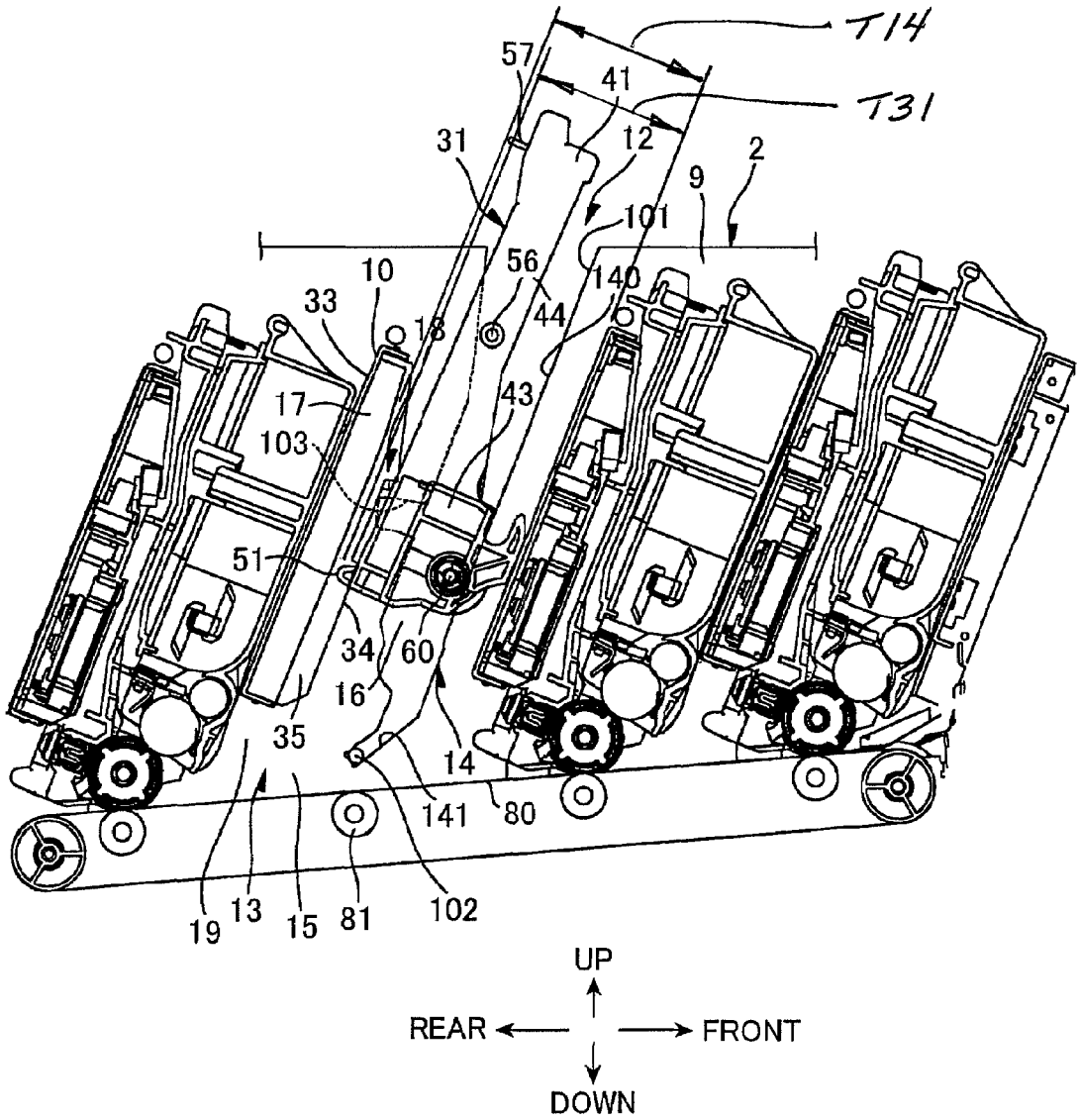
FIG. 15 is a side view showing the mounted state of the drum cartridge in the process-accommodating section (when passing through the developer accommodating section)

Accordingly, as shown in FIG. 14, four process-accommodating sections 12 are partitioned in the main casing 2 by the left side plate 8 and right side plate 9 and the adjacent partitioning plates 10 and front plate 11. Each of the process-accommodating sections 12 is provided for one of the process sections 27 corresponding to each printing color. Each of the process-accommodating sections 12 includes a drum-accommodating section 13 (see FIG. 15) for accommodating a drum cartridge 31 described later, and a developer-accommodating section 14 (see FIG. 15) for accommodating a developer cartridge 32 described later. As shown in FIG. 15, the drum cartridge 31 has a holder unit 43 that is mounted in the drum-accommodating section 13, while the developer cartridge 32 is mounted in the developer-accommodating section 14.

As shown in FIG. 15, the drum-accommodating sections 13 are provided lower than the partitioning plates 10 in spaces partitioned by the left side plate 8 and right side plate 9 in the widthwise direction and by imaginary slanted lines extending from the partitioning plates 10 and the front plate 11 along the same planes thereof in the front-to-rear direction. Each of the spaces partitioned in the drum-accommodating section 13 in this way is a drum-accommodating space 15 for accommodating the holder unit 43 of the drum cartridge 31.

The developer-accommodating section 14 is disposed as a continuation of the drum-accommodating section 13 on the upstream side of the drum-accommodating section 13 with respect to the direction in which the drum cartridge 31 is mounted. In other words, the developer-accommodating section 14 is provided above the drum-accommodating section 13 along the mounting direction for the drum cartridge 31 and the developer cartridge 32. The developer-accommodating sections 14 are partitioned by the partitioning plates 10 and front plate 11 in the front-to-rear direction and by the left side plate 8 and right side plate 9 in the widthwise direction. The internal space of the developer-accommodating sections 14 partitioned in this way (excluding an extended accommodating space 18 described later) forms a developer-accommodating space 16 for accommodating the developer cartridge 32.

As shown in FIGS. 14 and 15, in each of the developer-accommodating sections 14, rail parts 17 are provided on the partitioning plate 10 to extend along both widthwise ends of the partitioning plate 10. The rail parts 17 are formed as thick strips extending in the mounting direction of the drum cartridge 31. When mounting the drum cartridge 31, ridges 51 of the drum cartridges 31 (to be described later) slide against the rail parts 17, respectively.

As shown in FIG. 1, the feeder unit 4 includes a paper supply tray 21 that is detachably mounted in a lower section of the main casing 2 and can be inserted into or removed from the main casing 2 through the front side in a horizontal direction; a pickup roller 22 and a feeding roller 23 disposed above the front side of the paper supply tray 21; a feeding side U-shaped path 24 disposed in front of and above the feeding roller 23; a conveying roller 25 and a registration roller 26 disposed along the feeding side U-shaped path 24.

The paper 3 is stacked inside the paper supply tray 21. The pickup roller 22 picks up the topmost sheet of the paper 3 and conveys the sheet forward. Subsequently, the feeding roller 23 feeds the sheet along the feeding side U-shaped path 24.

The feeding side U-shaped path 24 is shaped substantially like the letter U and serves as a conveying path for the paper 3. The upstream end of the feeding side U-shaped path 24 is a lower part positioned adjacent to the feeding roller 23 for feeding the paper 3 forward, while the downstream end is an upper part positioned adjacent to a conveying belt 80 described later for conveying the paper 3 rearward.

After the feeding roller 23 feeds the sheet of paper 3 forward along the upstream end of the feeding side U-shaped path 24, the conveying roller 25 continues to convey the paper 3 along the feeding side U-shaped path 24 as the conveying direction of the paper 3 is reversed. The registration roller 26 first registers the sheet of paper 3 and subsequently conveys the sheet rearward.

The image-forming unit 5 includes the process sections 27, the transfer section 28, and a fixing section 29. The process sections 27 are provided one for each color of toner. Specifically, the color laser printer 1 of the preferred embodiment has four process sections 27, including a yellow process section 27Y, a magenta process section 27M, a cyan process section 27C, and a black process section 27K. The process sections 27 are disposed one in each of the process-accommodating sections 12, aligned one after another horizontally and separated by a prescribed gap in the front-to-rear direction.

Each of the process sections 27 includes a scanning unit 30, the drum cartridge 31, and the developer cartridge 32 that is detachably mounted on the drum cartridge 31. A process cartridge is configured of the drum cartridge 31, and the developer cartridge 32 mounted on the drum cartridge 31.

The scanning unit 30 includes a scanner casing 35 and, within the scanner casing 35, a laser light-emitting unit (not shown), a polygon mirror 36, two lenses 37 and 38, and a reflecting mirror 39.

As shown in FIG. 14, the scanner casing 35 is disposed in the widthwise center of each partitioning plate 10 so that the rail parts 17 of each partitioning plate 10 are positioned one on either widthwise end of the scanner casing 35. Further, a rear wall of the scanner casing 35 contacts a front surface of the partitioning plates 10, while a front wall 34 of the scanner casing 35 protrudes forward away from the partitioning plates 10. By disposing the scanner casing 35 so as to protrude forward from the partitioning plates 10 in this way, the scanning unit 30, drum cartridge 31, and developer cartridge 32 can be arranged in close proximity with each other, thereby making it possible to achieve a more compact device.

Since the scanner casing 35 protrudes forward from the partitioning plates 10, the drum cartridge 31 is restricted from passing through the developer-accommodating section 14 when the developer cartridge 32 is mounted on the drum cartridge 31. However, the drum cartridge 31 can pass through the developer-accommodating space 16 when the developer cartridge 32 is separated from the drum cartridge 31.

As shown in FIG. 15, due to the scanner casing 35, the developer-accommodating section 14 is formed narrower than the drum-accommodating section 13 in the direction orthogonal to the widthwise direction and the mounting direction of the drum cartridge 31 and developer cartridge 32 (hereinafter, referred to as the "thickness direction" of the drum cartridge 31 and developer cartridge 32).

More specifically, the developer-accommodating section 14 is formed wider in the thickness direction than the thickness of the holder unit 43 of the drum cartridge 31, and narrower than the thickness of the drum cartridge 31 and developer cartridge 32 when mounted on each other.

Further, the drum-accommodating section 13 has an expanded space 19 on the downstream side of the scanner casing 35 with respect to the mounting direction of the drum cartridge 31 by which the drum-accommodating section 13 is wider than the developer-accommodating section 14. Hence, the drum-accommodating section 13 is formed wider in the thickness direction than the thickness of the drum cartridge 31 and developer cartridge 32 mounted together and accommodated in the process-accommodating section 12.

As will be described later, when the holder unit 43 of the drum cartridge 31 is disposed in the expanded space 19, that is, when the drum cartridge 31 is accommodated in the drum-accommodating space 15 of the drum-accommodating section 13, and when the developer cartridge 32 is accommodated in the developer-accommodating space 16 of the developer-accommodating section 14, the drum cartridge 31 is restricted from moving in a direction for removing the drum cartridge 31 because the holder unit 43 contacts the scanner casing 35. After the developer cartridge 32 is removed from the developer-accommodating section 14, the drum cartridge 31 can be removed by first shifting the drum cartridge 31 in a direction away from the scanner casing 35 (forward) so that the drum cartridge 31 can pass from the drum-accommodating section 13 through the developer-accommodating section 14.

As shown in FIG. 15, the extended accommodating space 18 is formed in the developer-accommodating section 14 between an upper end and both widthwise ends of the scanner casing 35 and near the front wall 34 of the scanner casing 35 (a space between the front wall 34 of the scanner casing 35 and the developer-accommodating space 16 in which a middle plate 54 described later is provided). The extended accommodating space 18 accommodates an extended part 44 of the drum cartridge 31 described later.

As shown in FIG. 1, a window 40 is formed in the front wall 34 of the scanner casing 35 for allowing the passage of a laser beam. The laser light-emitting unit of the scanning unit 30 emits a laser beam based on prescribed image data. This laser beam is deflected by the polygon mirror 36, passes through or is reflected by the lens 37, reflecting mirror 39, and lens 38, and is irradiated through the window 40.

Figure 2:
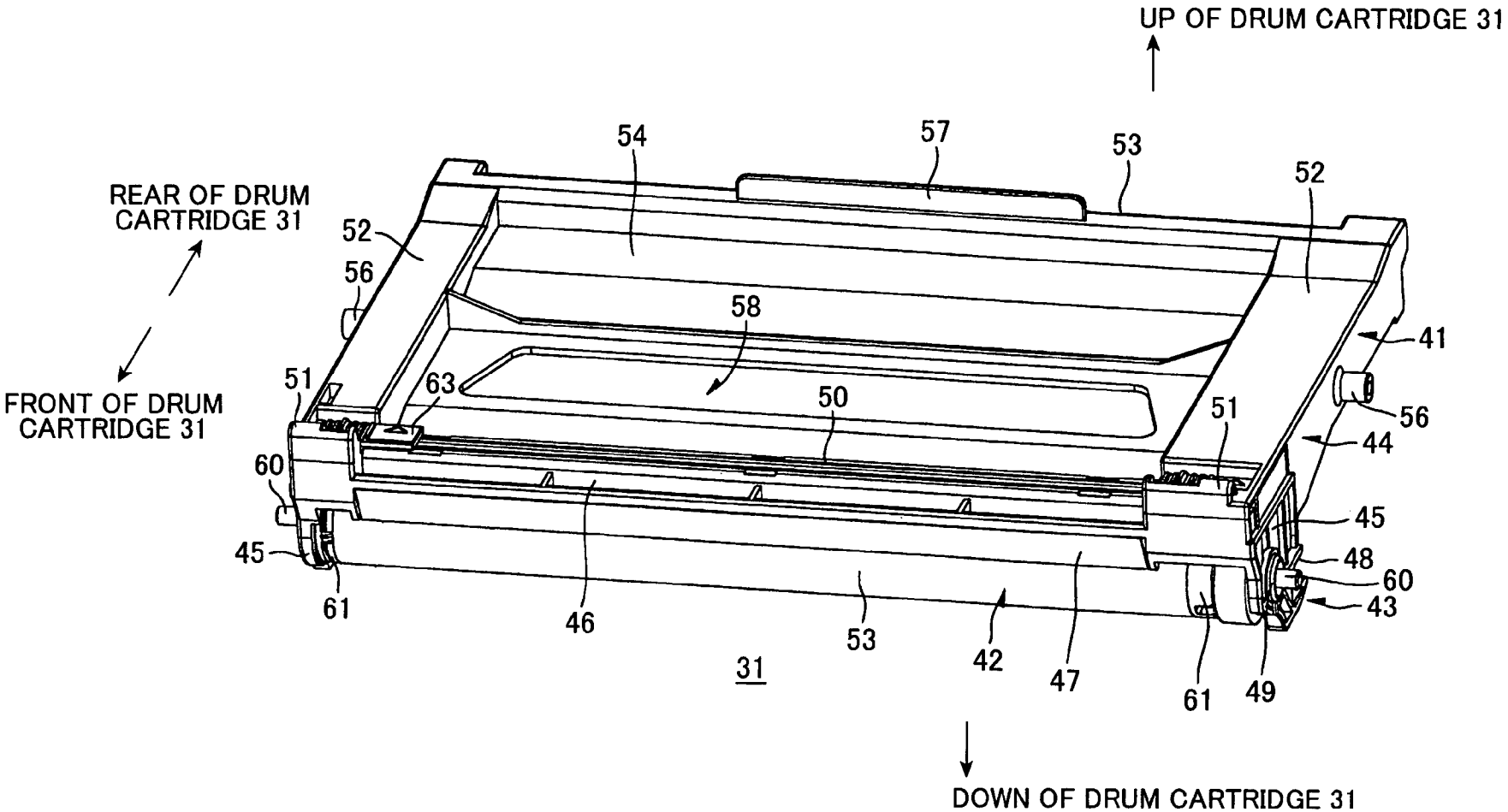
FIG. 2 is a perspective view from above the front side of a drum cartridge in the color laser printer of FIG. 1.
Figure 3:
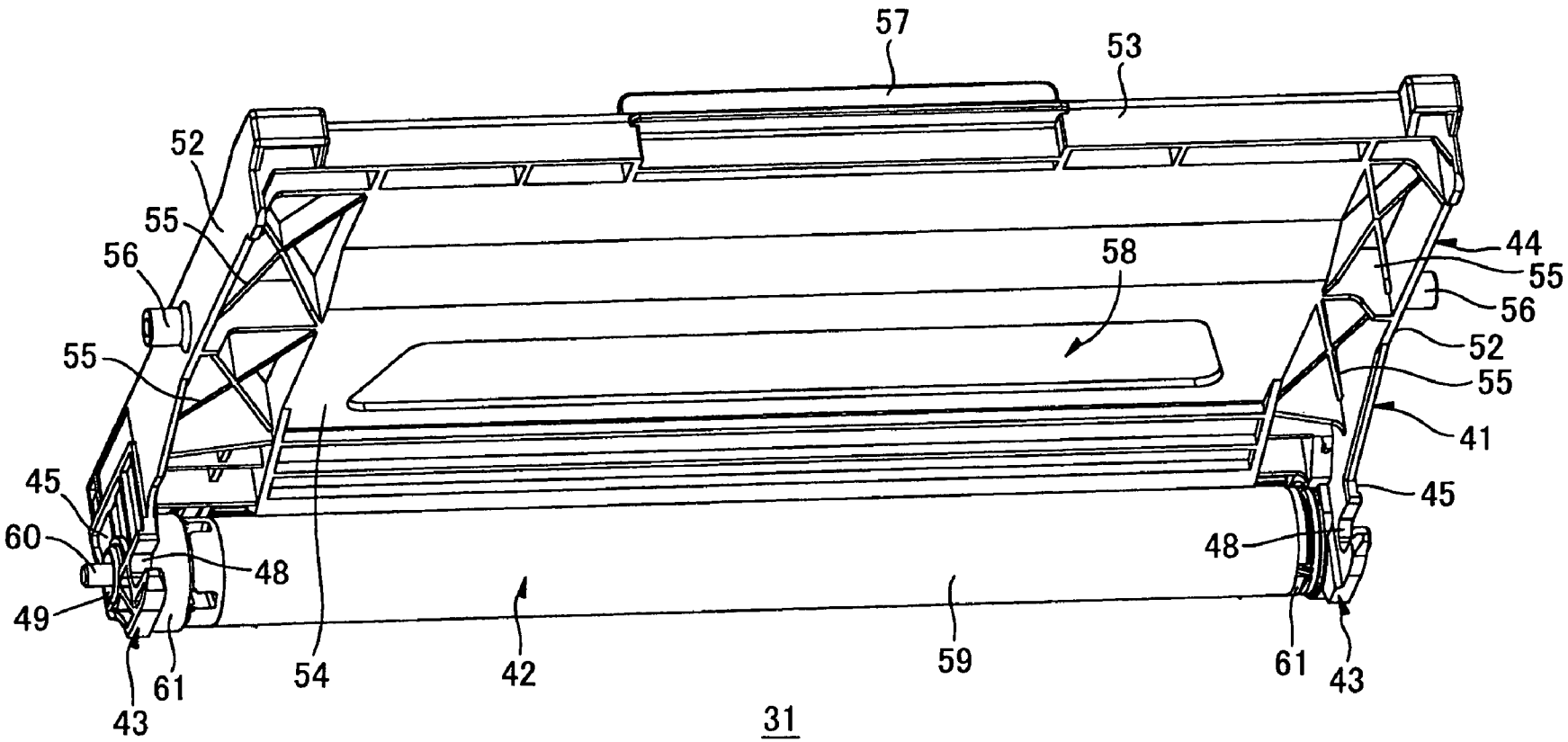
FIG. 3 is a perspective view from below the rear side of the drum cartridge.

As shown in FIGS. 2 and 3, the drum cartridge 31 includes a drum casing 41; and a photosensitive drum 42 and a Scorotron charger 62 (see FIG. 1) disposed in the drum casing 41.

The drum casing 41 includes the holder unit 43, and the extended part 44 extending from the holder unit 43. The holder unit 43 and extended part 44 are integrally formed of a synthetic resin.

Below, the drum cartridge 31 will be described with reference to FIGS. 2 through 7. In the following description, the area of the drum cartridge 31 in the top of FIG. 2 will be referred to as the "upper side" (the rear side when the drum cartridge 31 is mounted) of the drum cartridge 31, and the portion of the drum cartridge 31 in the bottom of FIG. 2 the "lower side" (front side when the drum cartridge 31 is mounted) of the drum cartridge 31. Further, the side of the drum cartridge 31 on which the holder unit 43 is provided will be referred to as the "front side" (lower side when the drum cartridge 31 is mounted) of the drum cartridge 31, while the side on which the extended part 44 is provided will be referred to as the "rear side" (upper side when the drum cartridge 31 is mounted) of the drum cartridge 31.

The holder unit 43 includes two side walls 45 opposing each other across a prescribed gap in the widthwise direction, a top wall 46 that spans between the upper edges of the side walls 45, and a front wall 47 that extends from the front edge of the top wall 46 vertically along part of the front edges of the side walls 45. The holder unit 43 is thicker (longer vertically) than a developer casing 64 (see FIG. 8) of the developer cartridge 32.

The holder unit 43 is formed thicker (longer vertically) than the extended part 44. This construction can reliably accommodate the photosensitive drum 42 and the charger 62.

Figure 6:
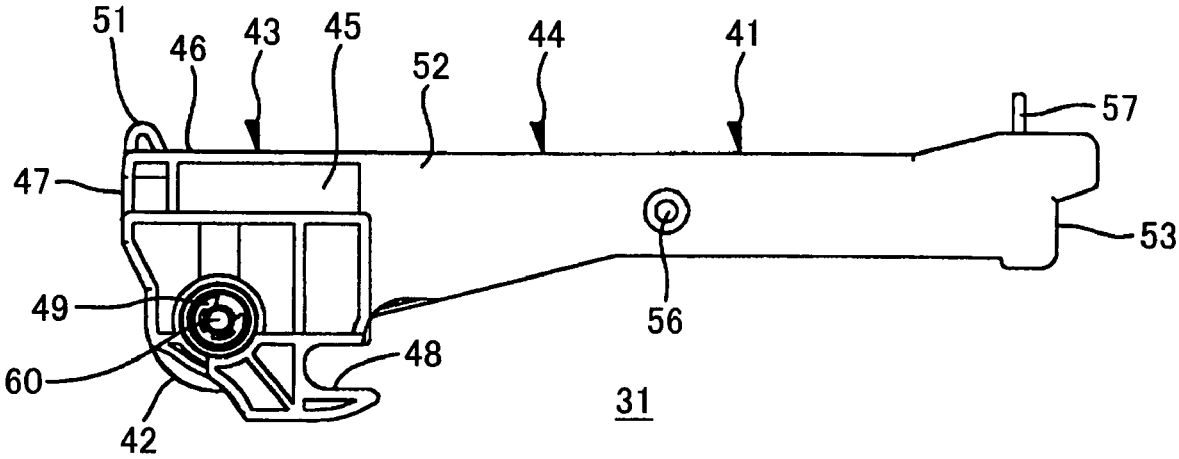
FIG. 6 is a right side view of the drum cartridge.
Figure 7:
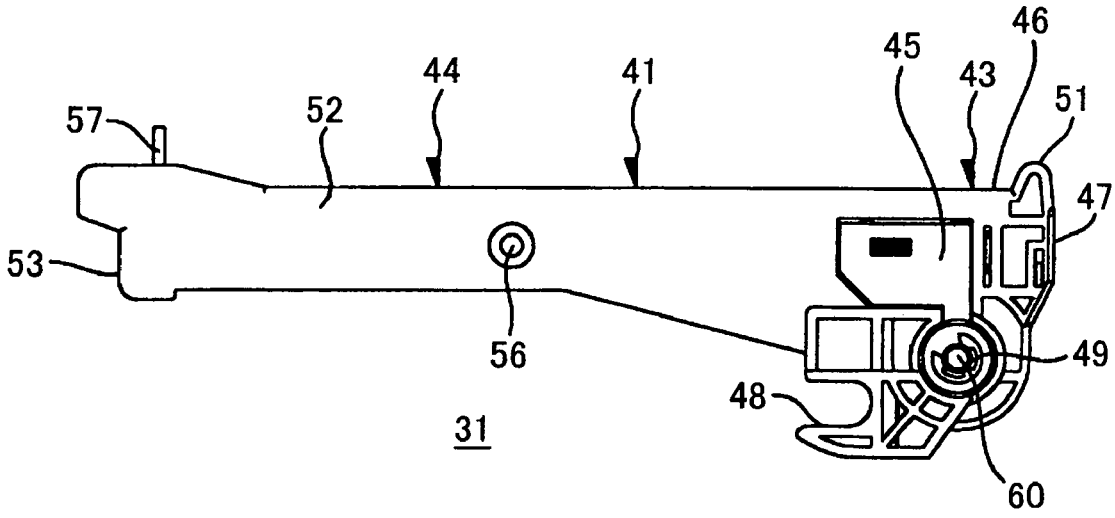
FIG. 7 is a left side view of the drum cartridge.

As shown in FIGS. 6 and 7, a developer positioning groove 48 formed substantially in the shape of a U that opens rearward is formed on the lower part of each side wall 45. An insertion part 49 is formed on the front side of the developer positioning groove 48 for inserting a drum shaft 60 of the photosensitive drum 42.

As shown in FIG. 2, a cleaner fitting part 50 is formed in the top wall 46 along the width of the same. A cleaner 63 described later is slidably fitted into the cleaner fitting part 50. As shown in FIGS. 6 and 7, the ridges 51 formed on both widthwise ends of the top wall 46 are substantially triangular shaped protrusions when viewed from the side that protrude upward on the front end of the top wall 46.

As shown in FIGS. 2 and 3, the extended part 44 extends rearward from the holder unit 43 so as to extend above the upper end of the scanner casing 35 in the developer-accommodating section 14 when the holder unit 43 is mounted in the drum-accommodating section 13.

The extended part 44 includes two extended side parts 52 that face each other across a gap in the widthwise direction, an extended rear wall 53 that spans between the rear edges of the extended side parts 52, and the middle plate 54 disposed in an area surrounded by the holder unit 43, the extended side parts 52, and the extended rear wall 53.

As shown in FIGS. 2 and 3, each of the extended side parts 52 has a substantially box-shaped cross section that is open on the bottom. As shown in FIG. 2, the outside surfaces of the extended side parts 52 extend rearward from both widthwise ends of the holder unit 43 so as to extend continuously rearward from the top of the developer positioning grooves 48.

As shown in FIG. 3, two reinforcing ribs 55 substantially X-shaped from a bottom view are disposed in the box-shaped interior of the extended side parts 52 along the front-to-rear direction. A drum boss 56 protruding outward in the widthwise direction is provided on the outer side surface of each extended side part 52 midway along the longitudinal direction thereof.

As described above, the extended rear wall 53 extends in the widthwise direction, connecting the rear edges of the extended side parts 52. A drum grip 57 is provided in the widthwise center of the extended rear wall 53 to facilitate gripping the drum cartridge 31 and mounting and removing the drum cartridge 31 with respect to the drum-accommodating section 13.

Figure 4:
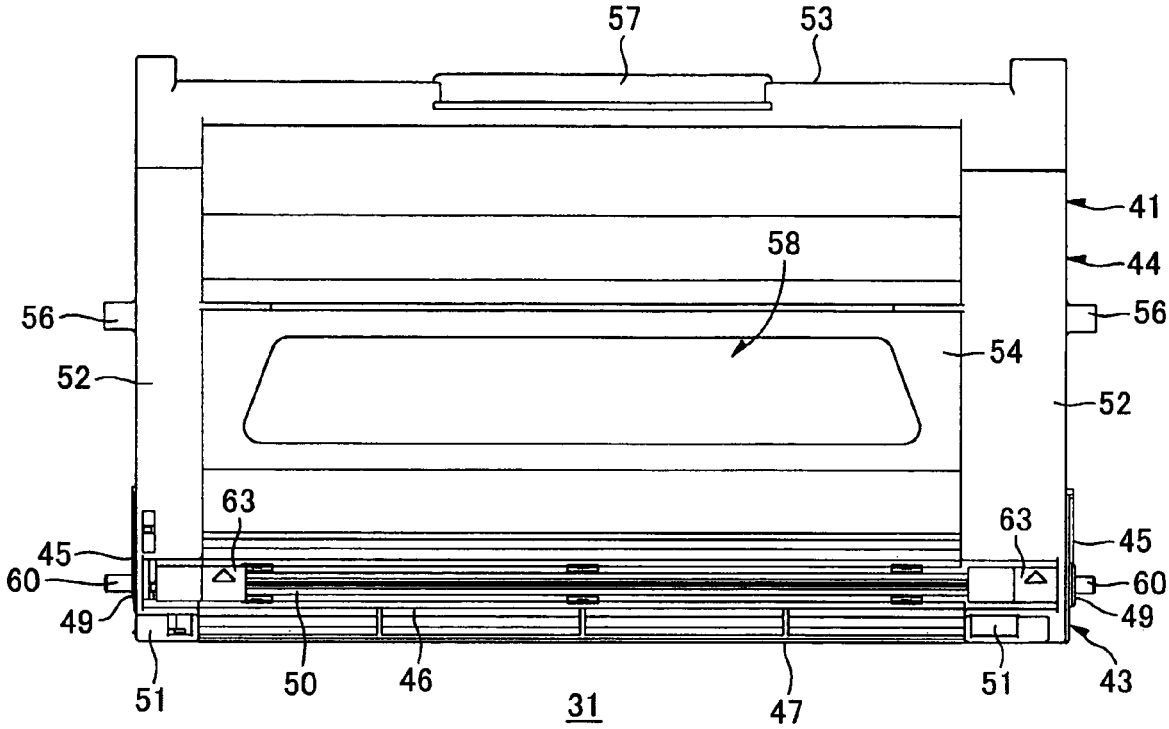
FIG. 4 is a plan view of the drum cartridge.

The middle plate 54 is formed in a substantially rectangular planar shape as shown in FIG. 2. The middle plate 54 is disposed in a portion surrounded by the holder unit 43, extended side parts 52, and extended rear wall 53 and is connected to the holder unit 43, extended side parts 52, and extended rear wall 53 at a position sunken below the upper surface of the extended side parts 52 and extended rear wall 53. An opening 58 is formed in the middle plate 54 to allow passage of a laser beam emitted through the window 40 of the scanner casing 35. As shown in FIG. 4, the opening 58 is shaped like a trapezoid in a plan view with the front side wider than the rear side. By forming the opening 58 to be trapezoidal in a plan view, it is possible to cut out only the portion of the middle plate 54 through which the laser beam passes, resulting in a stronger extended part 44 than when the middle plate 54 is formed to be rectangular in a plan view.

As shown in FIG. 2, the photosensitive drum 42 is accommodated within the holder unit 43 along the widthwise direction. The photosensitive drum 42 includes a main drum body 59 that is cylindrical in shape and has a positive charging photosensitive layer formed of a polycarbonate or the like on its outer surface, and the drum shaft 60 extending along the axial center of the main drum body 59. The drum shaft 60 is supported by both axial ends in the side walls 45 such that each axial end is inserted into the insertion part 49 of the respective side wall 45 and protrudes axially outward from each side wall 45. The drum shaft 60 is incapable of rotating relative to the side walls 45.

Figure 5:
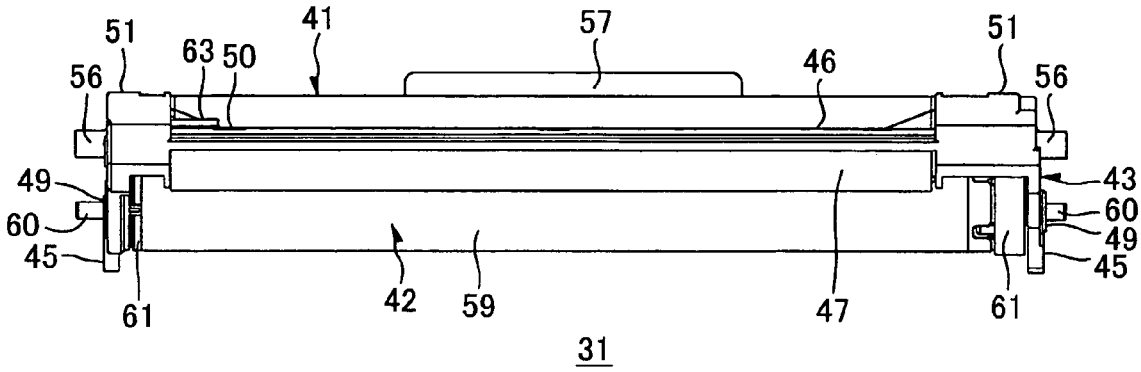
FIG. 5 is a front view of the drum cartridge.

A rotational support member 61 is fitted onto each axial end of the main drum body 59 so as to be incapable of rotating relative to the main drum body 59. The rotational support members 61 are supported on and capable of rotating relative to the drum shaft 60. Hence, the main drum body 59 is supported so as to be capable of rotating relative to the drum shaft 60. With this construction, as shown in FIG. 5, the photosensitive drum 42 is disposed in the holder unit 43 so that a front surface is exposed below the front wall 47.

As shown in FIG. 1, the charger 62 is accommodated in the holder unit 43 above the ridges 51 (rearward in FIG. 2) and extends in the widthwise direction. The charger 62 is a positive-charging Scorotron charger that includes a wire and a grid for generating a corona discharge. The charger 62 is supported on the top wall 46 rearward of the photosensitive drum 42 (above in FIG. 2) and faces the photosensitive drum 42 at a prescribed distance so as not to contact the same. As shown in FIG. 2, the charger 62 is provided with the cleaner 63 for cleaning the wire. The cleaner 63 is slidably fitted into the cleaner fitting part 50 of the top wall 46.

The developer cartridge 32 shown in FIGS. 8-13 includes the developer casing 64, and, provided in the developer casing 64, a toner-accommodating chamber 65, a supply roller 66, a developing roller 67, and a thickness-regulating blade 68, as shown in FIG. 1.

Next, the developer cartridge 32 will be described in detail with reference to FIGS. 8 through 13. In the following description, the portion of the developer cartridge 32 in the upper side of FIG. 8 will be referred to as the "upper side" (the rear side when the developer cartridge 32 is mounted) of the developer cartridge 32, while the portion of the developer cartridge 32 in the lower side of FIG. 8 will be referred to as the "lower side" (front side when the developer cartridge 32 is mounted) of the developer cartridge 32. Further, the side of the developer cartridge 32 on which the developing roller 67 is provided will be referred to as the "front side" (lower side when the developer cartridge 32 is mounted) of the developer cartridge 32, while the side of the developer cartridge 32 on which the toner-accommodating chamber 65 is provided will be referred to as the "rear side" (upper side when the developer cartridge 32 is mounted) of the developer cartridge 32.

Figure 8:
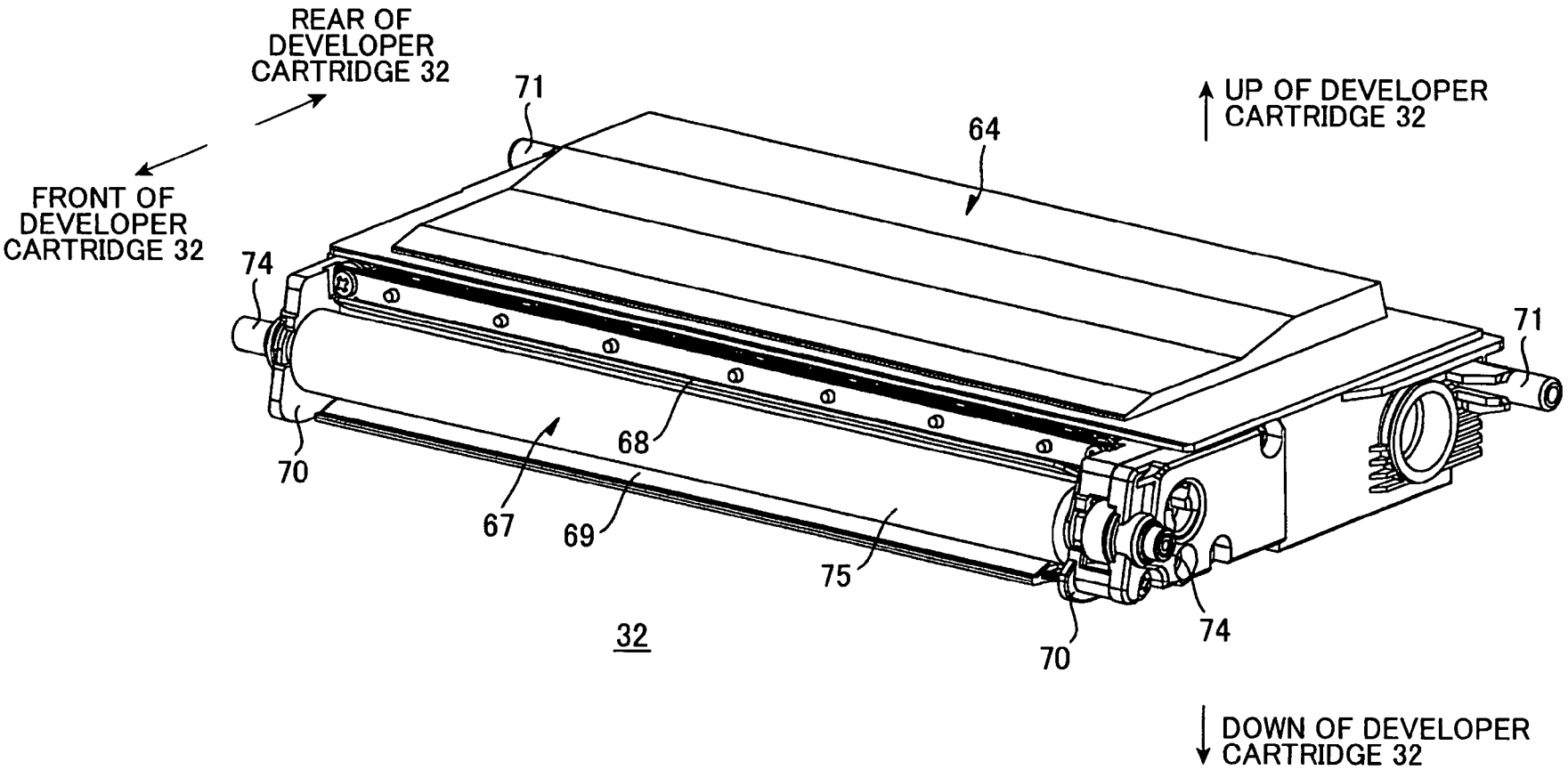
FIG. 8 is a perspective view from above the front side of a developer cartridge in the color laser printer of FIG. 1.
Figure 11:
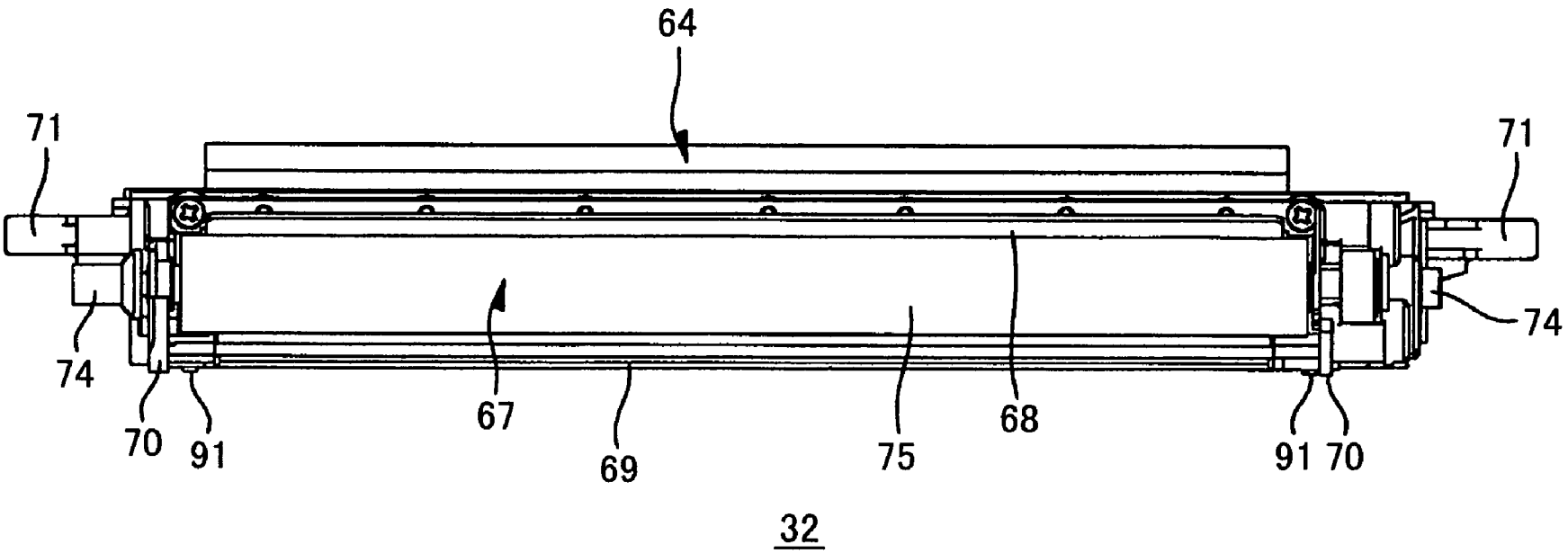
FIG. 11 is a front view of the developer cartridge.

As shown in FIG. 8, the developer casing 64 is formed in a box shape with an open front side. A jaw part 69 and runners 70 are provided on the lower front edge of the developer casing 64. The jaw part 69 is disposed across the entire width of the developer casing 64 and protrudes slightly forward from the lower front edge thereof. As shown in FIG. 11, the jaw part 69 is disposed in a confronting relationship with the developing roller 67 so as to press against the peripheral surface of the developing roller 67 from below in order to prevent the leakage of toner from the developing roller 67.

Figure 12:
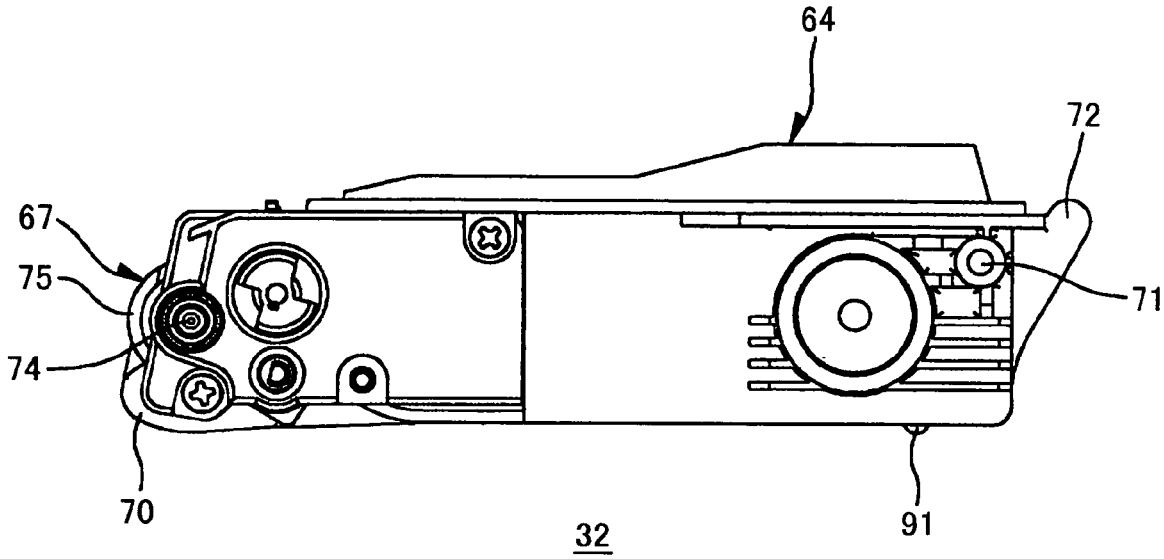
FIG. 12 is a right side view of the developer cartridge.
Figure 13:
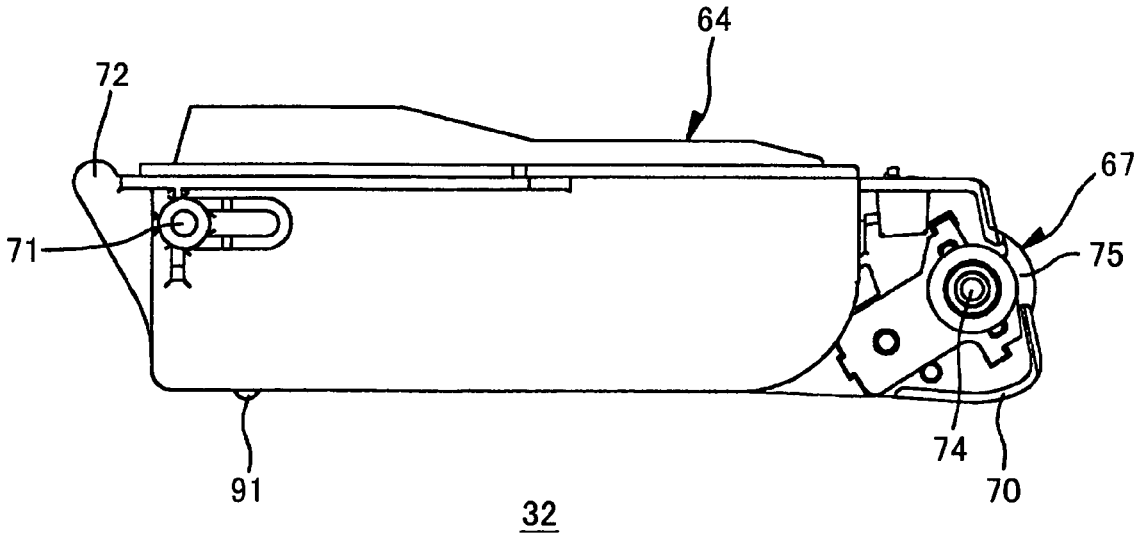
FIG. 13 is a left side view of the developer cartridge.

The runners 70 are disposed on the lower front edge of the developer casing 64, one on either widthwise end of the jaw part 69. As shown in FIGS. 12 and 13, the runners 70 are formed in a curved L-shape in a side view and protrude further forward and downward than the jaw part 69.

Figure 9:
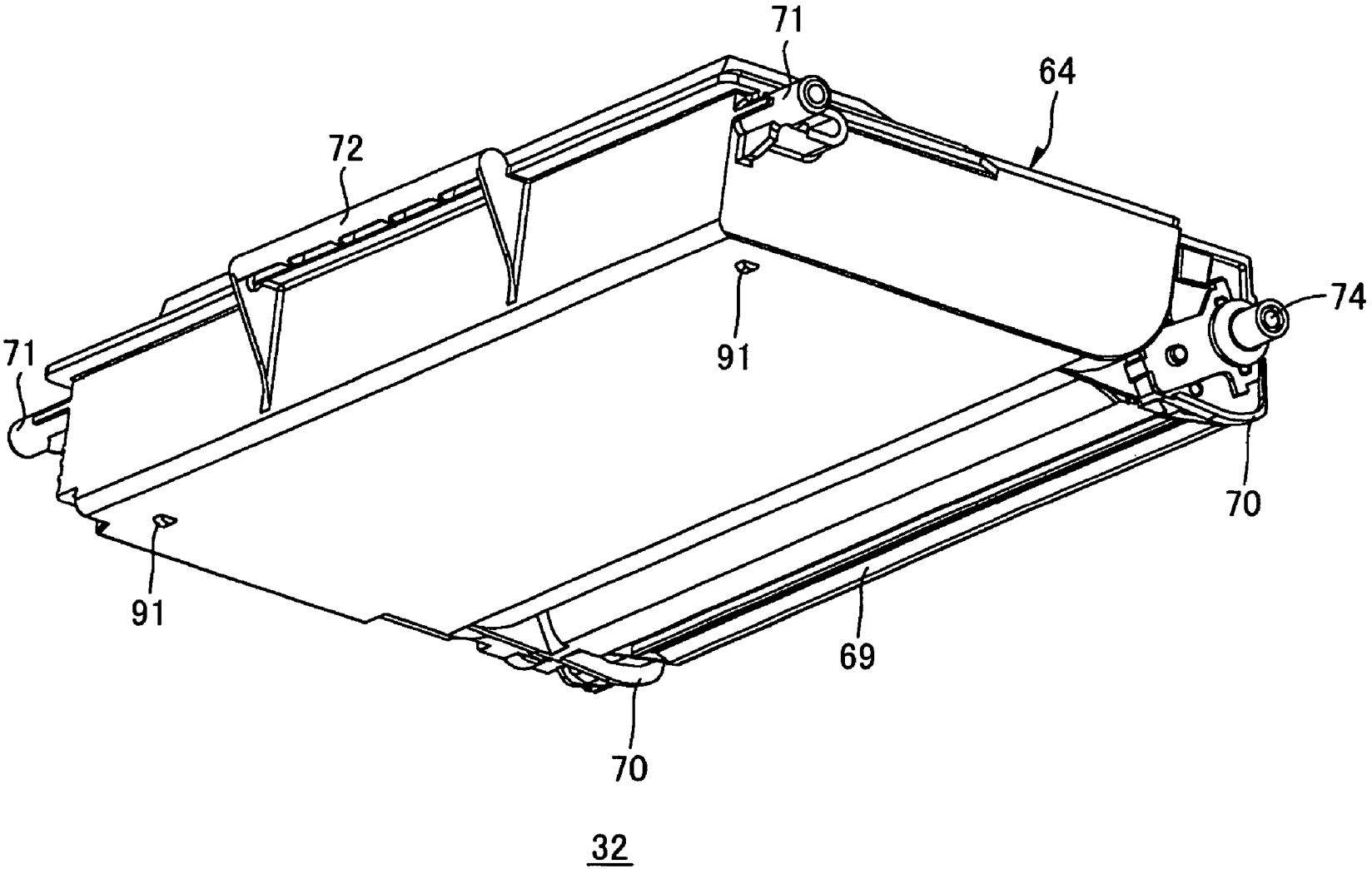
FIG. 9 is a perspective view from below the rear side of the developer cartridge.
Figure 10:
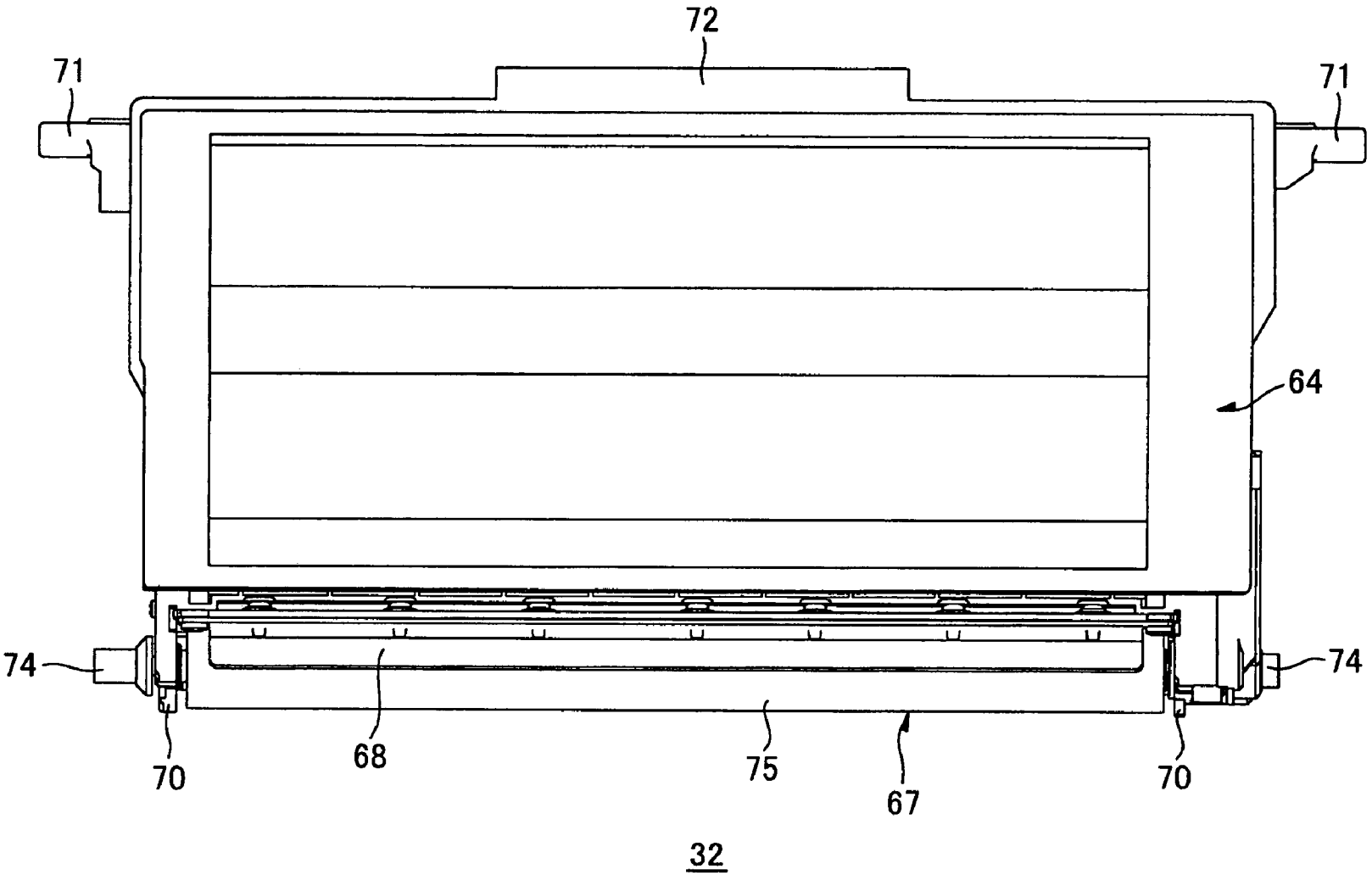
FIG. 10 is a plan view of the developer cartridge.

As shown in FIG. 9, developer boss parts 71 are disposed on the upper rear end of the developer casing 64 and protrude outward in the widthwise direction from both side walls of the developer casing 64. As shown in FIGS. 9 and 10, a developer grip 72 is provided on the rear wall of the developer casing 64 substantially in the widthwise center thereof, enabling a user to grip the developer cartridge 32 when mounting the developer cartridge 32 into or removing the developer cartridge 32 from the developer-accommodating section 14. Further, small contact protrusions 91 are formed on the bottom surface of the developer casing 64 near the rear side, with one on each widthwise end.

As shown in FIG. 1, the toner-accommodating chambers 65 are formed in the upper portion of the developer casings 64 (the rear portion in FIG. 8) for accommodating toner of each color used by the color laser printer 1. In the preferred embodiment, the toner-accommodating chambers 65 of each process section 27 accommodate a nonmagnetic, single-component polymerized toner having a positive charging nature. The toner-accommodating chamber 65 of the yellow process section 27Y accommodates a yellow toner, the toner-accommodating chamber 65 of the magenta process section 27M a magenta toner, the toner-accommodating chamber 65 of the cyan process section 27C a cyan toner, and the toner-accommodating chamber 65 of the black process section 27K a black toner.

More specifically, the toner for each color used in the preferred embodiment is a substantially spherical polymerized toner obtained by a polymerization method. The primary component of the polymerized toner is a binding resin obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The base particles are formed by compounding this binding resin with a coloring agent, a charge-controlling agent, wax, and the like. An additive to improve fluidity is also mixed with the base toner particles.

The coloring agent compounded with the binding resin provides one of the colors yellow, magenta, cyan, and black. The charge-controlling agent is a charge-controlling resin obtained by copolymerizing an ionic monomer having an ionic functional group, such as ammonium salt with a monomer that can be copolymerized with an ionic monomer, such as a styrene monomer or an acrylic monomer. The additive may be powder of a metal oxide, such as silica, aluminum oxide, titanium oxide, strontium titanate, cerium oxide, or magnesium oxide, or an inorganic powder, such as a carbide powder or metal salt powder.

An agitator 73 shown in FIG. 1 is rotatably supported in the lower section of the toner-accommodating chamber 65 (front side in FIG. 8) on both side walls of the developer casing 64 for stirring the toner. The supply roller 66 is also rotatably supported in the lower front side of the toner-accommodating chamber 65 (front lower side in FIG. 8) on both side walls of the developer casing 64. The supply roller 66 is configured of a metal roller shaft that is covered by a roller portion formed of a conductive sponge material.

The developing roller 67 is disposed below the supply roller 66 (in front of the supply roller 66 in FIG. 8) and in confrontation with the supply roller 66 in a compressed relationship. As shown in FIG. 8, the developing roller 67 is disposed in the front end of the developer casing 64 along the width thereof, with a front surface exposed from the developer casing 64. As described above, the lower portion of the exposed part is contacted by the jaw part 69 with pressure.

The developing roller 67 is configured of a metal roller shaft 74 covered by a roller portion 75 that is formed of a resilient material such as a conductive rubber material. More specifically, the roller portion 75 has a two-layered structure including an elastic roller part formed of an electrically-conductive urethane rubber, silicone rubber, or EPDM rubber including fine carbon particles or the like, and a coating covering the surface of the roller part and having as the primary component urethane rubber, urethane resin, polyimide resin, or the like. Both widthwise ends of the roller shaft 74 are rotatably supported in both side walls of the developer casing 64 and protrude outward in a widthwise direction from both side walls.

The thickness-regulating blade 68 is provided on the upper front end of the developer casing 64 across the entire width thereof. As shown in FIG. 1, the thickness-regulating blade 68 is configured of a blade formed of a metal leaf spring member, and a pressing part provided on the free end of the blade. The pressing part has a semicircular cross section and is formed of an insulating silicon rubber. A base part of the blade is supported on the front edge of an upper wall constituting the developer casing 64 so that the pressing part provided on the free end of the blade contacts the rear surface (upper surface in FIG. 1) of the developing roller 67 with pressure.

As shown in FIG. 14, guiding grooves 101 are formed in each of the process-accommodating sections 12. By inserting both ends of the drum shaft 60 in the drum cartridge 31 into the corresponding guiding grooves 101, the guiding grooves 101 guide the drum cartridge 31 as the drum cartridge 31 is mounted into or removed from the main casing 2. The guiding grooves 101 are formed as depressions in the inside surfaces of the left side plate 8 and right side plate 9 at corresponding positions in the widthwise direction, slanting rearward from top to bottom along the mounting direction of the drum cartridges 31 as shown in FIG. 15.

Figures 19A, 19B, 19C:
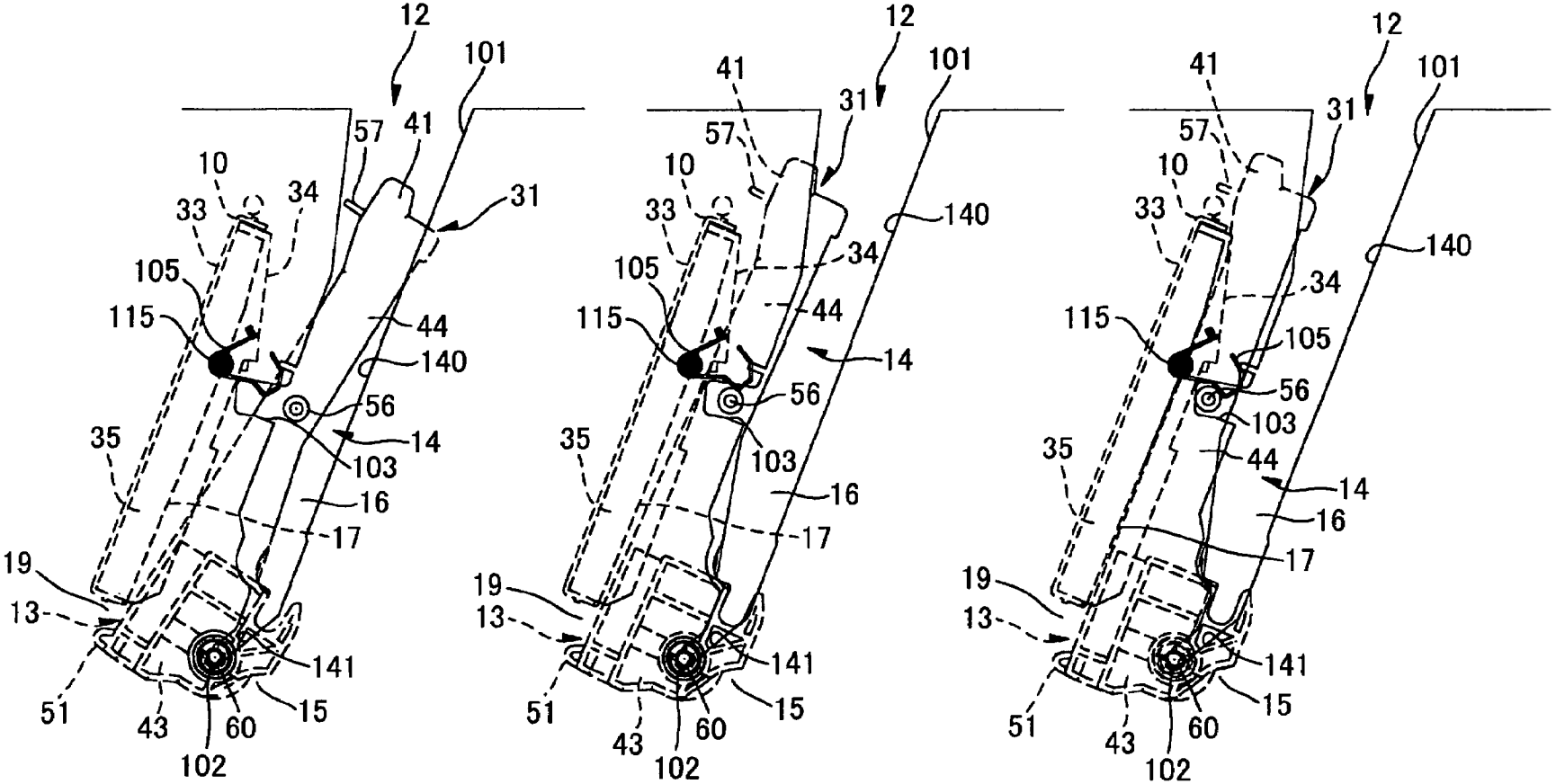
FIGS. 19(*a*)-19(*c*) are a series of side views showing the operation of engaging a restricting spring to a drum boss part when the drum cartridge is mounted in the process accommodating section, wherein FIG. 19(*a*) shows the restricting spring prior to engagement, FIG. 19(*b*) shows the restricting spring becoming engaged, and FIG. 19(*c*) shows the restricting spring completely engaged.

As shown in FIG. 19, the guiding grooves 101 include upstream guide parts 140 in the upper end that are wide in the front-to-rear direction, the upstream guide parts 140 functioning to guide the drum cartridge 31 as the drum cartridge 31 passes through the developer-accommodating section 14; and downstream guide parts 141 formed continuously with the upstream guide parts 140 in the lower section that grow gradually narrower toward the bottom ends thereof. The downstream guide parts 141 slant rearward relative to the upstream guide parts 140 so that the holder unit 43 is guided toward the expanded space 19 after the drum cartridge 31 has passed through the developer-accommodating section 14. Hence, the downstream guide parts 141 function to guide the drum cartridge 31 as the drum cartridge 31 is mounted into or removed from the drum-accommodating section 13.

The lower end (deepest end) of each downstream guide part 141 is a receiving part 102 for receiving the drum shaft 60. The receiving part 102 is formed as a depression in which the drum shaft 60 perfectly fits in the front-to-rear direction and is positioned so that, when the drum shaft 60 is received in the receiving parts 102, the photosensitive drum 42 is positioned in contact with a conveying belt 80 described later.

Drum positioning grooves 103 are formed in the left side plate 8 and right side plate 9 at corresponding widthwise positions for receiving the drum bosses 56. The drum positioning grooves 103 are depressions that are rectangular-shaped in a side view and open on the front side and are positioned midway along the length of the upstream guide part 140.

Figure 24:
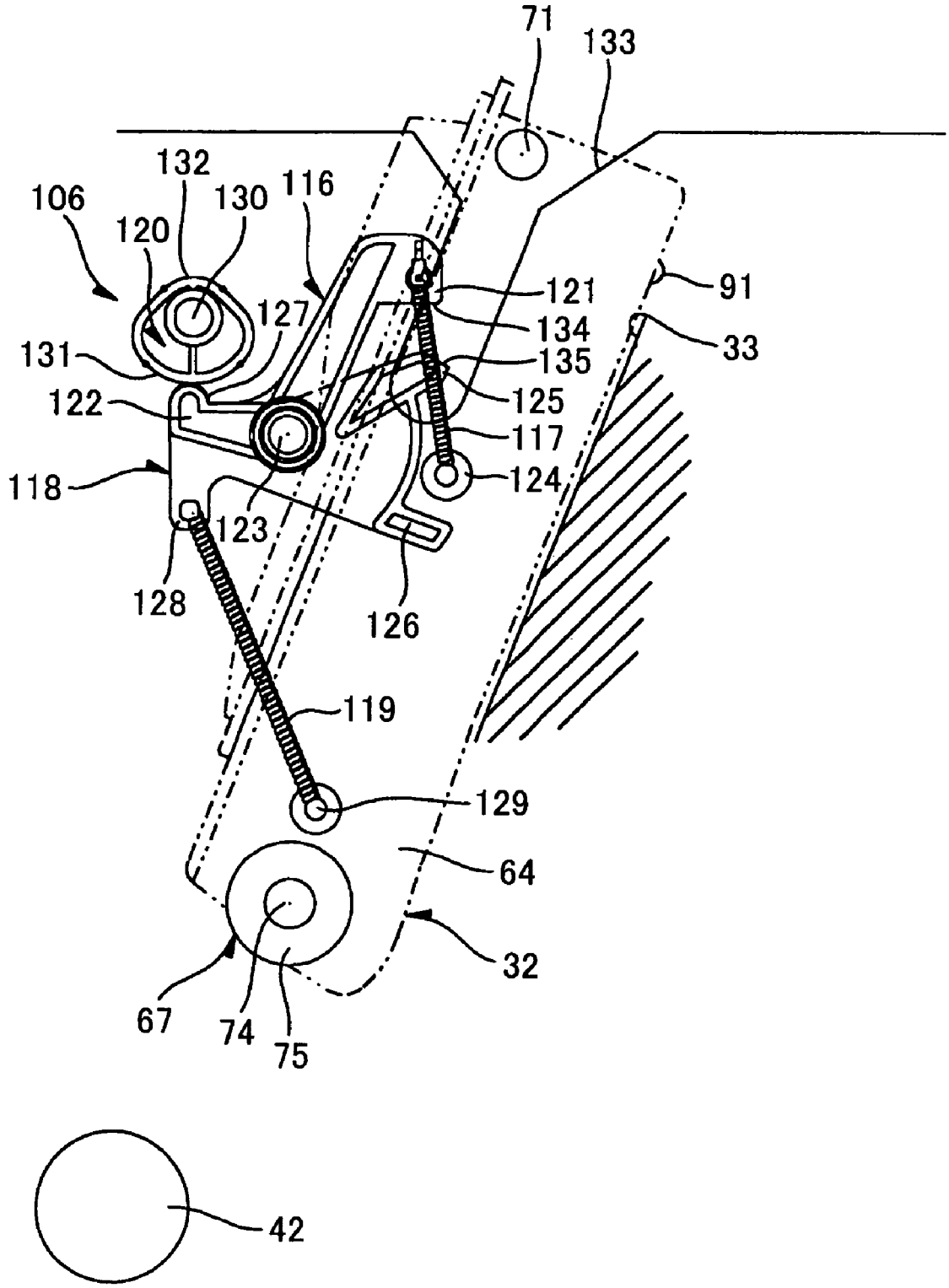
FIG. 24 is a side view showing the mounted state of the developer cartridge in the process accommodating section (prior to inserting the developer boss part into the boss insertion groove)

As shown in FIG. 14, boss insertion grooves 133 are formed in the upper side of the upstream guide parts 140 as cutout portions in the left side plate 8 and right side plate 9 for receiving the developer boss parts 71 of the developer cartridge 32. As shown in FIG. 24, the boss insertion grooves 133 are formed as straight, substantially elongated U-shaped notches in the upper ends of the left side plate 8 and right side plate 9 that slant rearward from top to bottom along the mounting direction of the developer cartridge 32, that is, along a path that the developer boss parts 71 moves when the developer cartridge 32 is mounted or removed. Further, the boss insertion grooves 133 are formed deep enough that the bottoms of the boss insertion grooves 133 are deeper than the position of the developer boss parts 71 when the developer cartridge 32 is mounted on the drum cartridge 31. The boss insertion grooves 133 also have sufficient width in the front-to-rear direction that the developer boss parts 71 fit into the boss insertion grooves 133 with some play. The upper end of the boss insertion grooves 133 has a substantially triangular shape growing wider toward the top to facilitate reception of the developer boss parts 71.

Provided in the guiding grooves 101 are a drum shaft locking mechanism 104 (see FIG. 22) for restricting movement of the drum shaft 60 received in the receiving part 102; a restricting spring 105 (see FIG. 19) for restricting rotation of the drum cartridge 31; and a contacting/separating mechanism 106 (see FIG. 24) for placing the developer cartridge 32 in contact with or separating the developer cartridge 32 from the drum cartridge 31.

Figure 22:
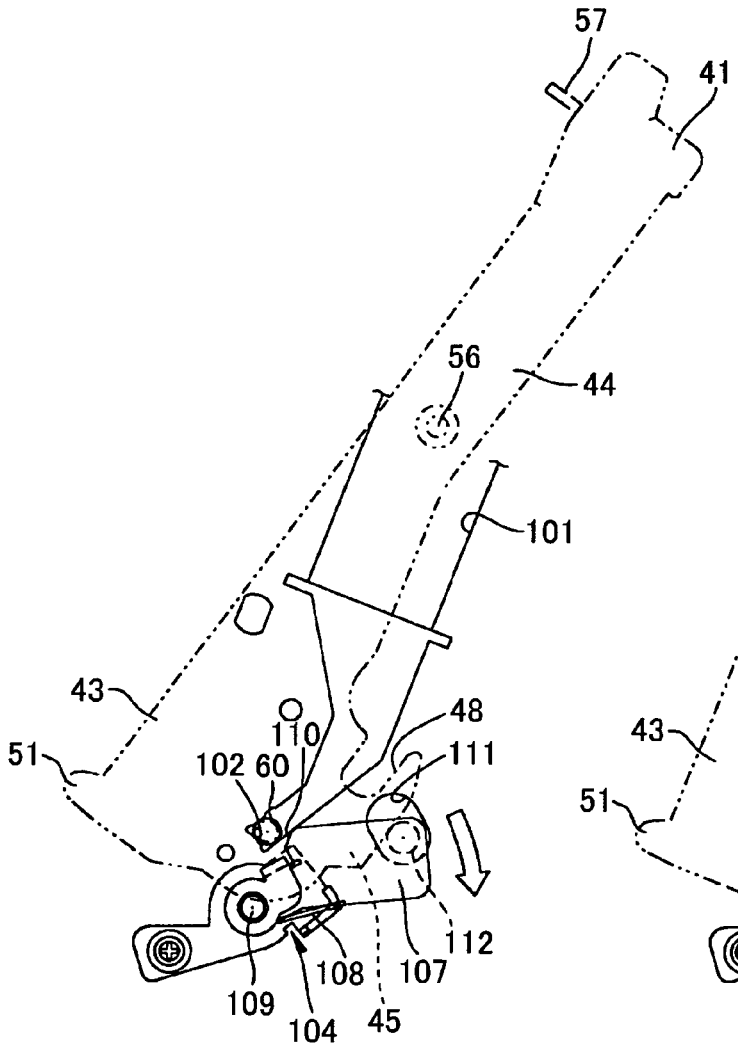

As shown in FIG. 22, the drum shaft locking mechanism 104 is disposed near the receiving part 102 on the outer surfaces of the left side plate 8 and right side plate 9. Each drum shaft locking mechanism 104 includes a pressing cam 107 and an urging spring 108. The pressing cam 107 has a substantially rectangular plate shape. The lower rear end of the pressing cam 107 is rotatably supported on a support shaft 109 that protrudes outward in the widthwise direction from the outer surfaces of the left side plate 8 and right side plate 9. An upper rear corner of the pressing cam 107 is a contact part 110 for contacting the drum shaft 60. Elliptical holes 111 are formed through the left side plate 8 and right side plate 9 near the upper front corner of the pressing cam 107. A contact shaft 112 protrudes inward in the widthwise direction via each of the elliptical holes 111 toward the mounting path of the drum cartridge 31 (the path in which the drum shaft 60 moves).

The urging spring 108 is a coil spring having a coil part that is wound around the support shaft 109. One end of the coil part is fixed to the respective left side plate 8 and right side plate 9, while the other end is engaged with the bottom end of the pressing cam 107. The urging force of the urging spring 108 constantly urges the pressing cam 107 to rotate in a direction by which the contact part 110 forces the drum shaft 60 into the receiving part 102 and by which the contact shaft 112 advances into the mounting path of the drum cartridge 31 (counterclockwise in FIG. 22).

As shown in FIG. 19, the restricting spring 105 is disposed near the drum positioning groove 103 on the outer surfaces of the left side plate 8 and right side plate 9. The restricting spring 105 is a coil spring having a coil part. The coil part is wound around a fixed shaft 115 that protrudes outward in the widthwise direction from the outer surface of the respective left side plate 8 and right side plate 9. One end of the coiled part is fixed to the respective left side plate 8 and right side plate 9. The other end of the restricting spring 105 faces the drum positioning groove 103 and is constantly advanced toward the drum positioning groove 103 by the urging force of the restricting spring 105, but can be retracted from the drum positioning groove 103.

As shown in FIG. 24, the contacting/separating mechanism 106 is disposed one near each of the boss insertion grooves 133 on the outer surface of each of the left side plate 8 and right side plate 9. The contacting/separating mechanism 106 includes a first pressing member 116 for pressing the developer boss part 71 in the mounting direction, a first urging spring 117 for urging the first pressing member 116, a second pressing member 118 for pressing the developer boss part 71 in the removal direction, a second urging spring 119 for urging the second pressing member 118, and a cam 120 disposed in confrontation with the first pressing member 116 and the second pressing member 118.

The first pressing member 116 is substantially shaped like the letter V with one leg connected to the other leg via a bent portion. When the first pressing member 116 is in a separated state described later with reference to FIG. 26, one leg of the first pressing member 116 is parallel to the boss insertion grooves 133, while the other leg extends in the front-to-rear direction. A boss contact part 121 is formed on a distal end of the first leg for contacting the developer boss part 71. The boss contact part 121 is formed at an angle to the first leg so as to extend forward from the end of the first leg when the first pressing member 116 is in the separated state. The bottom surface of the boss contact part 121 is formed as an upper pressing surface 134 for pressing the developer boss part 71 from above. The upper pressing surface 134 is formed so as to contact the developer boss parts 71 at a slant, simultaneously generating a pressing force for pressing the developer boss part 71 in the mounting direction and a pressing force for pressing the developer boss parts 71 toward the front edge of the boss insertion grooves 133, which edge serves as a reference surface. A cam contact part 122 is formed on the other distal end of the first pressing member 116 on the second leg for contacting the cam 120. The cam contact part 122 protrudes upward from the other end when the first pressing member 116 is in the separated state.

The first pressing member 116 is rotatably supported at the bent part thereof on a support shaft 123. The support shaft 123 is provided on the outer surface of the left side plate 8 and right side plate 9 and protrudes outward in the widthwise direction from a position behind the bottom end (deepest part) of the boss insertion groove 133. With this construction, the first pressing member 116 is provided so that the boss contact part 121 can advance into or retract from the boss insertion groove 133, that is, the moving path of the developer boss part 71, in the front-to-rear direction; while the cam contact part 122 can contact or separate from the bottom side of the cam 120 on the opposite side of the support shaft 123 from the boss insertion groove 133.

With this arrangement, the support shaft 123 is disposed downstream of the boss contact part 121 with respect to the mounting direction of the developer boss part 71.

The first urging spring 117 is a tension spring having one end fixed to a first fixing shaft 124 that protrudes from a position on the outer surface of the respective left side plate 8 and right side plate 9 below the bottom end (deepest part) of the boss insertion grooves 133. The other end of the first urging spring 117 is engaged in the cam contact part 121. Hence, the first urging spring 117 constantly urges the first pressing member 116 in a direction for moving the boss contact part 121 toward the moving path of the developer boss parts 71 (forward) and for moving the cam contact part 122 near the cam 120 (upward).

Figure 26:
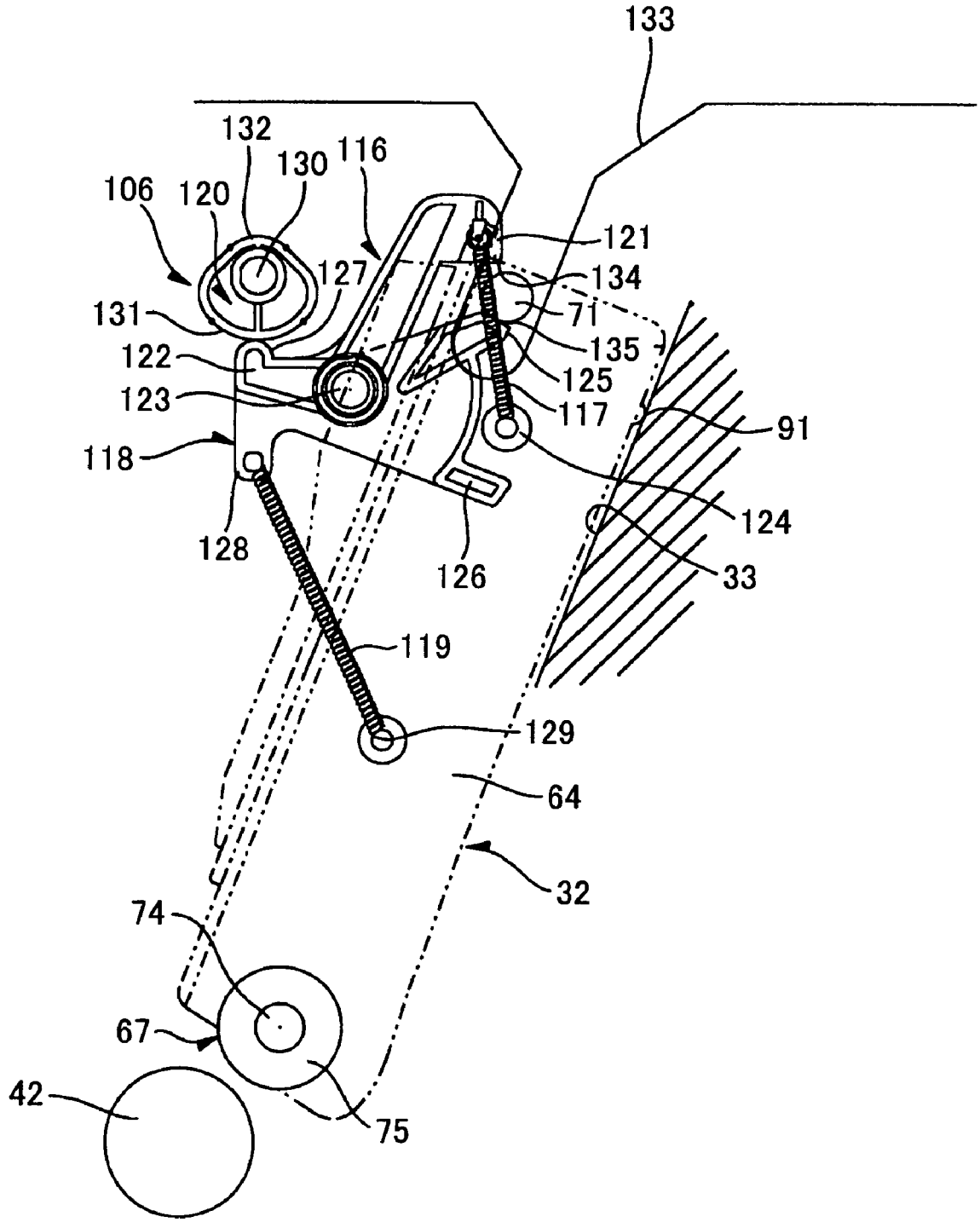
FIG. 26 is a side view showing the mounted state of the developer cartridge in the process accommodating section (separated state)

The second pressing member 118 has a substantially rectangular plane shape. A boss contact pawl part 125 is provided on the upper front corner of the second pressing member 118 for contacting the developer boss parts 71. The boss contact pawl part 125 protrudes diagonally upward and forward when the second pressing member 118 is in the separated state. Further, a rotation restricting pawl part 126 that is capable of contacting the first fixing shaft 124 is provided on the lower front corner of the second pressing member 118 and protrudes diagonally downward and forward when the second pressing member 118 is in the separated state. A cam contacting protrusion 127 for contacting the cam 120 is also provided on the upper edge of the second pressing member 118 near the rear end and protrudes upward when the second pressing member 118 is in the separated state. A spring engaging protrusion 128 for engaging with the other end of the second urging spring 119 is provided on the lower edge of the second pressing member 118 near the rear end and protrudes downward when the second pressing member 118 is in the separated state (FIG. 26).

The second pressing member 118 is rotatably supported on the support shaft 123 at a midpoint in the front-to-rear direction. In this way, the boss contact pawl part 125 extends toward a midpoint of the boss insertion groove 133, that is, a midpoint of the moving path of the developer boss part 71 at a position downstream of the boss contact part 121 in the mounting direction of the developer boss part 71 and can move in the mounting direction or removal direction of the developer boss part 71. Further, the rotation restricting pawl part 126 can contact or separate from the first fixing shaft 124, and the cam contacting protrusion 127 can contact or separate from the lower side of the cam 120 on the opposite side of the support shaft 123 from the boss insertion groove 133.

The second urging spring 119 is a tension spring having one end fixed to a second fixing shaft 129 provided on the outer surface of the respective left side plate 8 and right side plate 9. The second fixing shaft 129 protrudes outward in the widthwise direction from a position below the first fixing shaft 124. The other end of the second urging spring 119 is engaged in the spring engaging protrusion 128. With this construction, the second urging spring 119 constantly urges the second pressing member 118 in a direction by which the boss contact pawl part 125 presses the developer boss part 71 in the removal direction along the moving path of the developer boss parts 71 (upward), by which the rotation restricting pawl part 126 moves toward the first fixing shaft 124 (upward), and by which the cam contacting protrusion 127 separates from the cam 120 (downward).

The spring constant of the second urging spring 119 is set smaller than that of the first urging spring 117.

Figure 28:
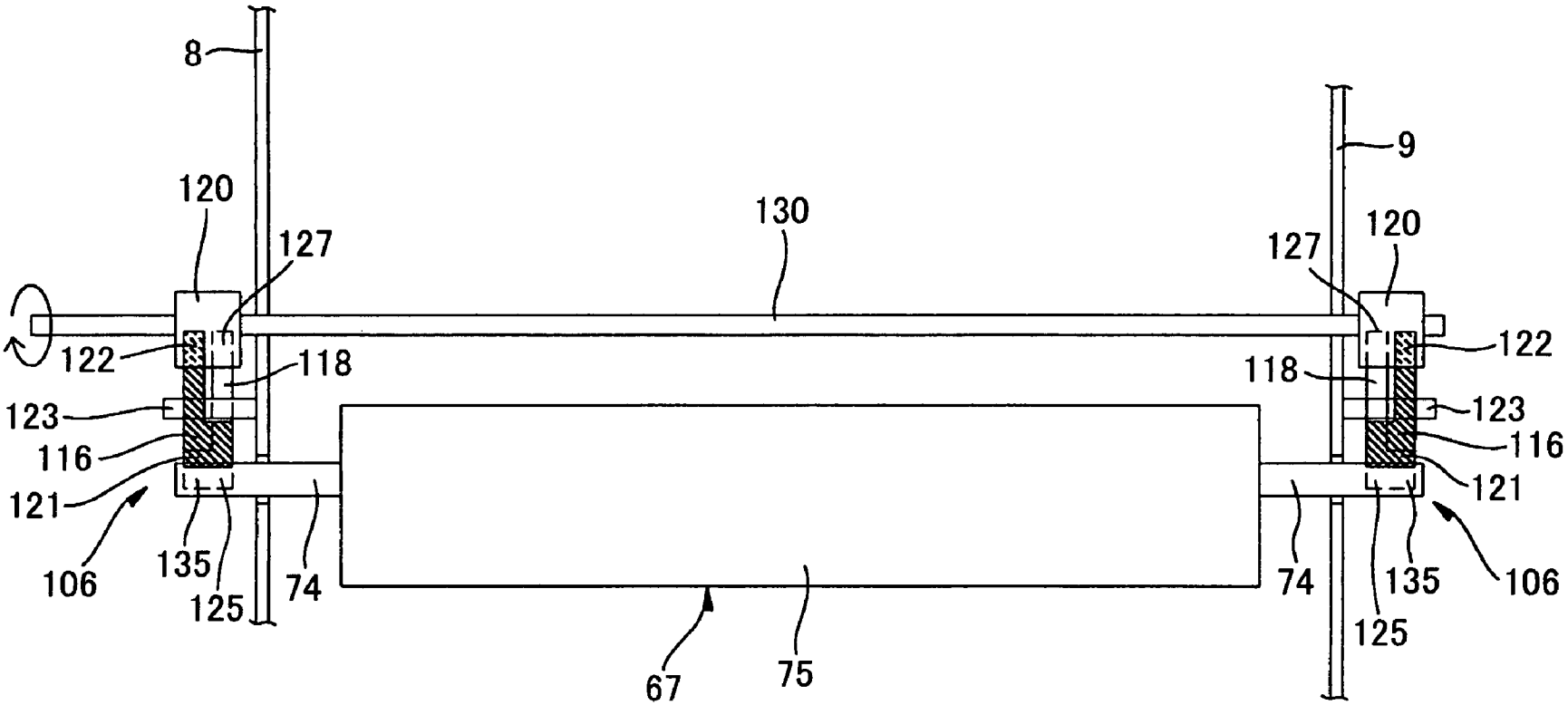
FIG. 28 is a plan view showing the mounted state of the developer cartridge in the process accommodating section (separated state)

As shown in FIG. 28, both the first pressing member 116 and the second pressing member 118 are rotatably supported on the support shaft 123, with the first pressing member 116 disposed on the widthwise outer side of the second pressing member 118. The boss contact part 121 of the first pressing member 116 protrudes inward in the widthwise direction, while the boss contact pawl part 125 of the second pressing member 118 protrudes outward in the widthwise direction so that the upper pressing surface 134 of the boss contact part 121 overlaps a lower side pressing surface 135 of the boss contact pawl part 125 in the moving direction of the developer boss parts 71.

As shown in FIG. 24, the cam 120 is shaped somewhat like a folding fan. The cam 120 is coupled to a camshaft 130 and is incapable of rotating relative to the camshaft 130. The camshaft 130 is rotatably supported in the left side plate 8 and right side plate 9 and protrudes outward in the widthwise direction from a position above and behind the support shaft 123. The cam 120 is formed with a continuous peripheral surface that includes a contact surface 131 having an arc shape, and a separating surface 132 formed on the side opposite the contact surface 131 and shaped substantially like the letter V with a corner portion in the center thereof.

By rotating the camshaft 130, the cam 120 can be oriented to selectively position the contact surface 131 or separating surface 132 opposite the cam contact part 122 of the first pressing member 116 and the cam contacting protrusion 127 of the second pressing member 118.

Figure 29:
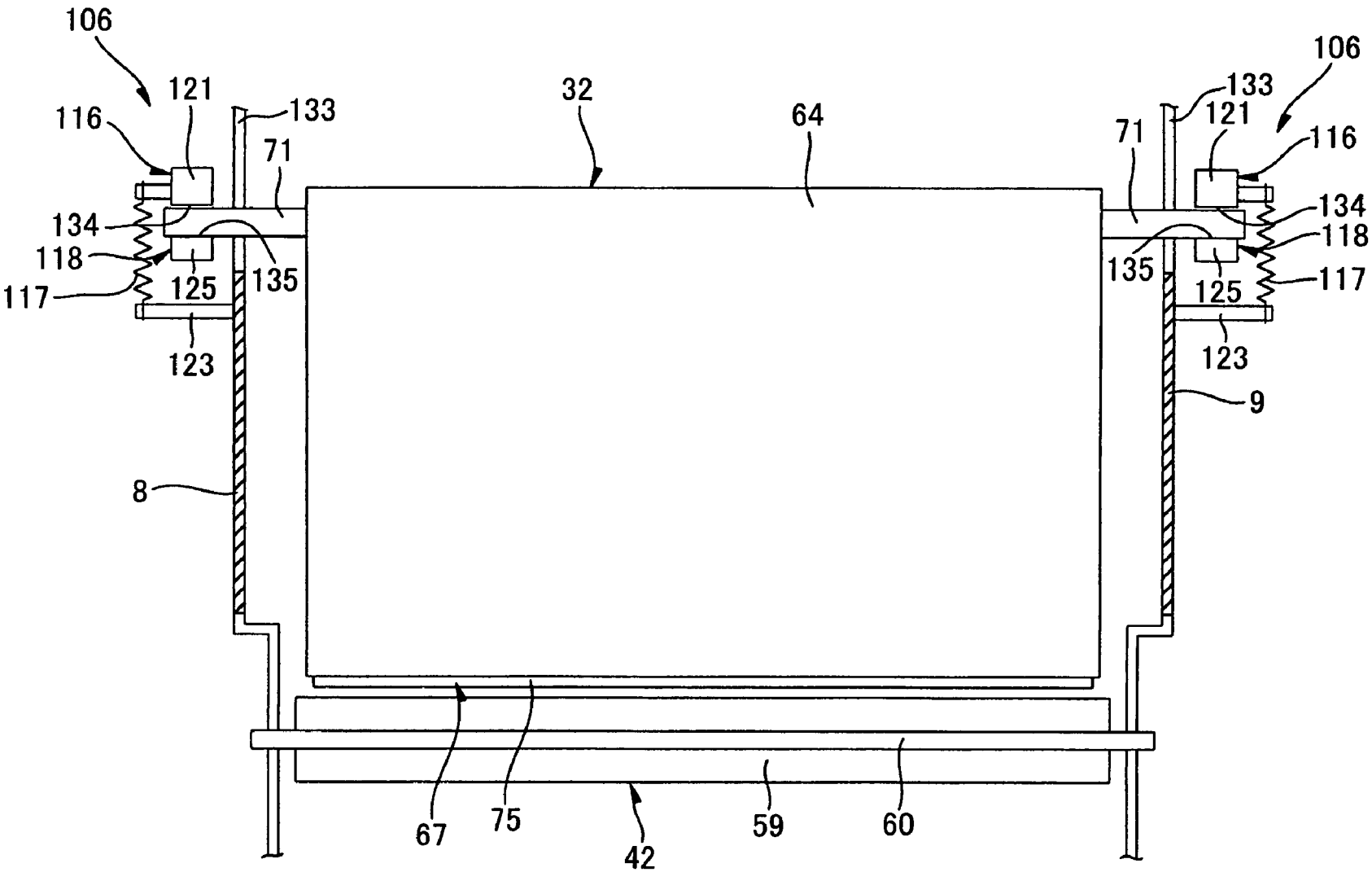
FIG. 29 is a front view showing the mounted state of the developer cartridge in the process accommodating section (separated state)

While the developer cartridge 32 is mounted in the developer-accommodating section 14, during non-image-forming operations, the contact surface 131 of the cam 120 contacts the cam contact part 122 and the cam contacting protrusion 127 to push the first pressing member 116 and the second pressing member 118 downward in the separated state in which the photosensitive drum 42 is separated from the developing roller 67 as shown in FIGS. 26, 28, and 29.

Although the first urging spring 117 pulls the boss contact part 121 of the first pressing member 116 downward, in the separated state the first pressing member 116 is rotated against the urging force of the first urging spring 117 so that the boss contact part 121 is retracted from the moving path of the developer boss parts 71. While the boss contact part 121 is moved in this retracting direction in the separated state, the boss contact part 121 advances slightly toward the moving path of the developer boss parts 71 within a range allowed by the mounting and removal of the developer cartridge 32.

Also in the separated state, the second pressing member 118 is rotated in a direction that compresses the second urging spring 119 and, by a pressing force larger than the urging force of the second urging spring 119, moves the boss contact pawl part 125 in a direction for pressing the developer boss parts 71 in the removal direction and moves the rotation restricting pawl part 126 toward the first fixing shaft 124. In this separated state, the boss contact pawl part 125 is disposed on the moving path of the developer boss parts 71 at a position upstream of a contact state described later (FIGS. 27, 30, and 31) with respect to the mounting direction of the developer boss parts 71.

Figure 32A:
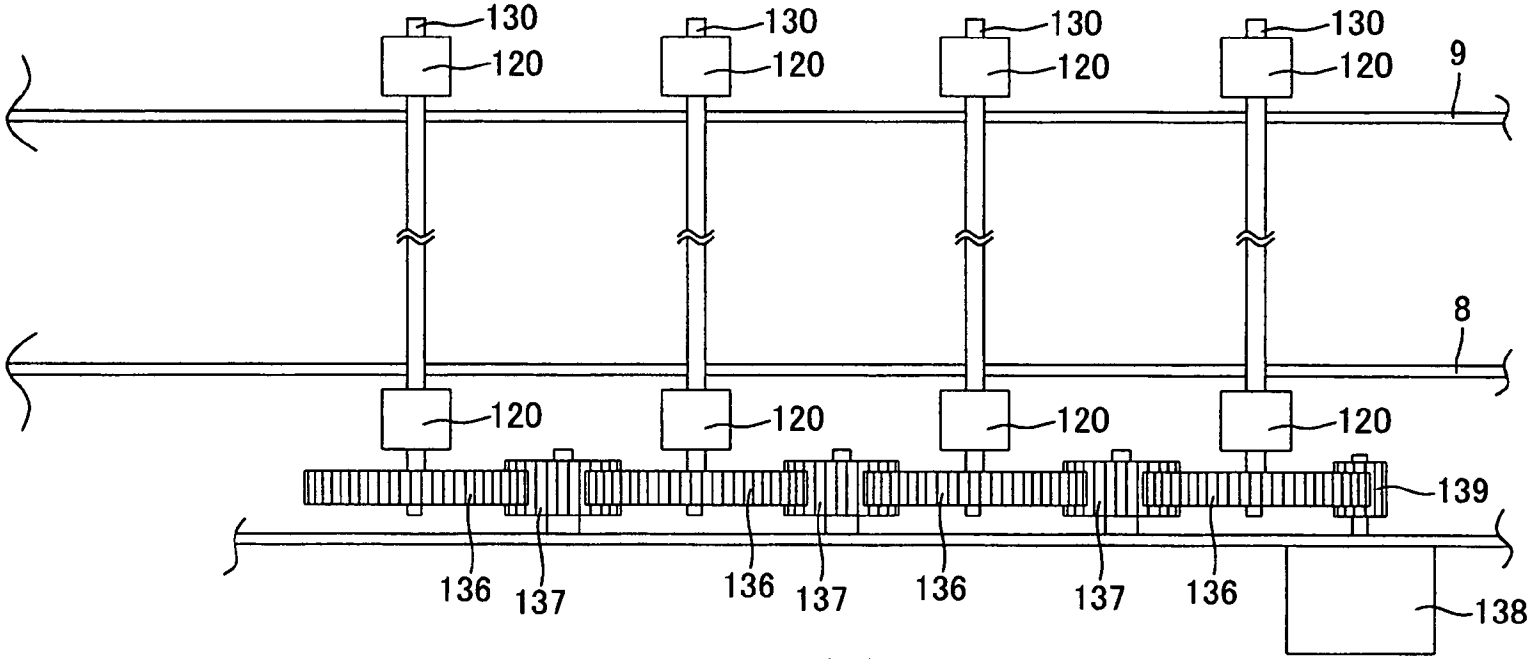
FIG. 32(*a*) is a plan view showing the structure of a cam driving path.
Figure 32B:
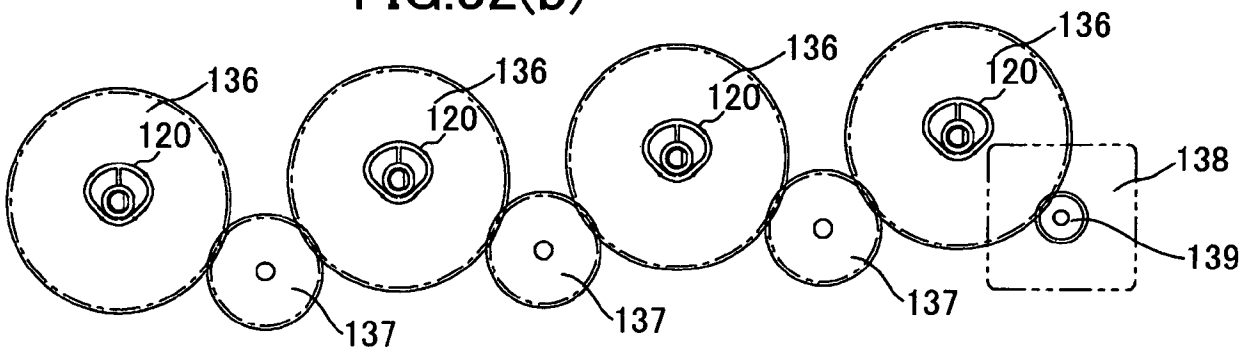

As shown in FIG. 32(*a*), the contacting/separating mechanism 106 is provided for each process-accommodating section 12, and in each process-accommodating section 12 the camshaft 130 spans between the left side plate 8 and right side plate 9 and is rotatably supported in the left side plate 8 and right side plate 9, and the cams 120 are coupled with the camshaft 130, one on each end thereof. While not shown in the drawing, a pair of the first pressing members 116 and a pair of the second pressing members 118 is provided in each process-accommodating section 12 to correspond to the pair of cams 120.

A cam drive gear 136 is coupled with the end of each camshaft 130 protruding from the outside of the left side plate 8. The cam drive gear 136 is incapable of rotating relative to the camshaft 130. An intermediate gear 137 is provided between adjacent cam drive gears 136 and is engaged with the cam drive gears 136. With this construction, a gear train is formed of the cam drive gears 136 and intermediate gears 137, as shown in FIG. 32(*b*). A motor 138 is provided for generating a driving force for driving each of the camshafts 130. The driving force generated by the motor 138 is inputted into the gear train via a pinion gear 139. This driving force is transferred to the camshafts 130 via the gear train for rotating each of the camshafts 130. Accordingly, the pairs of cams 120 are rotated simultaneously to selectively position either the contact surface 131 or the separating surface 132 opposite the cam contact part 122 of the first pressing member 116 and the cam contacting protrusion 127 of the second pressing member 118.

With the color laser printer 1 according to the preferred embodiment, each drum cartridge 31 is mounted in the main casing 2 by mounting the drum cartridge 31 for each color into the corresponding drum-accommodating section 13 of the corresponding process-accommodating section 12. Subsequently, the developer cartridge 32 of each color is mounted into the corresponding developer-accommodating section 14 and is thereby mounted on the corresponding drum cartridge 31.

Next, the process of mounting the drum cartridge 31 and developer cartridge 32 in the main casing 2 will be described with reference to FIGS. 15 through 23.

To mount the drum cartridge 31 in the drum-accommodating space 15 of the process-accommodating section 12, the user grips the drum grip 57, inserts the drum bosses 56 of the drum cartridge 31 into the corresponding guiding grooves 101, and pushes the drum cartridge 31 downward, as shown in FIG. 15. Through this operation, the drum bosses 56 are inserted into the upstream guide part 140, and the drum cartridge 31 is guided through the developer-accommodating section 14. Next, the drum bosses 56 are inserted into the downstream guide part 141, and the holder unit 43 is guided toward the expanded space 19 until the drum cartridge 31 is mounted in the drum-accommodating section 13. This construction ensures that the drum cartridge 31 can be mounted into the drum-accommodating section 13 smoothly.

Figure 20:
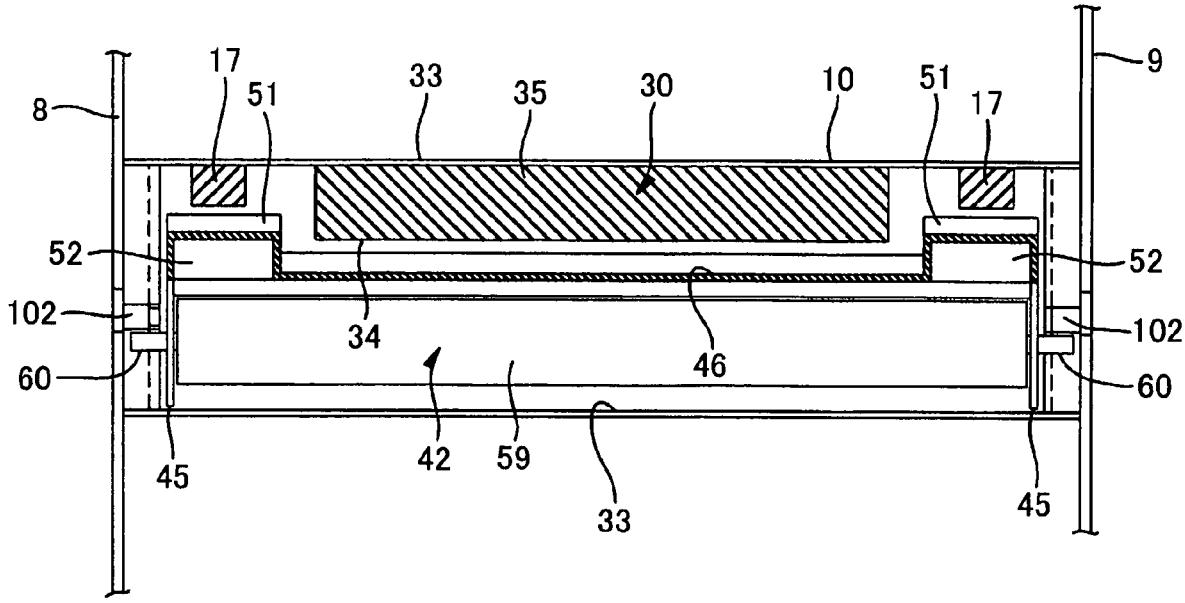
FIG. 20 is a cross-sectional view taken along an imaginary horizontal plane and showing the mounted state of the drum cartridge in the process accommodating section (when passing through the developer accommodating section)

When the holder unit 43 of the drum cartridge 31 passes through the developer-accommodating space 16 of the developer-accommodating section 14, the ridges 51 of the drum cartridge 31 frequently slide against the rail parts 17 of the developer-accommodating section 14 as the drum cartridge 31 is mounted, as shown in FIG. 20. In this way, since the ridges 51 protrude toward the rail parts 17 and the rail parts 17 are formed of thick strips, the ridges 51 contact the rail parts 17 to form a gap between the front wall 34 of the scanner casing 35 and the top wall 46 opposing the front wall 34, thereby preventing the top wall 46 from rubbing against the front wall 34 of the scanner casing 35.

Since the top wall 46 can be prevented from sliding against the front wall 34 of the scanner casing 35 by sliding the ridges 51 against the rail parts 17 when mounting the drum cartridge 31, the color laser printer 1 of the preferred embodiment can prevent the drum cartridge 31 from becoming damaged during the mounting process. Moreover, since the ridges 51 and the rail parts 17 are disposed on either widthwise end of the scanner casing 35, the holder unit 43 can be reliably prevented from sliding against the scanner casing 35.

Further, the charger 62 is disposed rearward of the ridges 51 in FIG. 2 in the holder unit 43, that is, upstream of the ridges 51 in the mounting direction of the drum cartridge 31. Accordingly, the ridges 51 always precede the charger 62 when the drum cartridge 31 is mounted, thereby reliably preventing damage to the charger 62.

Figure 16:
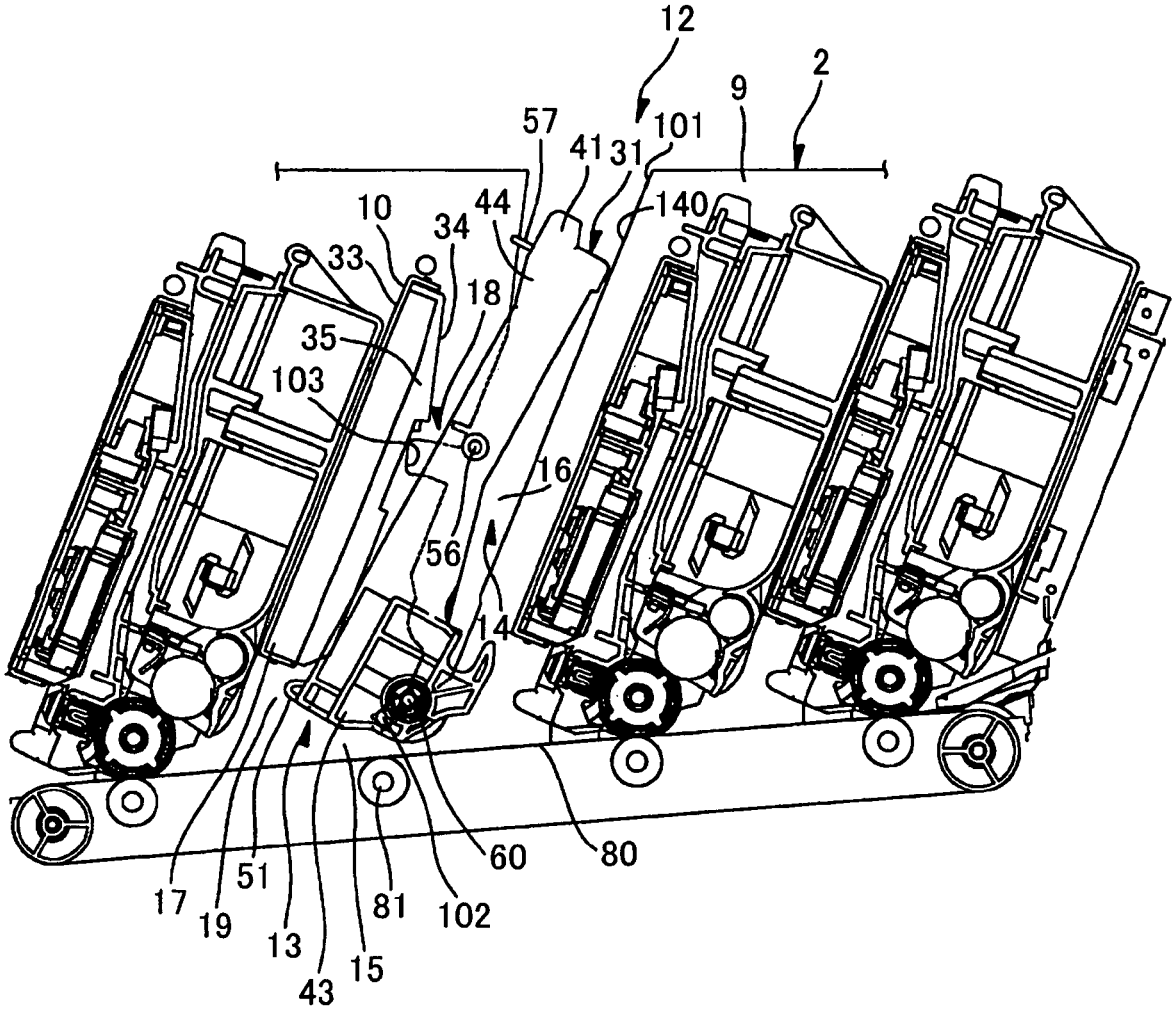
FIG. 16 is a side view showing the mounted state of the drum cartridge in the process accommodating section (when reaching the drum accommodating section)
Figure 17:
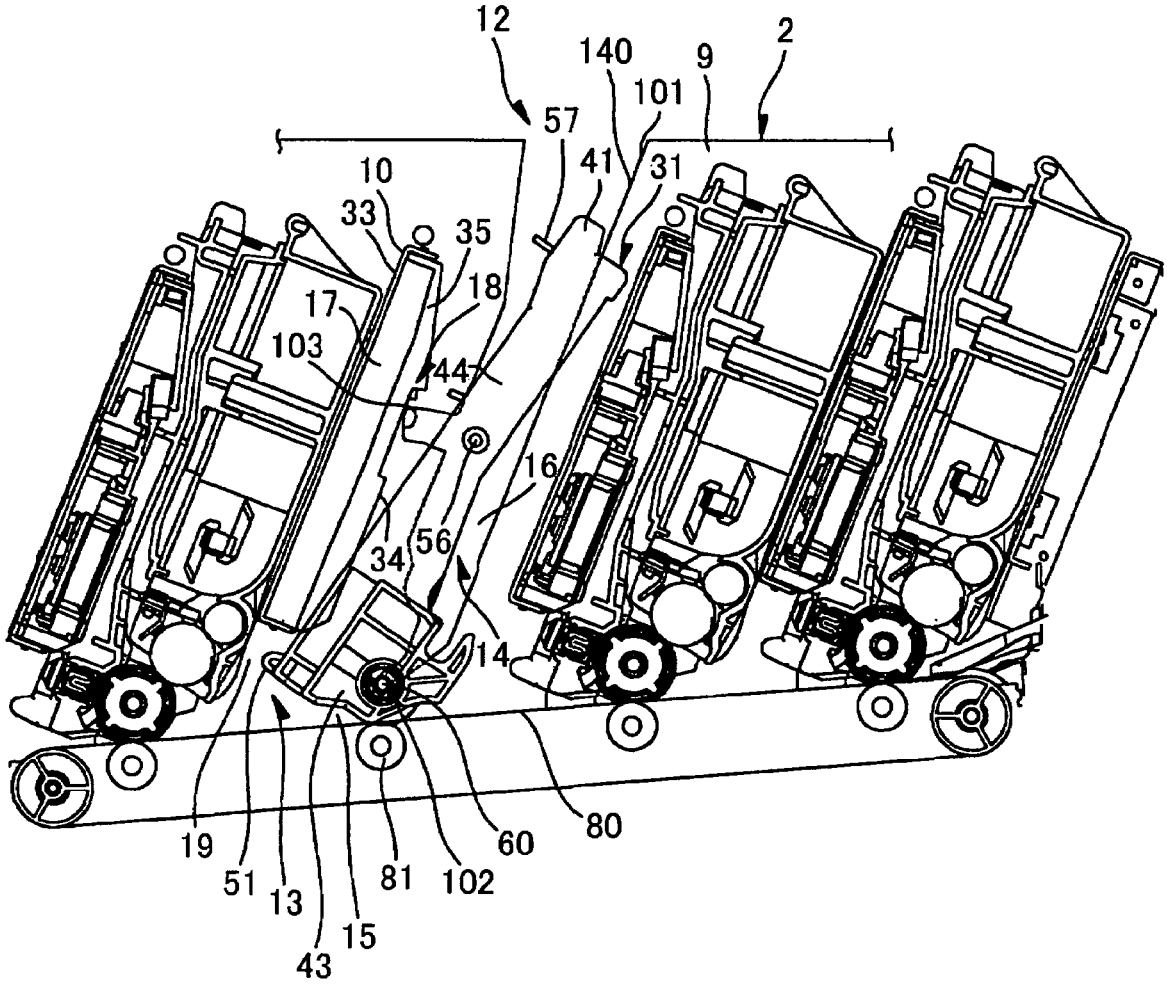
FIG. 17 is a side view showing the mounted state of the drum cartridge in the process accommodating section (while being rotated)

When the holder unit 43 of the drum cartridge 31 arrives in the drum-accommodating section 13, the drum shaft 60 is guided along the downstream guide part 141, which is bent diagonally rearward with respect to the upstream guide part 140. Hence, the drum shaft 60 moves diagonally rearward along the downstream guide part 141, as shown in FIG. 16. When the drum shaft 60 reaches the end of the receiving part 102, the drum casing 41 is oriented at a slant, with the holder unit 43 positioned rearward and the extended part 44 positioned forward, as shown in FIGS. 17, 19(*a*), and 22. In this state, the developer-accommodating space 16 of the developer-accommodating section 14 is closed by the extended part 44.

Figure 18:
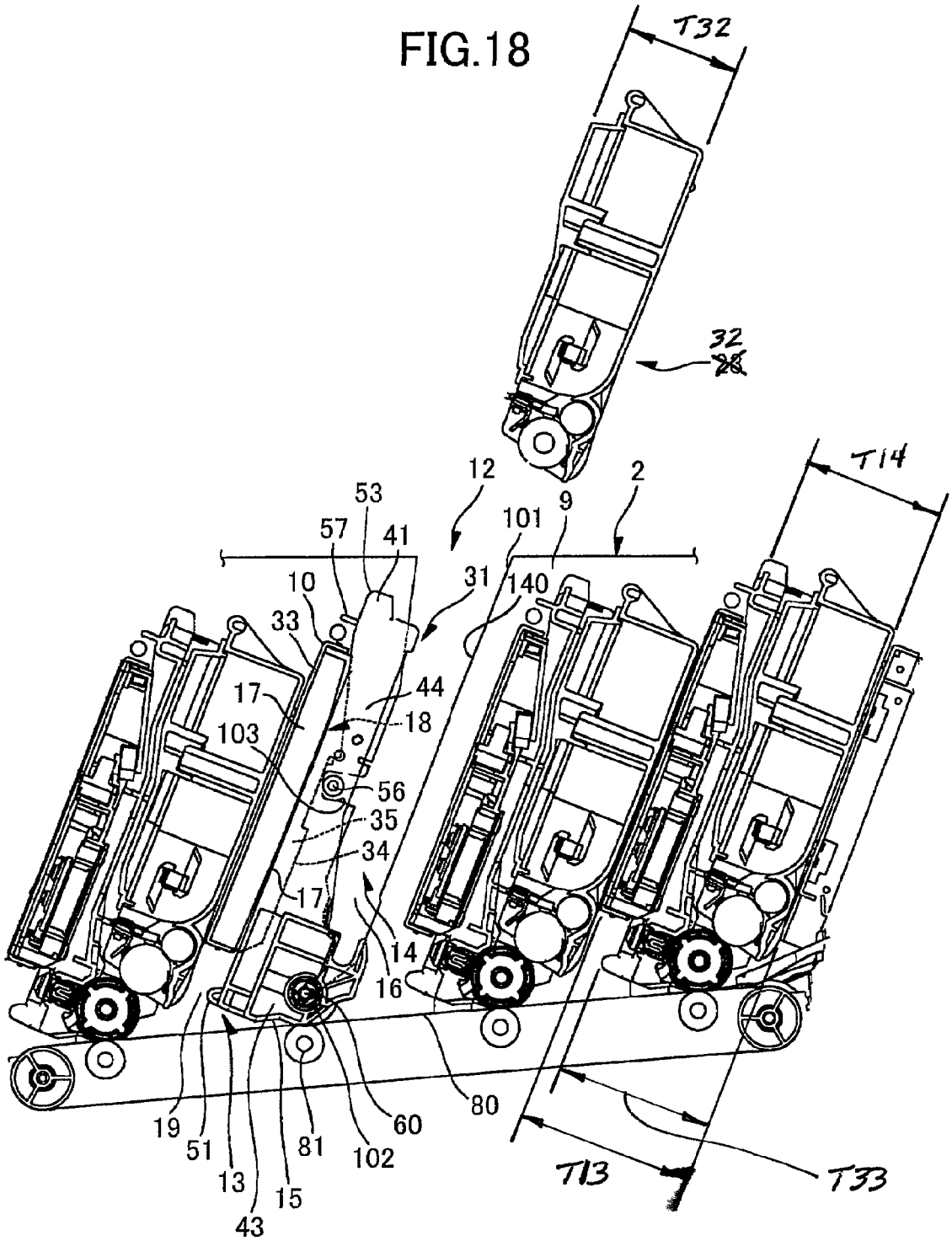
FIG. 18 is a side view showing the mounted state of the drum cartridge in the process accommodating section (when completely mounted)
Figure 21:
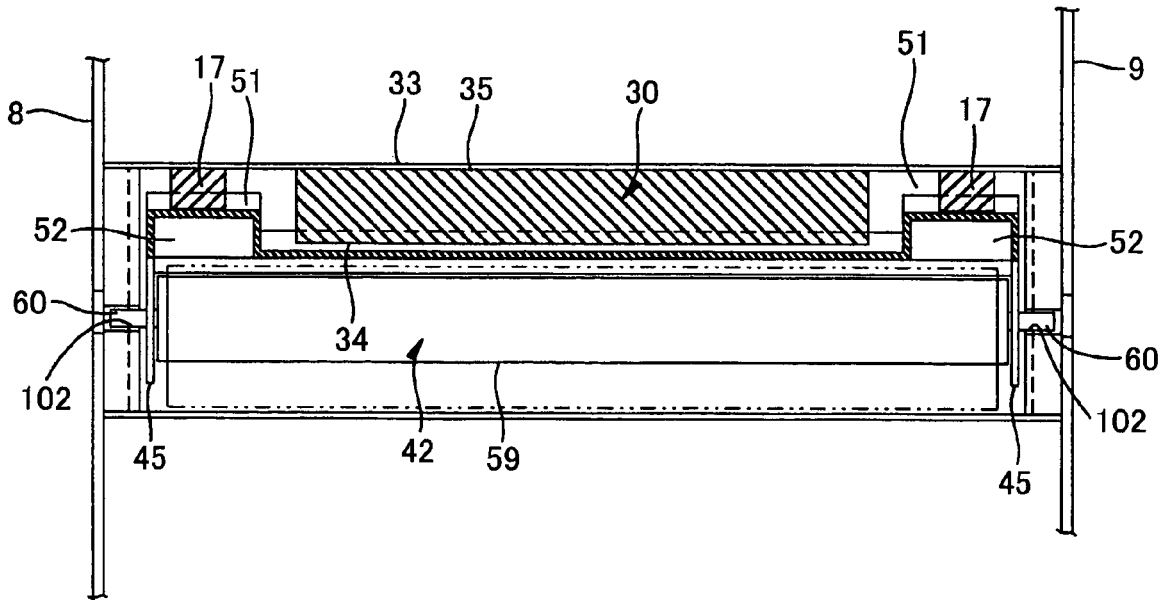
FIG. 21 is a cross-sectional view taken along an imaginary horizontal plane and showing the mounted state of the drum cartridge in the process accommodating section (when completely mounted)

After the drum shaft 60 reaches the end of the receiving part 102, the user grips the drum grip 57 and rotates the extended part 44 rearward about the drum shaft 60 supported in the receiving part 102. Through this operation, the extended part 44 is withdrawn from the developer-accommodating space 16 into the extended accommodating space 18, as shown in FIGS. 18 and 21, thereby freeing up the developer-accommodating space 16 for accommodating the developer cartridge 32.

More specifically, when the drum shaft 60 reaches the end of the receiving part 102, the drum bosses 56 first oppose the drum positioning grooves 103, as shown in FIG. 19(*a*). Then, the extended part 44 is withdrawn from the developer-accommodating space 16 toward the extended accommodating space 18, and the drum bosses 56 are accepted into the drum positioning grooves 103 as shown in FIG. 19(*b*). The drum bosses 56 slidingly contact the other ends of the restricting springs 105 until accommodated in the deepest part of the drum positioning grooves 103, as shown in FIG. 19(*c*).

As the drum bosses 56 press against the restricting springs 105 during this operation, the elastic ends of the restricting springs 105 are temporarily pushed out of the drum positioning grooves 103 as shown in FIG. 19(*b*) until the drum bosses 56 have passed into the drum positioning grooves 103. Subsequently, the elastic force of the restricting springs 105 brings the ends of the restricting springs 105 back into the drum positioning grooves 103 as shown in FIG. 19(*c*). At this time, the ends of the restricting springs 105 restrict the drum bosses 56, which are now accommodated in the deepest parts of the drum positioning grooves 103, from separating from the drum positioning grooves 103. This construction restricts the extended part 44 from rotating forward. Hence, once the extended part 44 is moved into the extended accommodating space 18 from the developer-accommodating space 16, the extended part 44 is reliably positioned and prevented from moving back into the developer-accommodating space 16.

To remove the drum cartridge 31, the user grips the drum grip 57 and rotates the extended part 44 forward. At this time, the drum bosses 56 press against the ends of the restricting springs 105, causing the elastic restricting springs 105 to be pushed out of the drum positioning grooves 103 as shown in FIG. 19(*b*). After the drum bosses 56 exit the drum positioning grooves 103, the elastic force of the restricting springs 105 brings the ends of the restricting springs 105 back into the drum positioning grooves 103 as shown in FIG. 19(*a*). In this way, the drum bosses 56 can be separated from the drum positioning grooves 103.

Further, when the drum shaft 60 is at the end of the receiving part 102, and the drum casing 41 is in a slanted position with the holder unit 43 positioned rearward and the extended part 44 forward (FIGS. 17 and 19(*a*)), the bottom end of each side wall 45 presses against each contact shaft 112 in the drum shaft locking mechanism 104, as shown in FIG. 22. Further, the pressing cams 107 are rotated against the urging force of the urging springs 108 in a direction that retracts the contact shafts 112 from the mounting path of the drum cartridge 31 (clockwise in FIG. 22).

Figure 23:
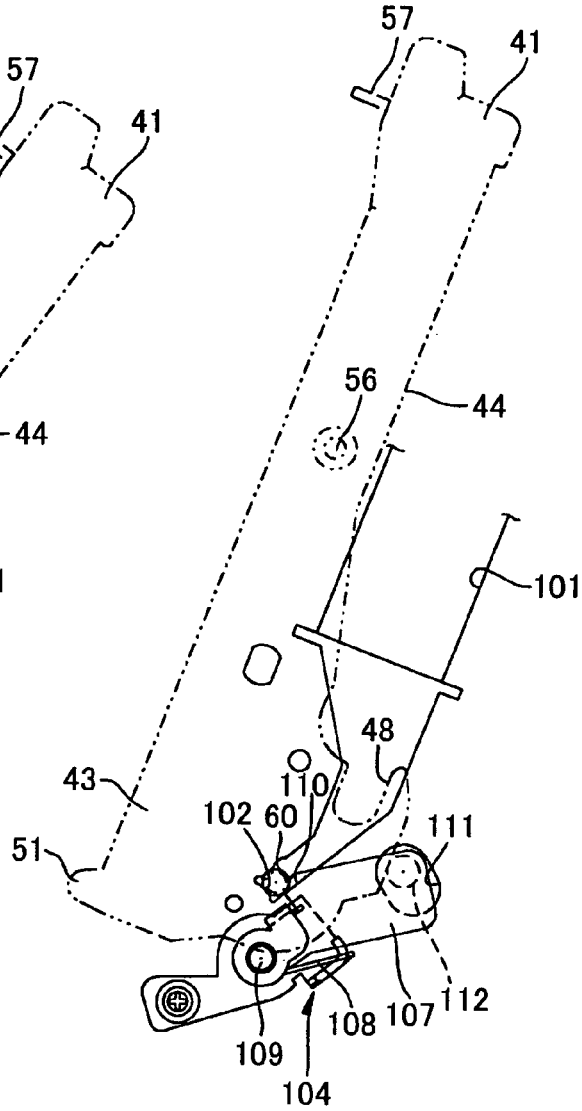

After the extended part 44 is rotated rearward as described above with reference to FIGS. 18, 19(*b*), and 19(*c*), as shown in FIG. 23, the urging force of the urging springs 108 causes the pressing cams 107 to rotate in a direction for advancing the contact shafts 112 into the mounting path of the drum cartridge 31 (counterclockwise in FIG. 23). Accordingly, the contact part 110 advances so as to close the guiding groove 101 and presses the drum shaft 60 toward the receiving part 102, thereby restricting movement of the drum shaft 60 in the receiving part 102.

To remove the drum cartridge 31, the user grips the drum grip 57 and rotates the extended part 44 forward. As a result, the bottom ends of the side walls 45 press the contact shafts 112, causing the pressing cams 107 to rotate against the urging force of the urging springs 108 in a direction for retracting the contact shafts 112 from the mounting path of the drum cartridge 31 (clockwise in FIG. 22). Accordingly, the contact part 110 is separated from the drum shaft 60 so as to open the guiding grooves 101, thereby allowing movement of the drum shaft 60 in the receiving part 102.

Through the process described above, the drum is cartridge 31 is mounted in the main casing 2 such that the drum cartridge 31 is accommodated in the drum-accommodating space 15, having the expanded space 19 of the drum-accommodating section 13, and the extended part 44 is accommodated in the extended accommodating space 18 of the developer-accommodating section 14.

In the color laser printer 1 of the preferred embodiment the front wall 34 of each scanner casing 35 protrudes forward from the partitioning plates 10 toward the developer-accommodating space 16. Hence, the front wall 34 of the scanner casing 35 restricts the passage of the drum cartridge 31 through the developer-accommodating section 14 when the developer cartridge 32 is mounted on the drum cartridge 31. However, the drum cartridge 31 is allowed to pass through the developer-accommodating space 16 when the developer cartridge 32 is separated from the drum cartridge 31.

By forming the front wall 34 of the scanner casing 35 to expand toward the developer-accommodating space 16, the drum cartridge 31 can be passed through the developer-accommodating space 16 without conflicting with the front wall 34 of the scanner casing 35 and can be mounted in the drum-accommodating section 13 and accommodated in the drum-accommodating space 15 when separated from the developer cartridge 32, without simply allocating additional space for the mounting paths of the drum cartridge 31 and the developer cartridge 32. Subsequently, as described below, the developer cartridge 32 can be mounted in the developer-accommodating section 14 and accommodated in the developer-accommodating space 16, thereby completing the process of mounting both the drum cartridge 31 and developer cartridge 32.

Specifically, the color laser printer 1 of the preferred embodiment uses the developer-accommodating space 16 of the developer-accommodating section 14 for accommodating the developer cartridge 32 to insert the drum cartridge 31 detached from the developer cartridge 32 past the front wall 34 of the scanner casing 35 in order to mount the drum cartridge 31 in the drum-accommodating section 13. Accordingly, the color laser printer 1 of the preferred embodiment can reduce the amount of space required for the mounting paths of the drum cartridge 31 and developer cartridge 32, thereby making the overall device more compact.

More specifically, in the color laser printer 1 according to the preferred embodiment, the developer-accommodating section 14 may be formed narrower than the thickness of the drum cartridge 31 and developer cartridge 32 when the drum cartridge 31 and developer cartridge 32 are accommodated in the process-accommodating section 12. In such a case, only the drum cartridge 31 is first inserted through the developer-accommodating section 14 and mounted in the drum-accommodating section 13. Subsequently, the developer cartridge 32 having a thickness less than the thickness of the holder unit 43 on the drum cartridge 31 is mounted in the developer-accommodating section 14, thereby completing the mounting of the drum cartridge 31 and developer cartridge 32. Accordingly, the space required for mounting paths of the drum cartridge 31 and developer cartridge 32 can be reduced, thereby enabling the device to be made more compact.

More specifically, when the drum cartridge 31 and developer cartridge 32 are mounted in the drum-accommodating section 13 and developer-accommodating section 14 respectively, the holder unit 43 is disposed in the expanded space 19 of the drum-accommodating section 13. Although movement of the drum cartridge 31 in the removing direction is restricted when the holder unit 43 is positioned in the expanded space 19, by moving the holder unit 43 out of the expanded space 19 in the thickness direction a distance corresponding to the thickness of the developer cartridge 32, removal of the drum cartridge 31 is allowed. Hence, after inserting the drum cartridge 31 through the developer-accommodating section 14, the drum cartridge 31 is mounted in the drum-accommodating section 13 with the holder unit 43 positioned in the expanded space 19, thereby allowing the developer cartridge 32 to be mounted in the developer-accommodating section 14. In this way, space required for mounting and removing the drum cartridge 31 and developer cartridge 32 can be reduced, thereby allowing the overall device to be made compact.

Since the drum cartridge 31 is accommodated in the drum-accommodating space 15 of the drum-accommodating section 13 and the developer cartridge 32 is accommodated in the developer-accommodating space 16 of the developer-accommodating section 14, the drum cartridge 31 and developer cartridge 32 can be reliably accommodated in the process-accommodating section 12.

Further, when mounting the drum cartridge 31 in the color laser printer 1 according to the preferred embodiment, the extended part 44 is rotated rearward about the drum shaft 60 while the drum shaft 60 is supported in the receiving part 102, thereby withdrawing the extended part 44 from the developer-accommodating space 16 into the extended accommodating space 18 to free up the developer-accommodating space 16 for accommodating the developer cartridge 32. Hence, through a simple operation, the developer cartridge 32 can be accommodated in the developer-accommodating space 16 after mounting the drum-cartridge 31 in the drum-accommodating section 13.

In addition to serving as a rotational point, the drum shaft 60 also improves the accuracy for positioning the photosensitive drum 42 when mounting the drum cartridge 31, thereby reducing the number of required parts.

Further, when the drum cartridge 31 is mounted in the drum-accommodating section 13, the restricting springs 105 prevent the drum bosses 56 from separating from the drum positioning grooves 103, thereby restricting forward rotation of the extended part 44. This construction reliably maintains the drum cartridge 31 in its mounted position and prevents the drum cartridge 31 from impeding the developer cartridge 32 when the developer cartridge 32 is mounted.

Further, when mounting (rotating) the drum cartridge 31, the contact parts 110 of the pressing cams 107, which have been withdrawn from the mounting path of the drum cartridge 31 to leave the guiding grooves 101 open, are urged by the urging springs 108 to press the drum shaft 60 into the receiving parts 102 when the drum shaft 60 is received therein, thereby restricting movement of the drum shaft 60 in the receiving parts 102. Accordingly, the drum cartridge 31 can be smoothly mounted into the drum-accommodating section 13 without incurring great resistance from the contact parts 110. As a result, the drum cartridge 31 need not have great rigidity and, therefore, can be made smaller. Further, since the contact parts 110 press the drum shaft 60 into the receiving parts 102 once the drum cartridge 31 is mounted, this construction achieves reliable mounting of the drum cartridge 31 and reliable positioning of the photosensitive drum 42.

Further, in the drum shaft locking mechanism 104 having the construction described above, the bottom end of the side wall 45 presses against the contact shaft 112 to rotate the pressing cam 107 against the urging force of the urging spring 108. Hence, the contact part 110 of the pressing cam 107 advances into or withdraws from the guiding groove 101, that is, the moving path of the drum shaft 60 in association with the mounting and removal of the drum cartridge 31, thereby ensuring that the drum cartridge 31 can be reliably mounted and removed.

Since the drum shaft locking mechanism 104 restricts movement of the drum shaft 60 once the drum shaft 60 is received in the receiving part 102, the drum shaft locking mechanism 104 can improve the positioning accuracy for the photosensitive drum 42, thereby reducing the number of required parts.

When the holder unit 43 is accommodated in the drum-accommodating space 15 of the drum-accommodating section 13, the ridges 51 pass over the rail parts 17 to a position below the scanner casing 35, as shown in FIG. 21. At this time, the top portion of the charger 62 is disposed below the scanner casing 35, as shown in FIG. 18. In addition, the photosensitive drum 42 is in contact with the conveying belt 80 described later.

Further, when the extended part 44 is accommodated in the extended accommodating space 18 of the developer-accommodating section 14, the extended side parts 52 contact the rail parts 17 on either widthwise side of the scanner casing 35, as shown in FIG. 21. This construction prevents the extended part 44 from interfering with the scanner casing 35. Further, by forming the reinforcing ribs 55 on the extended side parts 52 to increase the strength of the extended side parts 52 the reinforcing ribs 55 can prevent deformation in the extended side parts 52 due to contact with the rail parts 17. Further, the extended rear wall 53 is disposed above the scanner casing 35, as shown in FIG. 18. Providing the drum grip 57 on the extended rear wall 53 facilitates gripping of the extended rear wall 53 and improves operability. While not shown in the drawing, the middle plate 54 is disposed opposite the front wall 34 of the scanner casing 35 with the opening 58 of the middle plate 54 positioned opposite the window 40 of the scanner casing 35.

Since the drum cartridge 31 includes the holder unit 43 and extended part 44 as the drum casing 41, the size of the drum cartridge 31 can be increased while reducing the overall size of the device, since the extended part 44 can be accommodated in the extended accommodating space 18 when the drum cartridge 31 is mounted.

Further, the holder unit 43 and extended part 44 of the drum casing 41 are integrally formed of a synthetic resin material. Further, by positioning the charger 62 and the photosensitive drum 42 and further receiving the metal roller shaft 74 of the developing roller 67 in the developer positioning groove 48, as described later, the drum casing 41 can also position the developer cartridge 32 based on the metal roller shaft 74. Since the drum casing 41 can position all of the charger 62, photosensitive drum 42, and developer cartridge 32, it is possible to improve the precision for positioning these components relative to each other through a simple construction. Further, by positioning the developer cartridge 32 based on the metal roller shaft 74 of the developing roller 67, this construction can improve the precision for positioning the developing roller 67 relative to the photosensitive drum 42. Further, by providing the charger 62 in the holder unit 43, the overall size of the device can be reduced while maintaining the charger 62 in an appropriate position.

Figure 25:
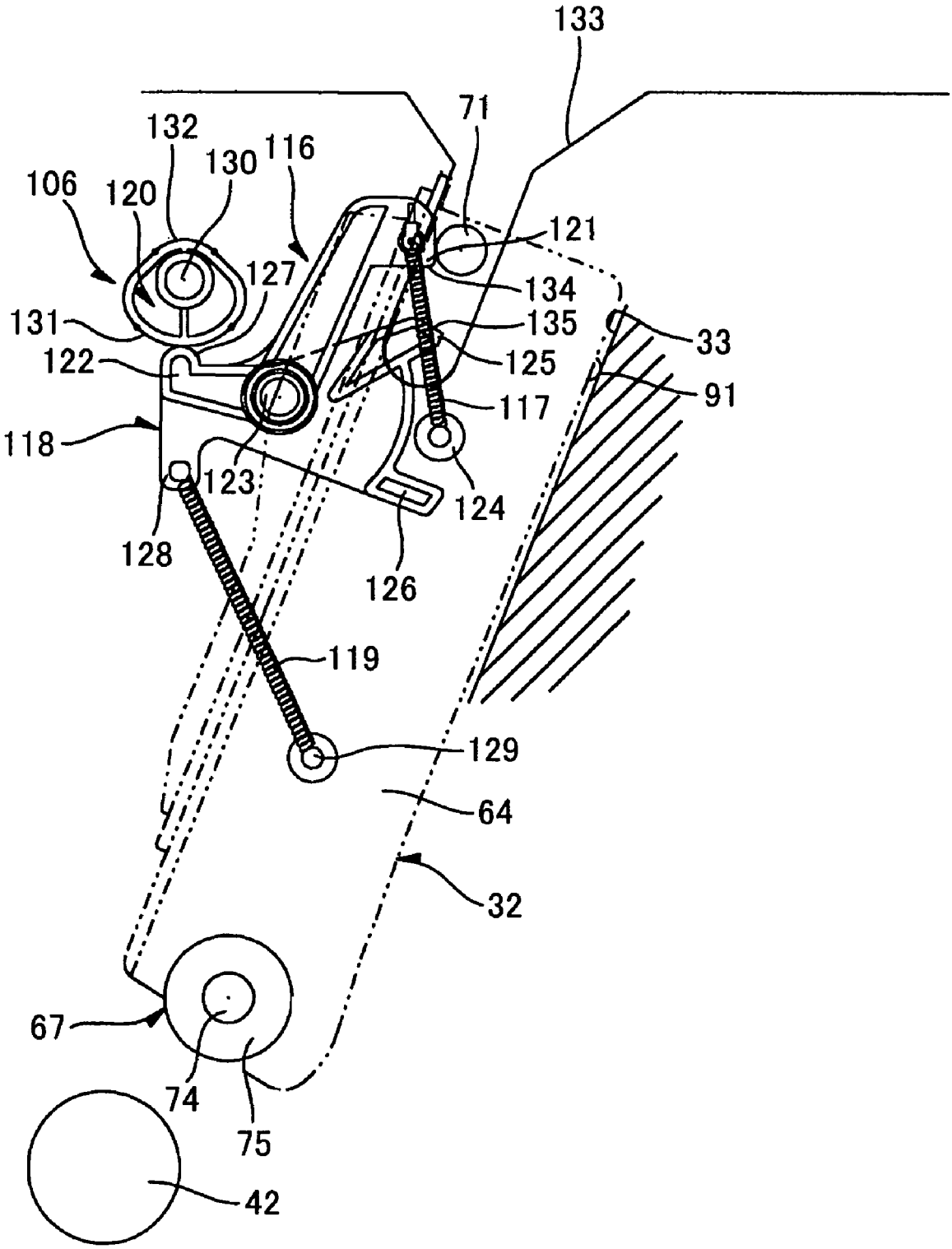
FIG. 25 is a side view showing the mounted state of the developer cartridge in the process accommodating section (when the developer boss part contacts the boss contact part)

Next, the operation for mounting the developer cartridge 32 on the drum cartridge 31 after the drum cartridge 31 has been mounted in the main casing 2 will be described. As shown in FIG. 24, the developer boss parts 71 of the developer cartridge 32 are positioned opposite the boss insertion grooves 133. The developer cartridge 32 is pushed downward, as shown in FIG. 25, so that the developer boss parts 71 are inserted into the boss insertion grooves 133. The developer boss parts 71 contact the boss contact parts 121 of the first pressing members 116 that protrude slightly into the moving path of the developer boss parts 71. The developer boss parts 71 slide over the boss contact parts 121 and contact the boss contact pawl parts 125 that await in the moving paths of the developer boss parts 71, as shown in FIG. 26, FIG. 28 and FIG. 29. The developer boss parts 71 press the boss contact pawl parts 125 downward in the mounting direction. However, the cam contact parts 127 contact the contact surfaces 131 of the cams 120, restricting further rotation of the second pressing member 118. Hence, the developer boss parts 71 are restricted from moving further in the mounting direction and are halted at the contact position with the boss contact pawl parts 125. As a result, as shown in FIG. 26, FIG. 28 and FIG. 29, the developer cartridge 32 is held in a separated state from the drum cartridge 31 in which a slight gap is maintained between the photosensitive drum 42 and the developing roller 67. In this way, the developer cartridge 32 is accommodated in the developer-accommodating space 16 of the developer-accommodating section 14 and is mounted on the drum cartridge 31, which has previously been mounted in the main casing 2.

When the color laser printer 1 of the preferred embodiment is performing a non-image-forming operation, the developer cartridge 32 is maintained in a separated state from the drum cartridge 31, whereby the developing roller 67 is separate from the photosensitive drum 42. During an image-forming operation, the developer cartridge 32 is in a contact state in which the developing roller 67 contacts the photosensitive drum 42.

Specifically, in a separated state, the contact surface 131 of the cam 120 is in contact with the cam contact part 122 of the first pressing member 116 and the cam contacting protrusion 127 of the second pressing member 118. To shift from the separated state to the contact state, the cam 120 is rotated until the separating surface 132 of the cam 120 opposes the cam contact part 122 of the first pressing member 116 and the cam contacting protrusion 127 of the second pressing member 118.

To rotate the cam 120, as shown in FIGS. 32(*a*) and 32(*b*), the motor 138 inputs a driving force into the camshafts 130 via the pinion gear 139 and the gear train configured of the cam drive gears 136 and intermediate gears 137 in order to rotate the camshafts 130. Through this operation, the pairs of cams 120 are rotated simultaneously until the separating surfaces 132 of the cams 120 are positioned opposite the cam contact parts 122 of the first pressing members 116 and the cam contacting protrusions 127 of the second pressing members 118.

Figure 27:
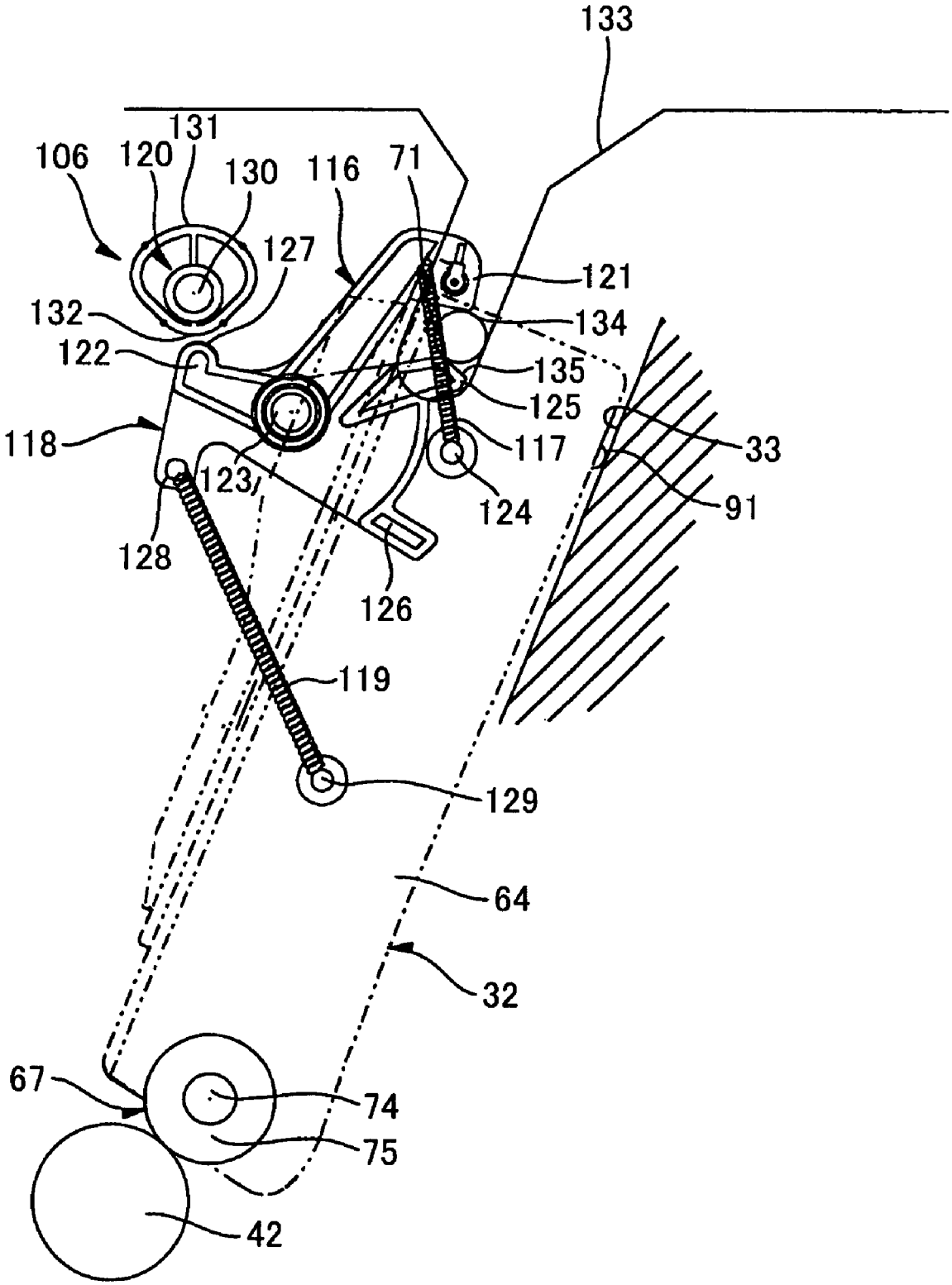
FIG. 27 is a side view showing the mounted state of the developer cartridge in the process accommodating section (contact state)
Figure 30:
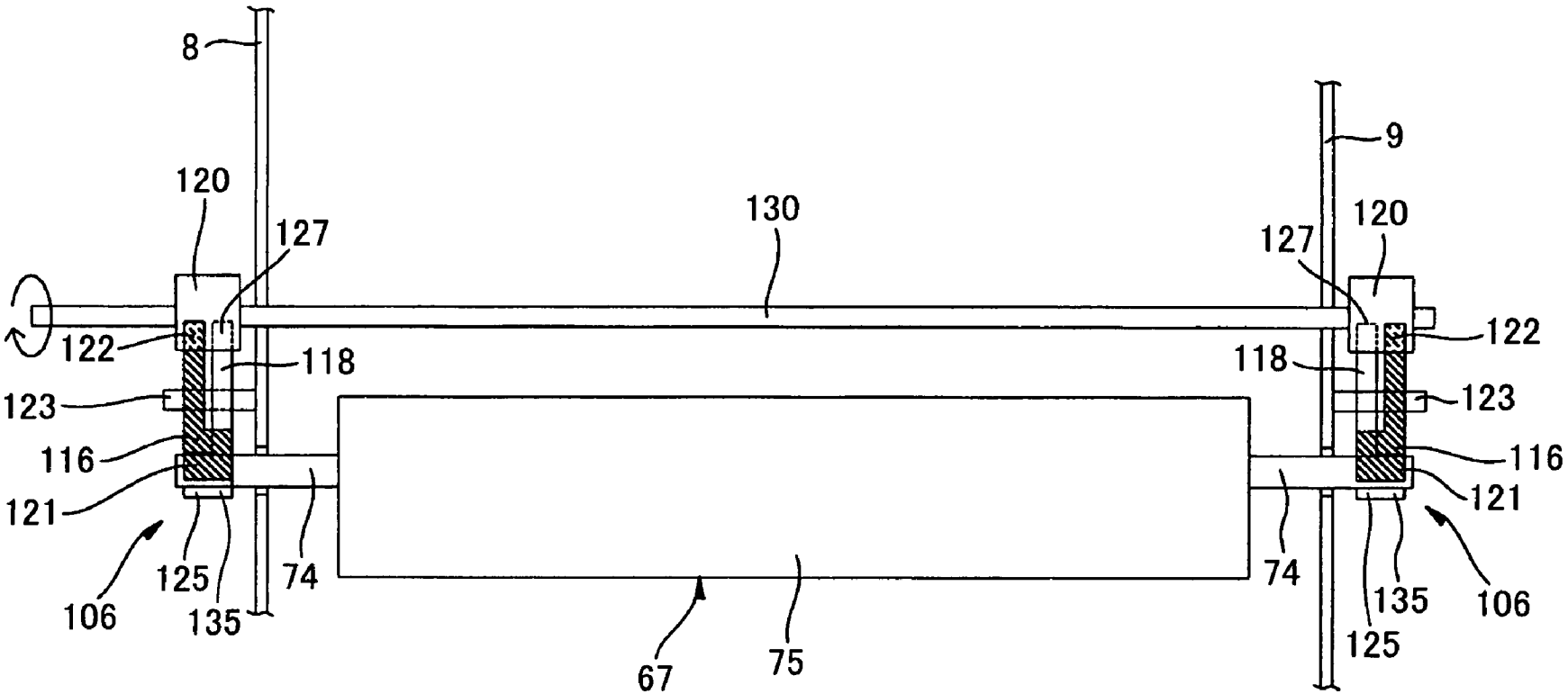
FIG. 30 is a plan view showing the mounted state of the developer cartridge in the process accommodating section (contact state)
Figure 31:
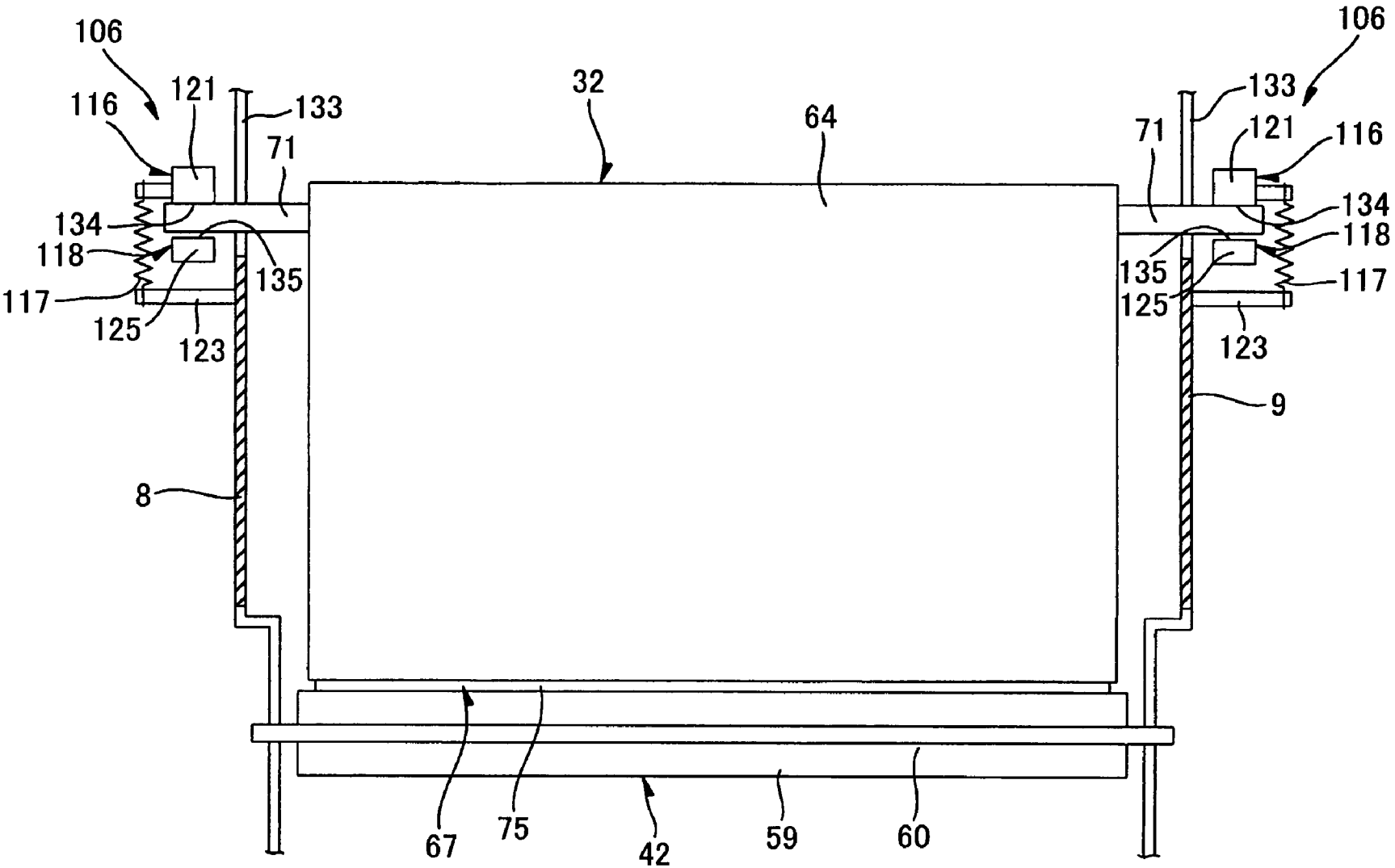
FIG. 31 is a front view showing the mounted state of the developer cartridge in the process accommodating section (contact state)

Rotating the separating surfaces 132 of the cams 120 opposite the cam contact parts 122 and cam contacting protrusions 127 releases the pressing force of the contact surfaces 131, as shown in FIG. 27, FIG. 30 and FIG. 31. As a result, the first urging springs 117 contract due to their own restoring force, thereby urging the first pressing members 116 to rotate about the support shafts 123 so that the boss contact parts 121 advance into the moving path of the developer boss parts 71.

In addition, the second urging springs 119 expand due to their own restoring force and urge the second pressing members 118 to rotate about the support shafts 123 so that the boss contact pawl parts 125 move downstream in the mounting direction of the developer boss parts 71 from their original positions in the separated state.

When the first pressing members 116 rotate, the upper pressing surfaces 134 of the boss contact parts 121 contact the developer boss parts 71 and press the developer boss parts 71 in the mounting direction of the developer boss parts 71 and toward the front edge of the boss insertion grooves 133. As the second pressing members 118 rotate, the boss contact pawl parts 125 move downstream in the mounting direction of the developer boss parts 71. The lower side pressing surfaces 135 of the boss contact pawl parts 125 are contacted by the developer boss parts 71, which are pressed by the upper pressing surfaces 134, and the second urging springs 119 elastically receive the developer boss parts 71.

Since the spring constant of the second urging spring 119 is set smaller than that of the first urging spring 117, the pressing force of the upper pressing surface 134 moves the developer boss part 71 downstream in the mounting direction from the original position of the developer boss part 71 in the separated state, and the lower side pressing surface 135 receives the developer boss part 71 as shown in FIGS. 30 and 31. When the developer boss part 71 is moved downstream in the mounting direction, the developing roller 67 contacts the photosensitive drum 42, thereby placing the photosensitive drum 42 and developing roller 67 in a contact state.

In the contact state, the developer boss part 71 contacts the front edge of the boss insertion groove 133 through the pressing force of the upper pressing surface 134. In addition, the first urging spring 117 and second urging spring 119 are urging the first pressing member 116 and second pressing member 118, respectively, so that a gap is formed between the separating surface 132 of the cam 120 and the cam contact part 122 of the first pressing member 116 and cam contacting protrusion 127 of the second pressing member 118.

Next, the process of shifting from the contact state back to the separated state will be described. In the contact state, the separating surface 132 of the cam 120 opposes the cam contact part 122 of the first pressing member 116 and the cam contacting protrusion 127 of the second pressing member 118 with a gap formed therebetween. As in the previous operation described above, the cam 120 is rotated until the contact surface 131 of the cam 120 is brought into contact with the cam contact part 122 of the first pressing member 116 and the cam contacting protrusion 127 of the second pressing member 118.

When the contact surface 131 is rotated opposite the cam contact part 122 and the cam contacting protrusion 127, as shown in FIG. 26, the contact surface 131 of the cam 120 contacts the cam contact part 122 of the first pressing member 116 and the cam contacting protrusion 127 of the second pressing member 118 and pushes the first pressing member 116 and the second pressing member 118 downward. As a result, the first pressing member 116 is rotated about the support shaft 123 against the urging force of the first urging spring 117, stretching the first urging spring 117 and retracting the boss contact part 121 from the moving path of the developer boss part 71. Further, the second pressing member 118 is rotated about the support shaft 123 by a pressing force larger than the urging force of the second urging spring 119, compressing the second urging spring 119 and moving the boss contact pawl part 125 upstream with respect to the mounting direction of the developer boss part 71.

Through the rotation of the first pressing member 116, the upper pressing surface 134 of the boss contact part 121 separates from the developer boss part 71, and the boss contact part 121 is withdrawn to a position only slightly protruding into the moving path of the developer boss part 71. Through the rotation of the second pressing member 118, the boss contact pawl part 125 moves upstream with respect to the mounting direction of the developer boss part 71 so that the lower side pressing surface 135 of the boss contact pawl part 125 presses the developer boss part 71 in the removing direction, thereby separating the developing roller 67 from the photosensitive drum 42 so that the photosensitive drum 42 and developing roller 67 are in the separated state. Since the boss contact part 121 is retracted from the moving path of the developer boss part 71 and protrudes only slightly into the path in this separated state, the developer cartridge 32 can be removed from the developer-accommodating section 14.

In the contacting/separating mechanism 106 of the color laser printer 1 described above, the boss contact part 121 is retracted from the moving path of the developer boss part 71 in the separated state. Accordingly, the developer boss part 71 can be moved along the moving path without interference from the boss contact part 121, allowing the developer cartridge 32 to be mounted or removed.

Since the boss contact part 121 of the first pressing member 116 has advanced into the moving path of the developer boss part 71 in the contact state, the boss contact part 121 can reliably press the developer boss part 71 in the mounting direction. As a result, despite providing the boss contact part 121, the moving path of the developer boss part 71 can be formed as a substantially straight and efficient boss insertion groove 133. Further, the boss contact part 121 can reliably press the developer boss part 71 in the mounting direction.

By forming the boss insertion groove 133 to be substantially straight, it is possible to make the overall device compact. In addition, operability in mounting or removing the developer cartridge 32 can be improved.

In the separated state, the boss contact part 121 is moved in a retracting direction, but still protrudes slightly into the moving path of the developer boss part 71 within a range that allows the mounting and removal of the developer cartridge 32. Hence, when mounting or removing the developer cartridge 32, the boss contact part 121 elastically contacts the developer boss part 71 to a degree that does not impede the movement of the developer boss part 71. This contact can provide a clicking sensation to the operator when the developer cartridge 32 is mounted and removed to ensure that the operator does not leave the developer cartridge 32 in a position midway along the mounting or removal path.

In the contact state where the boss contact part 121 is advanced in the moving path of the developer boss part 71, if the operator grips the developer grip 72 and pulls the developer cartridge 32 from the developer-accommodating section 14 with a force greater than or equal to a prescribed pulling force, this force will push the boss contact part 121 in the retracting direction against the urging force of the first urging spring 117. Hence, if a power outage or some other unforeseen event occurs, the developer cartridge 32 can be forcibly removed without damaging the first pressing member 116.

During the contact state, the upper pressing surface 134 of the boss contact part 121 presses the developer boss part 71 in the mounting direction of the developer boss part 71 and toward the front edge of the boss insertion groove 133. Accordingly, the developer boss part 71 is in contact with the front edge of the boss insertion groove 133, thereby ensuring that the developer cartridge 32 is accurately positioned in the contact state.

In the separated state, the lower side pressing surface 135 of the boss contact pawl part 125 reliably presses the developer boss part 71 in the removal direction. Hence, during a non-image-forming operation, the developer cartridge 32 can be withdrawn upstream in the mounting direction.

Further, the boss contact pawl part 125 of the second pressing member 118 contacts the developer boss part 71 midway during the mounting of the developer cartridge 32. Therefore, if the developer cartridge 32 is mounted vigorously, the contact with the boss contact pawl part 125 can moderate the force with which the developer cartridge 32 is mounted. Accordingly, this construction can prevent damage to the developer cartridge 32 and the drum cartridge 31.

Further, the boss contact pawl part 125 is disposed in the moving path of the developer boss part 71 downstream of the boss contact part 121 with respect to the mounting direction of the developer boss part 71. Hence, in the contact state, the developer boss part 71 between the boss contact part 121 and boss contact pawl part 125 is simultaneously pressed in the mounting direction by the boss contact part 121 and pressed in the removal direction by the boss contact pawl part 125. Accordingly, it is possible to adjust the pressing force on the developer boss part 71 in the mounting direction of the developer cartridge 32, thereby ensuring that the developer cartridge 32 is mounted appropriately.

More specifically, in the contacting/separating mechanism 106, the separating surface 132 of the cam 120 does not contact the cam contact part 122 and cam contacting protrusion 127 in the contact state. Therefore, the entire urging force of the first urging spring 117 can be applied to the cam contact part 122, and the pressing force applied to the developer boss part 71 in the mounting direction can be adjusted based on the preset spring constant for the first urging spring 117. Further, all of the urging force of the second urging spring 119 can be applied to the boss contact pawl part 125, and the pressing force on the developer boss part 71 in the removal direction can be adjusted based on the preset spring constant for the second urging spring 119. Therefore, the boss contact part 121 reliably presses the developer cartridge 32 in the mounting direction with the preset pressing force generated by the first urging spring 117, while the boss contact pawl part 125 reliably presses the developer cartridge 32 in the removal direction with the preset pressing force generated by the second urging spring 119.

As a result, since the spring constant of the second urging spring 119 is set smaller than that of the first urging spring 117, the developer boss part 71 can be held between the boss contact part 121 and the boss contact pawl part 125 in the contact state with a stable, light pressing force applied on the developer cartridge 32 in the mounting direction, thereby ensuring that the developer cartridge 32 is in an appropriate mounted state.

More specifically, the separating surface 132 of the cam 120 faces but does not contact the cam contact part 122 and cam contacting protrusion 127 during an image-forming operation. At this time, the urging force of the first urging spring 117 advances the boss contact part 121 into the mounting and removal path so that the boss contact part 121 presses the developer boss part 71, while the boss contact pawl part 125, which is pressing the developer boss part 71 in the removal direction through the urging force of the second urging spring 119, elastically receives the developer boss part 71 being pressed by the boss contact part 121. With this construction, the urging forces of the first urging spring 117 and second urging spring 119 place the developing roller 67 and photosensitive drum 42 in contact with each other with a stable pressing force.

During a non-image-forming operation, the contact surface 131 of the cam 120 opposes the cam contact part 122 and cam contacting protrusion 127 and presses the first pressing member 116 and second pressing member 118 downward. At this time, the boss contact part 121 is retracted from the mounting and removal path against the urging force of the first urging spring 117 and therefore separated from the developer boss part 71, while the boss contact pawl part 125 presses the developer boss part 71 in the removal direction by a pressing force larger than the urging force of the second urging spring 119, thereby facilitating removal of the developer cartridge 32.

Hence, the separating surface 132 and contact surface 131 can be selectively positioned opposite the cam contact part 122 and cam contacting protrusion 127 through the rotation of the cam 120. By doing so, it is possible to appropriately advance and retract the boss contact part 121 and boss contact pawl part 125 on the moving path of the developer boss part 71 to stabilize and adjust the pressing force on the developer boss part 71 in the mounting direction and facilitate removal of the developer cartridge 32.

In this way, the developing roller 67 and photosensitive drum 42 can be placed in contact during an image-forming operation and can be separated during a non-image-forming operation. Since the developing roller 67 and photosensitive drum 42 are placed in contact only when necessary, it is possible to extend the lives of these components.

In the contacting/separating mechanism 106, both the first pressing member 116 and the second pressing member 118 are rotatably supported on the support shaft 123, thereby simplifying the construction and reducing the number of required parts.

Further, the support shaft 123 is disposed downstream in the mounting direction of the developer boss part 71 from the position at which the boss contact part 121 presses the developer boss part 71 in the mounting direction. This construction reduces the amount that the first pressing member 116 rotates, enabling the overall device to be made compact.

Further, the boss contact part 121 of the first pressing member 116 is formed to protrude inward in the widthwise direction, while the boss contact pawl part 125 of the second pressing member 118 is formed to protrude outward in the widthwise direction so that the upper pressing surface 134 of the boss contact part 121 and the lower side pressing surface 135 of the boss contact pawl part 125 overlap along the moving path of the developer boss part 71. With this construction, the positions at which the upper pressing surface 134 and lower side pressing surface 135 press against the developer boss part 71 overlap in the moving direction of the developer boss part 71, thereby ensuring that the pressure applied to the developer boss part 71 by the boss contact part 121 and boss contact pawl part 125 is stable.

When the motor 138 inputs a driving force to the gear train configured of the cam drive gears 136 and the intermediate gears 137, the pairs of cams 120 rotate simultaneously in the contacting/separating mechanism 106. Therefore, the plurality of pairs of cams 120 corresponding to the plurality of pairs of first pressing members 116 and the plurality of pairs of second pressing members 118 can be reliably rotated through a simple construction. As a result, the plurality of developer cartridges 32 can be reliably mounted and removed through the appropriate operations of the first pressing members 116 and second pressing members 118.

Further, the runners 70 protrude further forward and downward than the jaw part 69 as shown in FIG. 8 as described above. Accordingly, when the developer cartridge 32 is mounted in the developer accommodating section 14, the runners 70 protrude further downstream than the jaw part 69 in the mounting direction of the developer cartridge 32 and nearer to the rear surface 33 of the partitioning plate 10 than the jaw part 69. Accordingly, the runners 70 of the developer casing 64 contact the rear surface 33 of the partitioning plate 10, and slide along the rear surface 33 as the developer cartridge 32 is mounted. This prevents the jaw part 69 from contacting the rear surface 33 of the partitioning plate 10. This construction can prevent damage to the jaw part 69 and can reliably prevent toner from leaking from the peripheral surface of the developing roller 67.

When the developer cartridge 32 is mounted on the drum cartridge 31 in the developer-accommodating section 14 so that the developer cartridge 32 can be selectively switched between the separated state and the contact state, the metal roller shaft 74 of the developing roller 67 is fitted into the developer positioning groove 48 of the drum casing 41 in order to position the developer cartridge 32 with respect to the drum cartridge 31. Further, the developer cartridge 32 is positioned with respect to the developer-accommodating section 14 through contact by the contact protrusions 91 on the bottom surface of the developer casing 64 with the rear surface 33 of the partitioning plate 10 as shown in FIGS. 24, 25, 26, and 27. Specifically, in the color laser printer 1 according to the preferred embodiment, the drum casing 41 of the drum cartridge 31 is positioned on the rear side by inserting the drum bosses 56 into the deepest parts of the drum positioning grooves 103 and preventing the drum bosses 56 from separating from the drum positioning grooves 103 with the restricting springs 105, while the developer casing 64 of the developer cartridge 32 is positioned on the front side by placing the contact protrusions 91 on the bottom surface of the developer casing 64 in contact with the rear surface 33 of the partitioning plate 10. In this way, positioning of the drum cartridge 31 and the developer cartridge 32 is performed on opposite sides from each other in the front-to-rear direction, making it less likely for error to occur than when one of the drum cartridge 31 and developer cartridge 32 is used to position the other. Accordingly, this construction achieves more precise positioning of the drum cartridge 31 and developer cartridge 32.

In the color laser printer 1 of the preferred embodiment, since the drum cartridge 31 provided with the photosensitive drum 42 and the developer cartridge 32 provided with the toner-accommodating chamber 65 can each be mounted and removed from the color laser printer 1, the drum cartridge 31 and developer cartridge 32 can be replaced individually based on the life of the photosensitive drum 42 and the toner-accommodating chamber 65, respectively.

When the drum cartridge 31 is mounted in the drum-accommodating section 13, the photosensitive drum 42 is grounded through connection with contact points (not shown). During an image-forming operation, a charge bias is applied to the charger 62. Further, during an image-forming operation, the motor 138 inputs a driving force that rotates the photosensitive drum 42 through the engagement of gears (not shown).

When the developer cartridge 32 is mounted in the developer-accommodating section 14, a connection is made with contact points (not shown), enabling a developing bias to be applied to the metal roller shaft 74 of the developing roller 67 during an image-forming operation. The motor 138 also inputs a driving force to rotate the agitator 73, supply roller 66, and developing roller 67 during an image-forming operation through couplings (not shown).

During an image-forming operation, toner for each color accommodated in the toner-accommodating chamber 65 of the respective process sections 27 shown in FIG. 1 is stirred by the agitator 73 and supplied to the supply roller 66. While rotating, the supply roller 66 supplies this toner to the developing roller 67, at which time the toner is positively tribocharged between the supply roller 66 and developing roller 67 to which a developing bias has been applied.

As the developing roller 67 rotates, the toner supplied to the surface of the developing roller 67 passes between the developing roller 67 and the thickness-regulating blade 68 so that the thickness-regulating blade 68 can regulate the toner carried on the surface of the developing roller 67 at a fixed thin layer.

In the meantime, a charge bias is applied to the charger 62 in the drum cartridge 31, causing the charger 62 to generate a corona discharge to apply a uniform positive charge to the surface of the photosensitive drum 42. As the photosensitive drum 42 rotates, the surface of the photosensitive drum 42 is exposed to the high-speed scan of a laser beam emitted from the scanning unit 30. The scanning unit 30 forms an electrostatic latent image on the surface of the photosensitive drum 42 corresponding to an image to be formed on the paper 3.

As the photosensitive drum 42 rotates further, the electrostatic latent image formed on the surface of the photosensitive drum 42 comes into contact with the positively charged toner carried on the surface of the developing roller 67. The toner on the surface of the rotating developing roller 67 is supplied to the latent image on the surface of the photosensitive drum 42, that is, is supplied to the exposed parts of the surface of the photosensitive drum 42 that have been exposed by the laser beam and, therefore, have a lower potential than other parts of the surface carrying a positive charge. In this way, the electrostatic latent image is developed into a visible toner image through a reverse developing process, and the toner image is carried on the surface of the photosensitive drum 42 for each color.

As shown in FIG. 1, the transfer section 28 is disposed in the main casing 2 above the feeder unit 4 and extends in the front-to-rear direction beneath the process-accommodating sections 12. The transfer section 28 includes a drive roller 78, a follow roller 79, the conveying belt 80, and transfer rollers 81. The drive roller 78 is disposed farther forward than the process-accommodating section 12 that accommodates the yellow process section 27Y. The follow roller 79 is disposed farther rearward than the process-accommodating section 12 that accommodates the black process section 27K.

The conveying belt 80 is an endless belt formed of a synthetic resin such as an electrically-conductive polycarbonate or polyimide containing dispersed conductive particles such as carbon. The conveying belt 80 is looped around the drive roller 78 and the follow roller 79. When the drive roller 78 is driven, the follow roller 79 follows the rotation of the drive roller 78, while the conveying belt 80 travels in a circuit between the drive roller 78 and follow roller 79. The outer surface of the conveying belt 80 opposes and contacts the photosensitive drum 42 in each process section 27 at an image-forming position and moves in the same direction as the surface of the photosensitive drum 42 at the point of contact.

The transfer rollers 81 are disposed inside the conveying belt 80 at positions opposing each photosensitive drum 42 with the conveying belt 80 interposed therebetween. The transfer rollers 81 are configured of a metal roller shaft covered with a roller part that is formed of an elastic material such as a conductive rubber material. The transfer rollers 81 are rotatably provided so that the surfaces of the transfer rollers 81 move in the same direction as the conveying belt 80 at the image-forming positions. A transfer bias is applied to the transfer rollers 81 during a transfer operation.

As described above, the conveying belt 80 moves in a circuit around the drive roller 78 and follow roller 79 when the drive roller 78 is driven and the follow roller 79 follows. When a sheet of paper 3 is supplied from the feeder unit 4, the conveying belt 80 conveys the paper 3 past each image-forming position between the conveying belt 80 and the photosensitive drum 42 of the process sections 27 in sequence in the rearward direction. As the conveying belt 80 conveys the paper 3, toner images in each color conveyed on the photosensitive drums 42 of each process section 27 are transferred sequentially onto the paper 3, thereby forming a color image on the paper 3.

Specifically, first a yellow toner image carried on the surface of the photosensitive drum 42 in the yellow process section 27Y is transferred onto the paper 3. Next, a magenta toner image carried on the surface of the photosensitive drum 42 in the magenta process section 27M is transferred onto the paper 3 and superimposed over the yellow toner image. This operation is repeated for transferring and superimposing the cyan toner image carried on the surface of the photosensitive drum 42 in the cyan process section 27C and the black toner image carried on the surface of the photosensitive drum 42 in the black process section 27K, producing a multicolor image on the paper 3.

To form multicolor images in this way, the color laser printer 1 is configured as a tandem type device in which the drum cartridge 31 and developer cartridge 32 are provided as a set in each process sections 27, and a set is provided for each color. Accordingly, the color laser printer 1 of the preferred embodiment forms toner images in each color at about the same speed as required for forming monochrome images, thereby achieving rapid color image formation. Hence, the color laser printer 1 of the preferred embodiment can form color images while maintaining a compact shape.

The fixing section 29 is disposed in the main casing 2 at a position rearward of the process-accommodating section 12 accommodating the black process section 27K and is aligned in the front-to-rear direction with the image-forming positions at points of contact between the photosensitive drums 42 and the conveying belt 80. The fixing section 29 includes a heating roller 82 and a pressure roller 83.

The heating roller 82 is configured of a metal tube, the surface of which is coated with a release layer. The metal tube accommodates a halogen lamp that extends along the axis of the heating roller 82. The halogen lamp heats the surface of the heating roller 82 to a fixing temperature. The pressure roller 83 is disposed in confrontation with the heating roller 82 for applying pressure thereto.

After the toner images have been transferred onto the paper 3, the paper 3 is conveyed to the fixing section 29. The fixing section 29 fixes the color image onto the paper 3 with heat as the paper 3 passes between the heating roller 82 and the pressure roller 83.

The discharge unit 6 includes a U-shaped discharge path 84, discharge rollers 85, and a discharge tray 86.

The discharge path 84 has a curved U shape and functions as a path for conveying the paper 3. The upstream end of the discharge path 84 is the lower section of the discharge path 84 and is positioned adjacent to the fixing section 29 for feeding the paper 3 in a rearward direction, while the downstream end of the discharge path 84 is the upper section and is positioned adjacent to the discharge tray 86 for discharging the paper 3 forward.

The discharge rollers 85 are a pair of rollers disposed near the downstream end of the discharge path 84. The discharge tray 86 is a surface formed on the top of the main casing 2 that slopes downward from the front to the rear side.

After a multicolor image is fixed on the paper 3 in the fixing section 29, the paper 3 is conveyed into the upstream end of the discharge path 84 in the rearward direction. The U-shaped discharge path 84 reverses the conveying direction of the paper 3, and the discharge rollers 85 discharges the paper 3 forward onto the discharge tray 86.

In the color laser printer 1 described above, the forward direction in which the pickup roller 22 picks up the paper 3 is opposite the rearward direction in which the paper 3 is conveyed past the image-forming positions. Further, the rearward direction in which the paper 3 is conveyed past the image-forming positions is opposite the forward direction in which the discharge rollers 85 discharge the paper 3. This construction enables the device to be made compact while providing conveying paths for the paper 3.

In the color laser printer 1 of the preferred embodiment described above, the drum cartridge 31 and developer cartridge 32 are mounted in the drum-accommodating section 13 and developer-accommodating section 14 of each process-accommodating section 12 at a slant to the front-to-rear direction and the vertical direction (thickness direction of the paper 3). More specifically, the drum cartridge 31 and the developer cartridge 32 are mounted in a direction that slopes rearward from top to bottom. This construction can improve the operability of mounting and removing the drum cartridge 31 and developer cartridge 32.

In the color laser printer 1 of the preferred embodiment described above, the plurality of sets of the drum cartridge 31 and developer cartridge 32 are disposed alternately with the plurality of scanning units 30 in the front-to-rear direction, thereby achieving an efficient arrangement that can produce a more compact device.

In the color laser printer 1 of the preferred embodiment described above, the extended part 44 of the drum casing 41 on the drum cartridge 31 is interposed between the scanning unit 30 and the developer cartridge 32 in each process-accommodating section 12. However, the opening 58 is formed in the middle plate 54 of the extended part 44 to allow passage of a laser beam that the scanning unit 30 irradiates toward the photosensitive drum 42. Hence, an efficient arrangement can be ensured by interposing the extended part 44 between the scanning unit 30 and developer cartridge 32, while the opening 58 formed in the extended part 44 can ensure reliable passage of the laser beam emitted from the scanning unit 30 toward the photosensitive drum 42.

As described above, according to the present embodiment, the drum cartridge 31 is formed thicker than the developer cartridge 32 in a thickness direction that is orthogonal to the mounting direction of the first and second cartridges. That is, the thickness T31 of the drum cartridge 31 is defined in the upper-and-lower direction of the drum cartridge 31 (FIG. 2 and FIG. 18). Because the holder unit 43 is formed thicker than the extended part 44 in the upper-and-lower direction (thickness direction), the thickness T31 of the drum cartridge 31 is determined based on the thickness of the holder unit 43. The thickness T32 of the developer cartridge 32 is defined in the upper-and-lower direction of the developer cartridge 32 (FIG. 8 and FIG. 18). The thickness T31 of the drum cartridge 31 is greater than the thickness T32 of the developer cartridge 32. The drum cartridge 31 is mounted in the process accommodating section 12, with such an orientation that the front-to-rear direction of the drum cartridge 31 (FIG. 2) is along the mounting direction and the front side of the drum cartridge 31 (FIG. 2) is on the downstream side relative to the rear side of the drum cartridge 31 (FIG. 2) in the mounting direction.

Similarly, the developer cartridge 32 is mounted in the process accommodating section 12, with such an orientation that the front-to-rear direction of the developer cartridge 32 (FIG. 8) is along the mounting direction and the front side of the developer cartridge 32 (FIG. 8) is on the downstream side relative to the rear side of the developer cartridge 32 (FIG. 8) in the mounting direction. In the process accommodating section 12, the drum accommodating section 13 (having a thickness T13 and the developer accommodating section 14 (having a thickness T14) are disposed in the mounting direction of the drum cartridge 31 and the developer cartridge 32 and that are partly displaced with respect to each other in the thickness direction orthogonal to the mounting direction. The developer accommodating section 14 is disposed upstream of the drum accommodating section 13 with respect to the mounting direction of the drum cartridge 31 and the developer cartridge 32, and is formed thicker than the drum cartridge 31 in the thickness direction and thinner than the thickness T33 of both the drum cartridge 31 and the developer cartridge 32 together when the drum cartridge 31 and the developer cartridge 32 are accommodated together in the process accommodating section 12. The thickness T13 of the drum accommodating section 13 is formed thicker than the thickness T33 of the drum cartridge 31 and the developer cartridge 32 together in the thickness direction when the drum cartridge 31 and the developer cartridge 32 are accommodated together in the process accommodating section 12.

With this construction, the drum cartridge 31 and the developer cartridge 32 can be mounted in the process accommodating section 12, even though the thickness T14 of the developer accommodating section 14 is thinner than the thickness T33 of both the drum cartridge 31 and the developer cartridge 32 together when these cartridges 31 and 32 are accommodated in the process accommodating section 12, by first inserting only the drum cartridge 31 through the developer accommodating section 14, which is wider than the thickness T31 of the drum cartridge 31, and mounting the drum cartridge 31 in the drum accommodating section 13, which is wider than the thickness T33 of both the drum cartridge 31 and the developer cartridge 32 when these cartridges 31 and 32 are accommodated in the process accommodating section 12, and subsequently mounting the developer cartridge 32, which is thinner than the drum cartridge 31, in the developer accommodating section 14. Therefore, this configuration can reduce the space required for the mounting paths of the drum cartridge 31 and the developer cartridge 32, enabling the device to be made compact.

In other words, the thickness T13 of the drum accommodating section 13 is formed wider than the thickness T14 of the developer accommodating section 14 in the direction orthogonal to the mounting direction of the drum cartridge 31 and the developer cartridge 32. The drum accommodating section 13 has the expanded region 19, by which the drum accommodating section 13 is wider than the developer accommodating section 14. The drum cartridge 31 has the protruding part 43 that is disposed in the expanded region 19 when the drum cartridge 31 is mounted in the drum accommodating section 13. The process accommodating section 12 has such a shape that restricts movement of the drum cartridge 31 in the mounting direction when the protruding part 43 is positioned in the expanded region 19, but allows movement of the drum cartridge 31 in the mounting direction when the protruding part 43 is moved from the expanded region 19 in the thickness direction by a distance equivalent to the thickness of the developer cartridge 32.

With this construction, movement of the drum cartridge 31 in the process accommodating section 12 is restricted in the mounting direction when the protruding part 43 is disposed in the expanded region 19, but allowed when the protruding part 43 is moved from the expanded region 19 in the thickness direction by a distance equivalent to the thickness T32 of the developer cartridge 32. Therefore, the drum cartridge 31 can be mounted in the drum accommodating section 13 by first inserting the drum cartridge 31 through the developer accommodating section 14 and positioning the protruding part 43 in the expanded region 19. Subsequently, the developer cartridge 32 can be mounted in the developer accommodating section 14. This configuration can reduce the space required for the mounting paths of the drum cartridge 31 and the developer cartridge 32, enabling the overall device to be made compact.

According to the present embodiment, the drum accommodating section 13 defines the drum accommodating region 15 in which the drum cartridge 31 is accommodated. The developer accommodating section 14 defines the developer accommodating region 16 that allows passage of the drum cartridge 31 when the drum cartridge 31 is mounted in or removed from the drum accommodating section 13 and that accommodates the developer cartridge 32 therein. The distended part 35 distends toward the developer accommodating region 16 to restrict passage of the drum cartridge 31 in the developer accommodating section 16 when the developer cartridge 32 accompanies the drum cartridge 31 and to allow passage of the drum cartridge 31 through the developer accommodating region 16 of the developer accommodating section 14 when the developer cartridge 32 does not accompany the drum cartridge 31.

By forming the distended part 35 toward the developer accommodating region 16 in this way, both the drum cartridge 31 and the developer cartridge 32 can be mounted in the process accommodating section 12 without simply allocating additional space for the mounting paths of the drum cartridge 31 and the developer cartridge 32. This is accomplished by first passing only the drum cartridge 31 through the developer accommodating region 16 of the developer accommodating section 14, without receiving interference from the distended part 35, and mounting the drum cartridge 31 in the drum accommodating section 13 so that the drum cartridge 31 is accommodated in the drum accommodating region 13, and subsequently mounting the developer cartridge 32 in the developer accommodating section 14 so as to be accommodated in the developer accommodating region 16. Specifically, this construction enables the drum cartridge 31 not accompanied by the developer cartridge 32 to pass through the developer accommodating section 14, while avoiding the distended part 35 by using the developer accommodating region 16 in which the developer cartridge 32 is to be accommodated. Therefore, it is possible to reduce the space required for the mounting paths of the drum cartridge 31 and the developer cartridge 32, enabling the overall device to be made compact.

In the drum shaft locking mechanism 104 described above in FIGS. 22 and 23, the contact shaft 112 is provided on the pressing cams 107. By placing the contact shaft 112 in contact with the bottom end of the side walls 45, the pressing cams 107 can be rotated against the urging force of the urging springs 108. However, as shown in FIG. 33(*a*), the contact shaft 112 may be replaced by a fitting member 113 that can engage with and disengage from the metal roller shaft 74 of the developing roller 67.

Figure 33A:
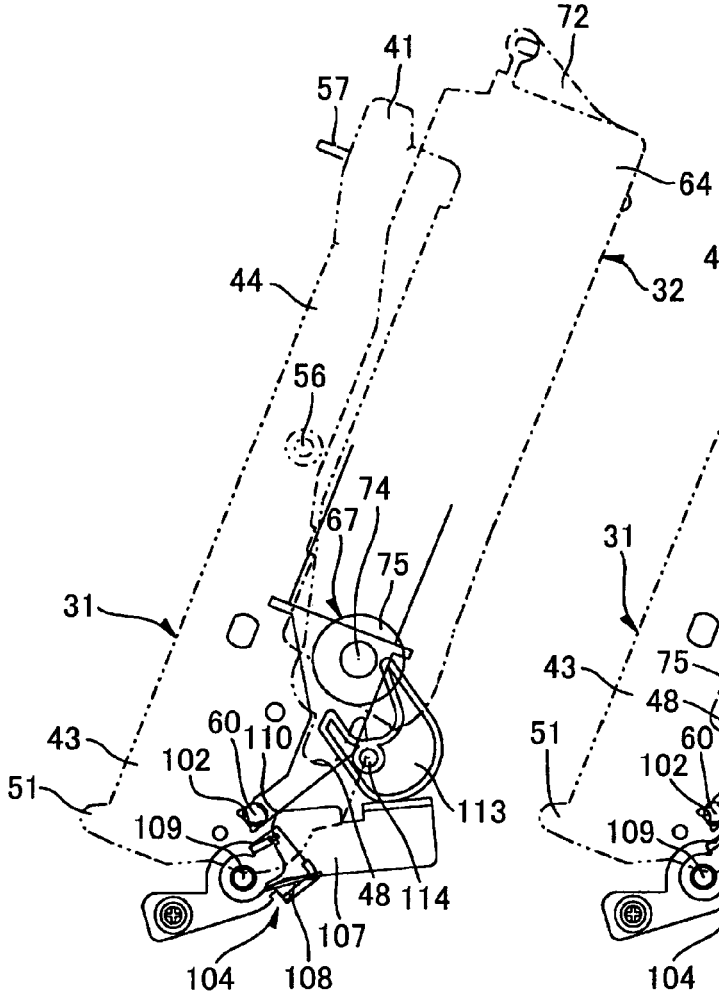
FIG. 33(*a*) and FIG. 33(*b*) are a series of side views showing the process of engaging a pressing cam with a drum shaft when mounting the drum cartridge in the process accommodating section (the engagement operation being associated with the mounting and removal of the developer cartridge) according to a modification, wherein FIG. 33(*a*) shows the pressing cam prior to engagement and FIG. 33(*b*) shows the pressing cam after engagement is complete.
Figure 33B:
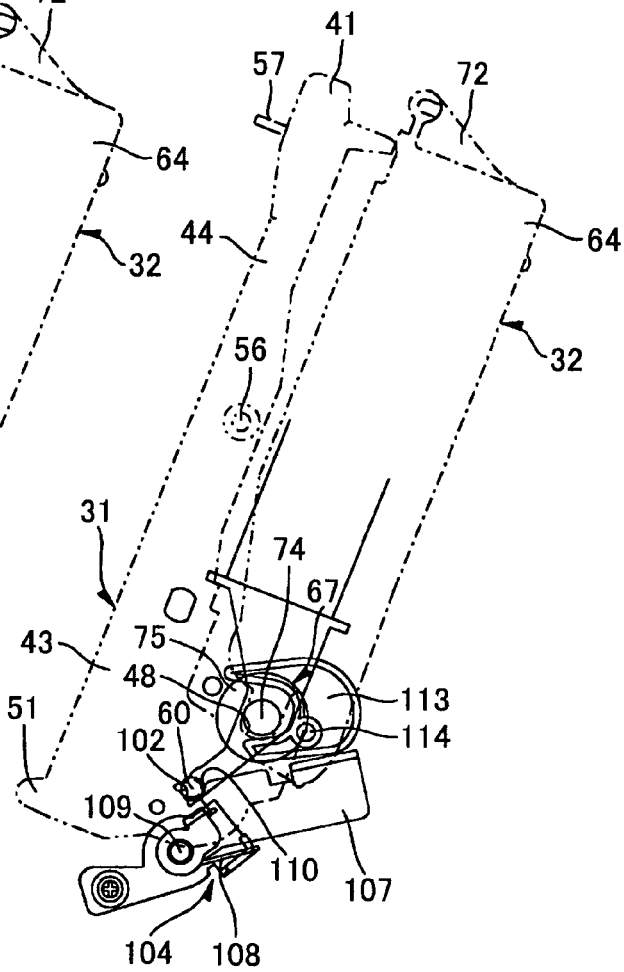

In FIG. 33(*a*), like parts and components with those in FIGS. 22 and 23 are designated with the same reference numerals to avoid duplicating description. As shown in FIG. 33, the fitting member 113 is a plate having a substantially U-shape. When the drum cartridge 31 is mounted in the drum-accommodating section 13 and the developer cartridge 32 is mounted onto or removed from the drum cartridge 31 in the developer-accommodating section 14, the fitting member 113 engages with or separates from the metal roller shaft 74 of the developing roller 67. The fitting member 113 is rotatably supported on a rotational shaft 114 that protrudes outward in the widthwise direction from the outer surfaces of the left side plate 8 and right side plate 9. With this construction, the fitting member 113 can rotate forward or in reverse as the metal roller shaft 74 is mounted and removed.

The upper edge on the front side of the pressing cams 107 contacts the fitting member 113. The urging force of the urging spring 108 constantly urges the pressing cam 107 to rotate in a direction (counterclockwise in FIG. 33(*a*)) by which the contact part 110 pushes the drum shaft 60 into the receiving part 102 and by which the upper edge of the pressing cam 107 pushes the fitting member 113 into the mounting path of the developer cartridge 32 (removing path of the metal roller shaft 74) to engage the metal roller shaft 74 as shown in FIG. 33(*b*).

FIG. 33(*a*) shows the developer cartridge 32 in the removed state. When the developer cartridge 32 has been shifted to this state, the metal roller shaft 74 has been withdrawn, causing the fitting member 113 to rotate out of the moving path of the metal roller shaft 74 against the urging force of the urging spring 108. In FIG. 33(*a*), the fitting member 113 is maintained in this withdrawn state.

FIG. 33(*b*) shows the developer cartridge 32 in a mounted state. Here, the metal roller shaft 74 has engaged with the fitting member 113, causing the fitting member 113 to rotate (counterclockwise in FIG. 33(*b*)) into the mounting path of the developer cartridge 32. At this time, the urging force of the urging spring 108 rotates the pressing cam 107 so that the contact part 110 closes the guiding grooves 101 and presses the drum shaft 60 into the receiving part 102, thereby restricting movement of the drum shaft 60 in the receiving part 102.

In the drum shaft locking mechanism 104 shown in FIGS. 33(*a*) and 33(*b*), the contact part 110 of the pressing cam 107 advances into and recedes from the guiding groove 101, that is, the moving path of the drum shaft 60 in association with the mounting and removal of the developer cartridge 32. This construction therefore ensures the reliable mounting and removal of the drum cartridge 31.

Figure 34:
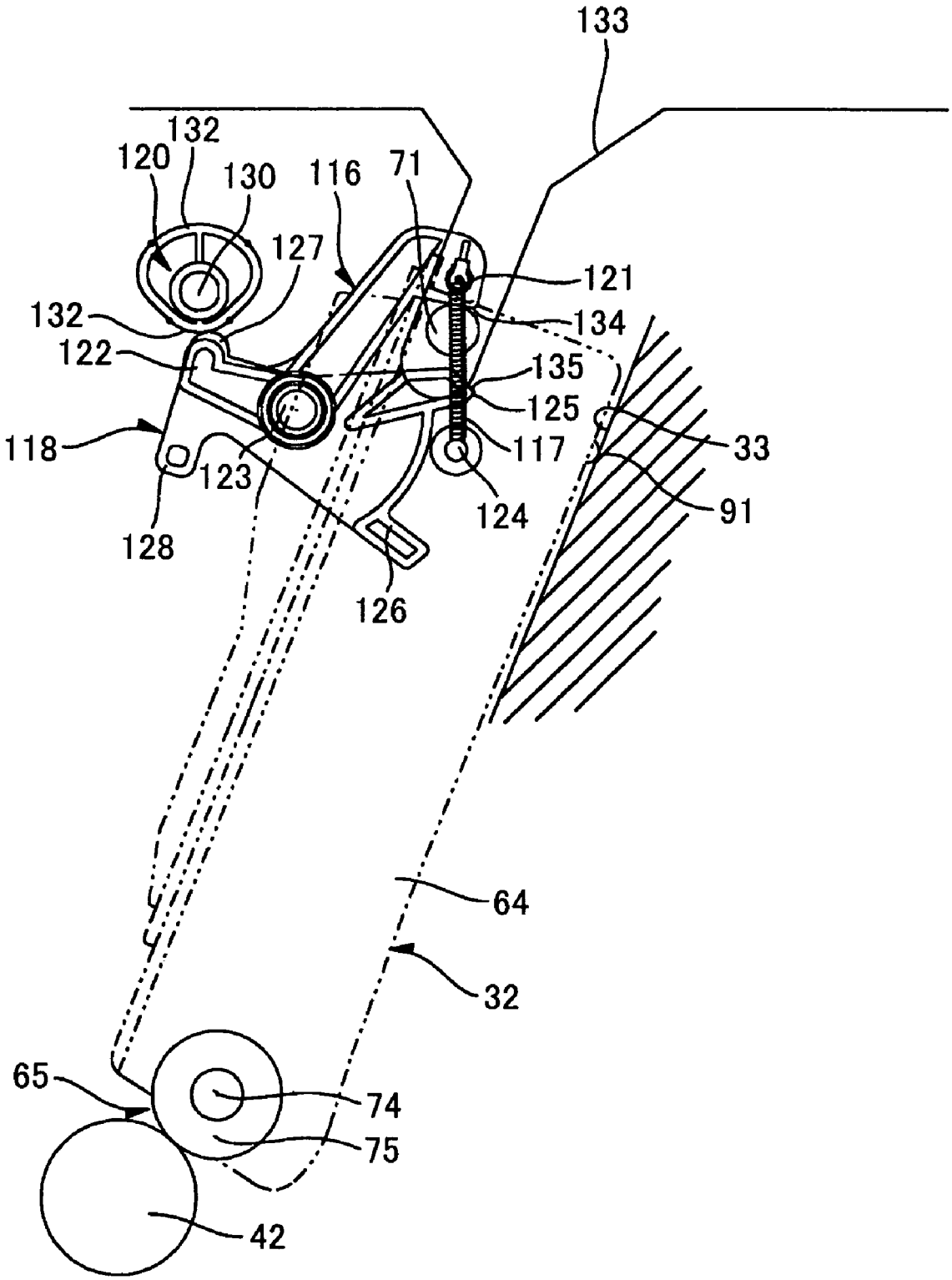
FIG. 34 is a side view showing a variation of the second pressing member in a contacting/separating mechanism according to another modification of the preferred embodiment.

In the contacting/separating mechanism 106 described above, the second urging spring 119 is provided on the second pressing member 118. However, the second pressing member 118 may be configured as shown in FIG. 34. In this construction, the second pressing member 118 is rotatably supported on the support shaft 123 and has a center of gravity that ensures the rotation restricting pawl part 126 always drops and that the cam contacting protrusion 127 always rises. This construction eliminates the need for the second urging spring 119.

While the invention has been described in detail with reference to the specific embodiment thereof, it would be apparent to those skilled in the art that various changes and modifications may be made therein without departing from the spirit of the invention.

For example, while the preferred embodiment describes a tandem-type color laser printer 1 that transfers images directly from the photosensitive drums 42 to the paper 3, the present invention is not limited to this type of device. For example, the present invention may be applied to an intermediate transfer-type color laser printer that temporarily transfers toner images in each color from photosensitive members to an intermediate transfer member and subsequently transfers the entire multicolor image onto the paper. The present invention may also be applied to a monochrome laser printer.

What is claimed is:

1. An image-forming device, comprising:

a housing; and a first cartridge and a second cartridge that are detachably mounted in the housing and that have a process member used in an image-forming process, the first cartridge being formed thicker than the second cartridge in a thickness direction orthogonal to a mounting direction of the first and second cartridges, the housing having a cartridge-accommodating section that accommodates the first and second cartridges therein, the cartridge-accommodating section including first and second accommodating sections that are disposed in the mounting direction of the first and second cartridges and that are partly displaced with respect to each other in the thickness direction;

the second accommodating section being disposed upstream of the first accommodating section with respect to the mounting direction of the first and second cartridges and being formed thicker than the first cartridge in the thickness direction and thinner than both the first and second cartridges together when the first and second cartridges are accommodated in the cartridge-accommodating section, the first accommodating section being formed thicker than the first and second cartridges together in the thickness direction when the first and second cartridges are accommodated in the cartridge-accommodating section, wherein the first accommodating section defines a first accommodating region that accommodates the first cartridge therein; and wherein the second accommodating section defines a second accommodating region that accommodates the second cartridge therein.

2. An image-forming device, comprising:

a housing; and first and second cartridges that are detachably mounted in the housing and that have a process member used in an image-forming process, the housing having a cartridge-accommodating section that accommodates therein the first and second cartridges, wherein the cartridge-accommodating section includes first and second accommodating sections that are disposed in a mounting direction of the first and second cartridges and that are partly displaced with respect to each other in a thickness direction orthogonal to the mounting direction of the first and second cartridges, the first accommodating section being disposed downstream of the second accommodating section with respect to the mounting direction of the first and second cartridges and being formed wider than the second accommodating section in the thickness direction orthogonal to the mounting direction of the first and second cartridges, the first accommodating section having an expanded region, by which the first accommodating section is wider than the second accommodating section, the first cartridge having a protruding part that is disposed in the expanded region when the first cartridge is mounted in the first accommodating section, the cartridge-accommodating section having a shape that restricts movement of the first cartridge in the mounting direction when the protruding part is positioned in the expanded region, but that allows movement of the first cartridge in the mounting direction when the protruding part is moved from the expanded region in the thickness direction by a distance equivalent to the thickness of the second cartridge, wherein the housing has a guide part that guides the first cartridge when the first cartridge is mounted in the cartridge-accommodating section, wherein the guide part includes:

an upstream guide part that extends in a first direction and guides the first cartridge to pass through the second accommodating section; and a downstream guide part that extends in a second direction different from the first direction and guides the first cartridge to be mounted in the first accommodating section, thereby allowing the protruding part to enter the expanded region after the first cartridge passes through the second accommodating section.

3. An image-forming device, comprising:

a housing; and a first cartridge and a second cartridge that are detachably mounted in the housing and that have a process member used in an image-forming process, the first cartridge being formed thicker than the second cartridge in a thickness direction orthogonal to a mounting direction of the first and second cartridges, the housing having a cartridge-accommodating section that accommodates the first and second cartridges therein, the cartridge-accommodating section including first and second accommodating sections that are disposed in the mounting direction of the first and second cartridges and that are partly displaced with respect to each other in the thickness direction;

the second accommodating section being disposed upstream of the first accommodating section with respect to the mounting direction of the first and second cartridges and being formed thicker than the first cartridge in the thickness direction and thinner than both the first and second cartridges together when the first and second cartridges are accommodated in the cartridge-accommodating section;

the first accommodating section being formed thicker than the first and second cartridges together in the thickness direction when the first and second cartridges are accommodated in the cartridge-accommodating section; wherein the first accommodating section defining a first accommodating region in which the first cartridge is accommodated;

the second accommodating section defines a second accommodating region that allows passage of the first cartridge when the first cartridge is mounted in or removed from the first accommodating section and that accommodates the second cartridge therein; and the housing includes a distended part that distends toward the second accommodating region to restrict passage of the first cartridge in the second accommodating section when the second cartridge accompanies the first cartridge and to allow passage of the first cartridge through the second accommodating region of the second accommodating section when the second cartridge fails to accompany the first cartridge;

wherein the first cartridge has a first casing, wherein the first casing includes:

a main body that is accommodated in the first accommodating region of the first accommodating section after passing through the second accommodating region of the second accommodating section when no second cartridge accompanies the first cartridge; and an extended part that extends to the second accommodating section when the first cartridge is mounted in the first accommodating section, wherein the second accommodating section has an extended part accommodating region that accommodates the extended part.

4. The image-forming device as claimed in claim 3, wherein the main body and the extended part are integrally formed with each other.

5. The image-forming device as claimed in claim 3, wherein the first casing has a rotational support part provided on the main body that is rotatably supported in the first accommodating section, wherein by supporting the rotational support part in the first accommodating section and rotating the first cartridge about the rotational support part, the first cartridge is mounted in the first accommodating section with the extended part withdrawn from the second accommodating region toward the extended part accommodating region to allow the second cartridge to be accommodated in the second accommodating region of the second accommodating section.

6. The image-forming device as claimed in claim 5, further comprising a rotation-restricting portion that restricts the rotation of the first cartridge when the first cartridge is mounted in the first accommodating section.

7. The image-forming device as claimed in claim 3, wherein the housing further has:

a first positioning part in the second accommodating section on its side, on which the distended part is provided, the first positioning part positioning the first cartridge through contact with the extended part; and a second positioning part in the second accommodating section on its side opposite the side on which the distended part is provided, the second positioning part positioning the second cartridge through contact with the second cartridge.

8. The image-forming device as claimed in claim 3, wherein the first casing has a protrusion that is formed on a side facing the distended part and that protrudes toward the distended part to prevent the first casing from sliding against the distended part when mounting the first cartridge in the first accommodating section.

9. The image-forming device as claimed in claim 3, wherein the process member includes a charger disposed on the main body of the first casing.

10. The image-forming device as claimed 9, wherein the protrusion is disposed on the main body of the first casing downstream of the charger with respect to the mounting direction of the first cartridge.

11. The image-forming device as claimed in claim 8, wherein the housing includes a rail part in the second accommodating section, the protrusion sliding along the rail part, and wherein by placing the protrusion in contact with the rail part, a gap is formed between the distended part and the first casing.

12. The image forming device as claimed in claim 11, wherein the rail part includes a pair of rail parts that are provided in the second accommodating section and that extend in the mounting direction of the first cartridge, facing each other with one on either side of the distended part, wherein the protrusion includes a pair of protrusions that are disposed on the first casing to correspond to the pair of rail parts, respectively.

13. The image-forming device as claimed in claim 3, wherein the extended part of the first casing includes a pair of extended side parts that extend in the mounting direction of the first cartridge, the pair of extended side parts opposing each other, with one on either side of the distended part when the first cartridge is mounted in the first accommodating section with the extended part being accommodated in the extended part accommodating region, wherein each extended side part includes a reinforcing part that is provided in the mounting direction of the first cartridge and reinforcing the corresponding extended side part.

14. The image-forming device as claimed in claim 13, wherein the extended part of the first casing includes a holding part that facilitates mounting and removal of the first cartridge with respect to the first accommodating section.

15. The image-forming device as claimed in claim 14, wherein the first casing includes an extended end part that couples with upstream ends of the pair of extended side parts with respect to the mounting direction of the first cartridge, wherein the holding part is provided on the extended end parts.

16. The image-forming device as claimed in claim 3, wherein the process member includes a photosensitive member and a developer storing portion, wherein the photosensitive member is provided in the first cartridge, and the developer storing portion is provided in the second cartridge.

17. The image-forming device as claimed in claim 16, herein the first casing positions the charger, the photosensitive member, and the second cartridge with respect to one another.

18. The image-forming device as claimed in claim 17, wherein the process member includes a developing roller that is provided in the second cartridge, wherein the first casing positions the second cartridge based on a shaft of the developing roller.

19. The image-forming device as claimed in claim 18, wherein the first casing has a rotational support part provided on the main body that is rotatably supported in the first accommodating section, wherein by supporting the rotational support part in the first accommodating section and rotating the first cartridge about the rotational support part, the first cartridge is mounted in the first accommodating section with the extended part withdrawn from the second accommodating region toward the extended part accommodating region to allow the second cartridge to be accommodated in the second accommodating region of the second accommodating section, wherein the photosensitive member is disposed in the main body of the first casing, and wherein the rotational support part includes a supporting shaft that supports the photosensitive member in the main body of the first casing.

20. The image-forming device as claimed in claim 16, wherein the first casing includes a shaft that projects in the longitudinal direction of the photosensitive member, wherein the housing further includes, in the first accommodating section:

a receiving part that receives the shaft of the first casing; and a pressing member that is retractably disposed along a path on which the shaft moves when mounting the first cartridge in or removing the first cartridge from the first accommodating section, the pressing member advancing into and retracting from the path of the shaft and pressing the shaft into the receiving part when the first cartridge is mounted in the first accommodating section.

21. The image-forming device as claimed in claim 20, wherein the pressing member advances into or retracts from the path of the shaft in association with the first cartridge being mounted in or removed from the first accommodating section.

22. The image-forming device as claimed in claim 20, wherein the pressing member advances into and retracts from the path of the shaft in association with the second cartridge being mounted on or detached from the first cartridge.

23. The image-forming device as claimed in claim 22, wherein the shaft includes a supporting shaft that supports the photosensitive member.

24. The image-forming device as claimed in claim 16, wherein the process member includes a developing roller, wherein the second cartridge includes:

a second casing;

the developing roller disposed in the second casing with a portion exposed from the second casing;

a pressing part that is disposed on the second casing facing the peripheral surface of the developing roller exposed from the second casing along the length of the developing roller from its side, the side facing a wall of the housing that defines a side of the second accommodating section opposite to the distended part when the second cartridge is mounted in the second accommodating section, the pressing part applying pressure to the peripheral surface of the developing roller to prevent leakage of developer; and a sliding part that protrudes further downstream than the pressing part in the mounting direction and nearer to the wall than the pressing part when the second cartridge is mounted in the second accommodating section, the sliding part contacting and sliding along the wall when the second cartridge is mounted in the second accommodating section.

25. The image-forming device as claimed in claim 3, further including an exposing device mounted in the housing, wherein the distended part is part of the exposing device.

26. The image-forming device as claimed in claim 3, wherein the first cartridge and second cartridge form one set, with one set being provided for each of a plurality of different colors.

27. The image-forming device as claimed in claim 26, further including a feeding portion that picks up and feeds a recording medium; and a discharging portion that discharges the recording medium from the housing, wherein the plurality of sets of the first and second cartridges are disposed between the feeding portion and the discharging portion along a conveying path for conveying the recording medium, wherein the feeding portion and discharging portion are disposed so that a pickup direction in which the feeding portion picks up the recording medium is opposite a conveying direction in which the plurality of sets of the first and second cartridges convey the recording medium past image-forming positions for sequentially forming images; and wherein the conveying direction for conveying the recording medium past the image-forming positions is opposite a discharging direction in which the discharging portion discharges the recording medium.

28. The image-forming device as claimed in claim 27, wherein the first and second cartridges are mounted and removed in a direction slanted with respect to the conveying direction for conveying the recording medium in the image-forming device and the thickness direction of the recording medium orthogonal to the conveying direction.

29. The image-forming device as claimed in claim 28, further comprising a plurality of exposing devices, one for each of the plurality of sets of first and second cartridges, wherein the exposing devices are alternately disposed with the sets of first and second cartridges along the conveying direction for conveying the recording medium through the image-forming device.

30. The image-forming device as claimed in claim 29, wherein the first cartridge has a first casing, wherein the first casing includes:

a main body that is accommodated in the first accommodating region of the first accommodating section after passing through the second accommodating region of the second accommodating section when no second cartridge accompanies the first cartridge; and an extended part that extends to the second accommodating section when the first cartridge is mounted in the first accommodating section, wherein the second accommodating section has an extended part accommodating region that accommodates the extended part, wherein the extended part of the first casing is interposed between each exposing device and each of the second cartridges, wherein the extended part has an opening to allow passage of a laser beam that the exposing device emits toward the photosensitive member.

31. The image-forming device as claimed in claim 2, wherein the first accommodating section defines a first accommodating region that accommodates the first cartridge therein; and wherein the second accommodating section defines a second accommodating region that accommodates the second cartridge therein.

* * * * *